US006795044B2

(12) United States Patent
Tanaka et al.

(10) Patent No.: US 6,795,044 B2
(45) Date of Patent: Sep. 21, 2004

(54) PLASMA DISPLAY PANEL AND DRIVING METHOD THEREOF

(75) Inventors: Yoshito Tanaka, Tokyo (JP); Hajime Homma, Tokyo (JP); Tadashi Nakamura, Tokyo (JP)

(73) Assignee: NEC Corporation, Tokyo (JP)

( * ) Notice: Subject to any disclaimer, the term of this patent is extended or adjusted under 35 U.S.C. 154(b) by 525 days.

(21) Appl. No.: 09/895,165

(22) Filed: Jul. 2, 2001

(65) Prior Publication Data

US 2002/0018033 A1 Feb. 14, 2002

(30) Foreign Application Priority Data

Jun. 30, 2000 (JP) ..... 2000-197977
Jun. 28, 2001 (JP) ..... 2001-196496

(51) Int. Cl.[7] ..... G09G 3/28

(52) U.S. Cl. ..... 345/60; 345/61; 345/62; 345/63; 345/64; 345/65; 345/66; 345/67; 345/68; 315/169.1; 315/169.2; 315/169.3; 315/169.4; 315/306; 315/313; 315/336

(58) Field of Search ..... 345/60, 61, 62, 345/63, 64, 65, 66, 67, 68; 315/169.1, 169.2, 169.3, 169.4, 306, 313, 336

(56) References Cited

U.S. PATENT DOCUMENTS 4,638,218 A * 1/1987 Shinoda et al. ..... 315/169.4
6,278,422 B1 * 8/2001 Ukai et al. ..... 345/63
6,288,691 B1 * 9/2001 Mikoshiba et al. ..... 345/60
6,597,334 B1 * 7/2003 Nakamura ..... 345/68

FOREIGN PATENT DOCUMENTS

| | | |
|---|---|---|
| JP | 2-220330 A | 9/1990 |
| JP | 2629944 | 4/1997 |
| JP | 10-207420 A | 8/1998 |
| JP | 2000-56731 A | 2/2000 |
| JP | 2000-56731 | 2/2000 |
| KR | 1998-69853 A | 10/1998 |

* cited by examiner

*Primary Examiner*—Richard Hjerpe
*Assistant Examiner*—Jean Lesperance
(74) *Attorney, Agent, or Firm*—Sughrue Mion, PLLC

(57) ABSTRACT

Scanning electrodes are shared between adjacent display lines. Sustaining electrodes are disposed between the scanning electrodes by two. The sustaining electrodes form display lines by gaps with adjacent scanning electrodes. The sustaining electrodes are separated into a first sustaining electrode group in which a plurality of sustaining electrodes disposed at the one side of the scanning electrode are commonly connected and a second sustaining electrode group in which a plurality of sustaining electrodes disposed at the other side of the scanning electrode are commonly connected to be independently driven.

61 Claims, 28 Drawing Sheets

FIG. 27

| 12e / 12d | ... | 153 | 154 | 155 | 156 | 157 | ... |
|---|---|---|---|---|---|---|---|
| ⋮ | | ⋮ | ⋮ | ⋮ | ⋮ | ⋮ | |
| 153 | ... | 1100100100 | 1100100000 | 1100100010 | 1100100001 | 0111001110 | ... |
| | | 1100100101 | 1010101111 | 1001111101 | 1001111011 | 1010110000 | |
| 154 | ... | 0110111001 | 1011000110 | 1100100010 | 0110111001 | 1100100010 | ... |
| | | 1011000010 | 1011000111 | 1001111011 | 1011000110 | 0110111111 | |
| 155 | ... | 1001111001 | 1100100010 | 0111010010 | 1100011111 | 1011000101 | ... |
| | | 0111001110 | 1010101111 | 0111010011 | 1100100100 | 0110111010 | |
| 156 | ... | 0110111110 | 1011000111 | 1001111000 | 1100100100 | 1010110000 | ... |
| | | 0111010000 | 0110111000 | 1010101111 | 1001111011 | 0110111111 | |
| 157 | ... | 1011001000 | 1010110000 | 0110111110 | 0110111100 | 1011000111 | ... |
| | | 1100011111 | 1010101111 | 1100100100 | 1011000110 | 0110111010 | |
| ⋮ | | ⋮ | ⋮ | ⋮ | ⋮ | ⋮ | |

PLASMA DISPLAY PANEL AND DRIVING METHOD THEREOF

BACKGROUND OF THE INVENTION

1. Field of the Invention

The present invention relates to a plasma display panel performing an AC discharge type matrix display and a driving method thereof.

2. Description of the Related Art

A first prior art of a conventional plasma display panel and a driving method thereof will be described, referring to the drawings. FIG. 1 is a partially cross sectional view illustrating the conventional plasma display panel. In the plasma display panel, two isolation substrates 1*a* and 1*b* of a front surface and a rear surface made of glass are provided.

On the isolation substrate 1*a*, transparent scanning electrodes 2 and sustaining electrodes 3 are formed, and trace electrodes 4 are arranged to overlap the scanning electrodes 2 and the sustaining electrodes 3 in order to make the resistance values of the electrodes be lowered. Also, a first dielectric layer 9 is formed to cover the scanning electrode 2 and the sustaining electrode 3, and a protective layer 10 made of magnesium oxide or the like is formed to protect the dielectric layer 9 from discharge.

On the isolation substrate 1*b*, data electrodes 5 that are extended in perpendicular to the scanning electrodes 2 and the sustaining electrodes 3 are formed. Also, a second dielectric layer 11 is formed to cover the data electrode 5. On the dielectric layer 11, a partition wall 7 extended in the same direction as that of the data electrode 5 is formed to partition a display cell that is a unit of display. Moreover, on the side surface of the partition wall 7 and the surface of the dielectric layer 11 on which the partition wall 7 is not formed, a fluorescent layer 8 is formed to transform ultraviolet light generated by discharging of discharge gas into visible light.

A space sandwiched between the isolation substrates 1*a* and 1*b* and partitioned by the partition wall 7 becomes a discharge space 6 filled by discharge gas consisting of helium, neon, xenon, and the like, or mixture of gases thereof.

In the above-configured plasma display panel, surface discharge 100 is generated between the scanning electrode 2 and the sustaining electrode 3.

FIG. 2 is a schematic diagram illustrating an electrode arrangement of the conventional plasma display panel. One display cell 12 is provided on the intersection of one scanning electrode 2, one sustaining electrode 3, and one data electrode 5, which is in perpendicular to the electrodes. The scanning electrode 2 is connected to a scan driver integrated circuit IC (not shown) so as to individually apply a scan voltage pulse. Since the sustaining electrode 3 applies only a common waveform, it is all electrically commonly connected on the end portion of the panel or driving circuit.

Subsequently, the selective display operation of the display cell will be described. FIG. 3 is a timing chart illustrating a voltage pulse applied to each electrode. In FIG. 3, a period A is a pre-discharge period for easily generating discharge, a period B is a selecting operation period for selecting ON/OFF of display of each display cell, a period C is a sustaining discharge period for performing display discharge in all the selected display cells, and a period D is a sustaining erasing period for stopping display discharge.

First, in the pre-discharge period A, with applying a voltage exceeding a discharge start threshold voltage between the scanning electrode 2 and the sustaining electrode 3, discharge is generated in all the display cells 12 so that wall charge is formed. After that, with using weak discharge due to a dull pulse, wall charge formed on the scanning electrode 2 and the sustaining electrode 3 is neutralized and erased.

Subsequently, in the selecting operation period B, with sequentially applying a scan pulse to each scanning electrode 2 and simultaneously applying a data pulse to the data electrode 5 in accordance with an image data, wall charge is formed only on the scanning electrode 2 of the display cell 12 to perform display.

After that, in the sustaining discharge period C, sustaining pulses having inverted phases with each other are applied to all the scanning electrodes 2 and all the sustaining electrodes 3. As a result, discharge for display is generated only in the display cell 12 in which the wall charge is formed during the selecting operation period B.

In the sustaining erasing period D, the wall charge is neutralized and erased by a dull pulse, thereby returning to the initial state.

In the practical plasma display driving, a period from the above-mentioned pre-discharge period A or the selecting operation period B to the sustaining erasing period D has been one sub-field, a combination of a plurality of sub-fields in which the number of pulses is changed in the sustaining discharge period C has been one field, and display brightness has been regulated with selection of ON/OFF of each sub-field. At this time, sub-field selection state for input gradation is determined referring to a lookup table (LUT). In the LUT, the sub-field selection state for all the input gradation is uniquely described.

In addition, as described above, in a manner that the sustaining period when only sustaining discharge is performed is independent of other periods, brightness can be controlled by means of changing a cycle of sustaining pulse applied in the sustaining discharge period C, and high brightness can be achieved by means of supplying high frequency.

Subsequently, a second prior art of a conventional display penal and a driving method thereof will be described. FIG. 4 is a schematic diagram illustrating an electrode arrangement in a conventional plasma display panel having an electrode structure in which a scanning electrode is shared between upper and lower adjacent display cells. Each discharge space of two display cells 12 sharing the scanning electrode 2 is physically separated by a partition wall (not shown in FIG. 4) formed on the scanning electrode 2. The plasma display panel having such a structure is disclosed, for example, in Japanese Patent No. 2629944.

FIG. 5 is a timing chart illustrating the conventional driving method disclosed in Japanese Patent No. 2629944. In the interval of the sustaining pulse, a pre-discharge pulse and a selective erasing pulse are sequentially applied to a scanning electrode Y, and the pre-discharge pulse is selectively applied to a sustaining electrode X in the upper and lower lines so that the upper and lower display lines are individually selected.

Also, a plasma display panel (a third prior art) having a structure in which display cells are divided into a plurality of blocks and a plurality of scanning electrodes are shared in the blocks is disclosed in Japanese Patent Laid-Open No. 2000-56731. In the conventional plasma display panel, an erasing selection is adapted in the same manner as that of the above-mentioned Japanese Patent No. 2629944.

In the conventional plasma display panel shown in the first prior art, because each scanning electrode 2 is individually selected, the output terminals of scan driver IC are needed as the same number as the scanning electrodes 2 (that is, the number of display lines). On the other hand, because high withstand voltage and high speed of response are needed for the scan driver IC, its price is high so that its using quantity needs to be reduced in order to cut down cost.

Also, in the conventional plasma display panel shown in the second prior art, the number of scanning electrodes 2 is reduced by half with respect to the number of display lines so that the number of scan drivers IC can be reduced by half. However, there are problems in the driving method disclosed in Japanese Patent No. 2629944, as follows.

Firstly, two kinds of pulses of a pulse Vwy for illuminating all the display cells on the display lines and a pulse Vey for selecting the display cells need to be sequentially applied to the scanning electrode. And, in the practical driving, a pulse for stopping discharge of each display line (not shown) needs to be sequentially applied to the scanning electrode. Consequently, a scan circuit including the scan driver IC becomes complex, thereby causing a problem that cost merit that the number of scan drivers IC is reduced cannot be sufficiently achieved.

Secondly, because many pulses are applied within a constant pulse for display (a sustaining pulse), it is difficult to shorten a cycle of the sustaining pulse. Because brightness in the plasma display panel is determined by the number of discharge times, and as a result, there is a problem that high brightness cannot be easily achieved.

Thirdly, because several times (about 5 times) of discharges are performed in the (non-selected) display cell in which display is not performed, there is a problem that brightness of black level is increased so that contrast of display image is deteriorated.

In the erasing selective type plasma display panel as the second and third prior arts, there is a problem that brightness of black level is high and contrast of whole image plane is lacking so that sufficient quality of image cannot be achieved.

SUMMARY OF THE INVENTION

It is an object of the present invention to provide a plasma display panel in which high contrast can be obtained, and cost is reduced without reducing brightness, and progressive driving is available, and a driving method thereof.

According to one aspect of the present invention, a plasma display panel comprises: a first substrate and a second substrate disposed opposite to each other; a plurality of scanning electrodes provided on a face side of the first substrate opposite to the second substrate and extended parallel to a first direction; a plurality of sustaining electrodes provided by two between adjacent two scanning electrodes among the scanning electrodes; a plurality of data electrodes provided on a face side of the second substrate opposite to the first substrate and extended to a second direction perpendicular to the first direction; a dielectric layer covering the scanning electrodes and the sustaining electrodes; and a partition wall partitioning the scanning electrodes into two regions in the second direction. The scanning electrodes are shared between adjacent display lines. The sustaining electrodes are separated into a first sustaining electrode group in which a plurality of the sustaining electrodes disposed at one side of the scanning electrode are commonly connected and a second sustaining electrode group in which a plurality of sustaining electrodes disposed at the other side of the scanning electrode are commonly connected to be independently driven.

In the present invention, the scanning electrodes are shared between adjacent display lines and the plurality of sustaining electrodes are separated into a first sustaining electrode group in which a plurality of the sustaining electrodes disposed at one side of the scanning electrode are commonly connected and a second sustaining electrode group in which a plurality of sustaining electrodes disposed at the other side of the scanning electrode are commonly connected to be independently driven. Accordingly, display line can be selected by the driving method of a combination of the scanning electrodes and the sustaining electrodes disposed at the both side thereof. Consequently, the numbers of outputs of scan drivers IC can be reduced about by half of the number of display lines.

According to another aspect of the present invention, a driving method of a plasma display panel, the plasma display panel having: a first substrate and a second substrate disposed opposite to each other; a plurality of scanning electrodes provided on a face side of the first substrate opposite to the second substrate and extended parallel to a first direction, the scanning electrodes being commonly connected by a plural number in a sequence of order to make scanning electrode groups; a plurality of sustaining electrodes disposed by one between adjacent two scanning electrodes among the scanning electrodes, the sustaining electrodes being commonly connected so that the sustaining electrodes forming display lines between the scanning electrodes belonging to one of the scanning electrode groups belong to different sustaining electrode groups; a plurality of data electrodes provided on a face side of the second substrate opposite to the first substrate and extended to a second direction perpendicular to the first direction; and a dielectric layer covering the scanning electrodes and the sustaining electrodes, the method comprises the steps of: generating a pre-discharge between one of the sustaining electrode groups and each of the scanning electrode groups; and performing a selecting operation in accordance with an image data of each of display cells in display lines generated with the pre-discharge. Generating the pre-discharge and performing the selecting operation are repeated while sequentially selecting the sustaining electrode group. At least one of the steps of performing the selecting operation has a step of generating an opposite discharge between the scanning electrode and the data electrode in a display cell performing display, thereby forming wall charge on the scanning electrode and the sustaining electrode.

According to another aspect of the present invention, a driving method of a plasma display panel, the plasma display panel having: a first substrate and a second substrate disposed opposite to each other; a plurality of scanning electrodes provided on a face side of the first substrate opposite to the second substrate and extended parallel to a first direction, the scanning electrodes being shared between adjacent display lines; a plurality of sustaining electrodes disposed by two between adjacent two scanning electrodes among the scanning electrodes, the sustaining electrodes being separated into a first sustaining electrode group in which a plurality of sustaining electrodes disposed at one side of the scanning electrode are commonly connected and a second sustaining electrode group in which a plurality of sustaining electrodes disposed at the other side of the scanning electrode are commonly connected; a plurality of data electrodes provided on a face side of the second substrate opposite to the first substrate and extended to a second direction perpendicular to the first direction; a dielectric layer covering the scanning electrodes and the sustaining electrodes; and a partition wall partitioning the scanning electrodes into two regions in the second direction, the method comprises the steps of: generating a first pre-discharge between the first sustaining electrode group and the scanning electrodes; performing a selecting operation in display lines generated with the first pre-discharge; generating a second pre-discharge between the second sustaining electrode group and the scanning electrodes; and performing a selecting operation in display lines generated with the second pre-discharge.

According to another aspect of the present invention, a driving method of a plasma display panel, the plasma display panel having: a first substrate and a second substrate disposed opposite to each other; a plurality of scanning electrodes provided on a face side of the first substrate opposite to the second substrate and extended parallel to a first direction, the scanning electrodes being shared between adjacent display lines; a plurality of sustaining electrodes disposed by one between adjacent two scanning electrodes among the scanning electrodes, the sustaining electrodes being shared between adjacent display lines and being separated into a first sustaining electrode group in which an odd number of the sustaining electrodes are commonly connected and a second sustaining electrode group in which an even number of the sustaining electrodes are commonly connected; a plurality of data electrodes provided on a face side of the second substrate opposite to the first substrate and extended to a second direction perpendicular to the first direction; a dielectric layer covering the scanning electrodes and the sustaining electrodes; and a partition wall partitioning the scanning electrodes and the sustaining electrodes into two regions, respectively, in the second direction, the method comprises the steps of: generating a first pre-discharge between the first sustaining electrode group and the scanning electrodes; performing a selecting operation in display lines generated with the first pre-discharge; generating a second pre-discharge between the second sustaining electrode group and the scanning electrodes; and performing a selecting operation in display lines generated with the second pre-discharge.

In the present invention, pre-discharge and selecting operation are performed in the display line included in a first sustaining electrode group, pre-discharge and selecting operation are sequentially performed every display line included in sustaining electrode groups, and then, selecting operation is performed in all the display lines, thereafter, being transferred to a sustaining discharge period for performing sustaining discharge for display. Accordingly, because the selecting operation is performed only in the display line where the pre-discharge was generated, the selecting operation can be individually performed even in the adjacent display lines that share the scanning electrode.

An erasing selective type driving method can be available by providing, in at least one of the steps of generating the pre-discharge and performing the associated selecting operations, with the steps of forming wall charges having an opposite polarity with each other on the scanning electrode and the sustaining electrode, and generating opposite discharge between the scanning electrode and the sustaining electrode to erase wall discharge in the display cell where display is not performed. Consequently, with forming wall charge due to pre-discharge only in the sustaining electrode group where the selecting operation is performed, the selecting operation can be prevented from being performed in the display lines included in the other sustaining electrode group.

At that time, after the step of erasing the wall charge, by inverting polarity of wall charge by generating discharge in the display cell in which wall charge was not erased, erroneous erasing of necessary wall charge in the address period of the next sustaining electrode group can be avoided.

Also, an input selective type driving method can be available by providing, in at least one of the steps of performing the selecting operations, with the step of generating opposite discharge between the scanning electrode and the data electrode in a display cell in which display is performed, thereby forming wall charges on the scanning electrode and the sustaining electrode. In such an input selective type selecting operation, with neutralizing and erasing wall charge by pre-discharge only in the sustaining electrode group which performs the selecting operation, performing a selecting operation in the display line included in other sustaining electrode group can be avoided.

Also, by providing, in the step of generating a first pre-discharge, with the steps of forming wall charge having an opposite polarity to that of a voltage pulse applied to the scanning electrode by pre-discharge on all of the scanning electrodes, and applying an erasing pulse between the first sustaining electrode group and the scanning electrode to erase wall charge by pre-discharge; in the step of performing a selecting operation in the display line generated with the first pre-discharge, with the steps of sustaining a voltage of the first sustaining electrode group as a voltage for generating sustaining discharge between the scanning electrode, and generating opposite discharge between the scanning electrode and the data electrode in a display cell which performs display in the display line in which erasing of wall charge is performed by the pre-discharge, thereby forming wall charge; in the step of generating the second pre-discharge, with the step of applying an erasing pulse between the second sustaining electrode group and the scanning electrode to erase wall charge by the pre-discharge; in the step of performing a selecting operation in a display line generated with the second pre-discharge, with the steps of sustaining a voltage of the first sustaining electrode group as a voltage for not generating sustaining discharge between the scanning electrode, and generating opposite discharge between the scanning electrode and the data electrode in a display cell which performs display in the display line in which erasing of wall charge is performed by the pre-discharge, thereby forming wall charge, in such an input selective type selecting operation, in case that a side included in the first sustaining electrode group is not selected in the display cell which shares the scanning electrode, and a side included in the second sustaining electrode group is selected, although opposite discharge is generated even in the display cell included in the first sustaining electrode group in the address period of the display cell comprising sustaining electrode belonging to the second sustaining electrode group, because the first sustaining electrode group is sustained with such a voltage that sufficient discharge is not generated between the scanning electrode, wall charge is not generated on the scanning electrode and the sustaining electrode, and generation of discharge in the sustaining discharge period can be avoided.

According to another aspect of the present invention, a driving method of a plasma display panel, the plasma display panel having: a first substrate and a second substrate disposed opposite to each other; a plurality of scanning electrodes provided on a face side of the first substrate opposite to the second substrate and extended parallel to a first direction, the scanning electrodes being shared between adjacent display lines; a plurality of sustaining electrodes disposed by two between adjacent two scanning electrodes among the scanning electrodes, the sustaining electrodes being separated into a first sustaining electrode group in which a plurality of sustaining electrodes disposed at one side of the scanning electrode are commonly connected and a second sustaining electrode group in which a plurality of sustaining electrodes disposed at the other side of the scanning electrode are commonly connected; a plurality of data electrodes provided on a face side of the second substrate opposite to the first substrate and extended to a second direction perpendicular to the first direction; a dielectric layer covering the scanning electrodes and the sustaining electrodes; and a partition wall partitioning the scanning electrodes into two regions in the second direction, the method comprises the steps of: forming wall charge in a display cell having the sustaining electrode belonging to the first sustaining electrode group on the basis of image data, thereby the same polarity of wall charge is formed in a display cell sharing the scanning electrode and data electrode with the display cell and having the sustaining electrode belonging to the second sustaining electrode group; erasing wall charge formed in a display cell having the sustaining electrode belonging to the second sustaining electrode group; and forming wall charge in a display cell having the sustaining electrode belonging to the second sustaining electrode group on the basis of display data.

According to another aspect of the present invention, a driving method of a plasma display panel, the plasma display panel having: a first substrate and a second substrate disposed opposite to each other; a plurality of scanning electrodes provided on a face side of the first substrate opposite to the second substrate and extended parallel to a first direction, the scanning electrodes being shared between adjacent display lines; a plurality of sustaining electrodes disposed by one between adjacent two scanning electrodes among the scanning electrodes, the sustaining electrodes being shared between adjacent display lines and being separated into a first sustaining electrode group in which an odd number of the sustaining electrodes are commonly connected and a second sustaining electrode group in which an even number of the sustaining electrodes are commonly connected; a plurality of data electrodes provided on a face side of the second substrate opposite to the first substrate and extended to a second direction perpendicular to the first direction; a dielectric layer covering the scanning electrodes and the sustaining electrodes; and a partition wall partitioning the scanning electrodes and the sustaining electrodes into two regions, respectively, in the second direction, the method comprises the steps of: forming wall charge in a display cell having the sustaining electrode belonging to the first sustaining electrode group on the basis of image data, thereby the same polarity of wall charge is formed in a display cell sharing the scanning electrode and data electrode with the display cell and having the sustaining electrode belonging to the second sustaining electrode group; erasing wall charge formed in a display cell having the sustaining electrode belonging to the second sustaining electrode group; and forming wall charge in a display cell having the sustaining electrode belonging to the second sustaining electrode group on the basis of display data.

According to another aspect of the present invention, a driving method of a plasma display panel, the plasma display panel having: a first substrate and a second substrate disposed opposite to each other; a plurality of scanning electrodes provided on a face side of the first substrate opposite to the second substrate and extended parallel to a first direction, the scanning electrodes being shared between adjacent display lines; a plurality of sustaining electrodes disposed by two between adjacent two scanning electrodes among the scanning electrodes, the sustaining electrodes being separated into a first sustaining electrode group in which a plurality of sustaining electrodes disposed at one side of the scanning electrode are commonly connected and a second sustaining electrode group in which a plurality of sustaining electrodes disposed at the other side of the scanning electrode are commonly connected; a plurality of data electrodes provided on a face side of the second substrate opposite to the first substrate and extended to a second direction perpendicular to the first direction; a dielectric layer covering the scanning electrodes and the sustaining electrodes; and a partition wall partitioning the scanning electrodes into two regions in the second direction, the method comprises the steps of: forming wall charges having different polarities between a display cell having the sustaining electrode belonging to the first sustaining electrode group and a display cell having the sustaining electrode belonging to the second sustaining electrode group, on the scanning electrode and the sustaining electrode; erasing the wall charge in a display cell having the sustaining electrode belonging to the first sustaining electrode group on the basis of display data; inverting the polarity of said wall charges, respectively, in a display cell having said sustaining electrode belonging to said first and second sustaining electrode group; and erasing the wall charge in a display cell having the sustaining electrode belonging to the second sustaining electrode group on the basis of display data.

According to another aspect of the present invention, a driving method of a plasma display panel, the plasma display panel having: a first substrate and a second substrate disposed opposite to each other; a plurality of scanning electrodes provided on a face side of the first substrate opposite to the second substrate and extended parallel to a first direction, the scanning electrodes being shared between adjacent display lines; a plurality of sustaining electrodes disposed by one between adjacent two scanning electrodes among the scanning electrodes, the sustaining electrodes being shared between adjacent display lines and being separated into a first sustaining electrode group in which an odd number of the sustaining electrodes are commonly connected and a second sustaining electrode group in which an even number of the sustaining electrodes are commonly connected; a plurality of data electrodes provided on a face side of the second substrate opposite to the first substrate and extended to a second direction perpendicular to the first direction; a dielectric layer covering the scanning electrodes and the sustaining electrodes; and a partition wall partitioning the scanning electrodes and the sustaining electrodes into two regions, respectively, in the second direction, the method comprises the steps of: forming wall charges having different polarities between a display cell having the sustaining electrode belonging to the first sustaining electrode group and a display cell having the sustaining electrode belonging to the second sustaining electrode group, on the scanning electrode and the sustaining electrode; erasing the wall charge in a display cell having the sustaining electrode belonging to the first sustaining electrode group on the basis of display data; inverting the polarity of said wall charges, respectively, in a display cell having said sustaining electrode belonging to said first and second sustaining electrode group; and erasing the wall charge in a display cell having the sustaining electrode belonging to the second sustaining electrode group on the basis of display data.

By employing such a driving method, the number of driving circuits for driving the sustaining electrode groups, which are driven with each other divided is reduced. As a result, reduction of cost can be achieved.

Also, in the step of addressing, a step of changing a sequence of selecting operations every field consisting of one image plane between a plurality of the display lines or between a display line including the sustaining electrode belonging to the first sustaining electrode group and a display line including the sustaining electrode belonging to the second sustaining electrode group can be provided. In the input selective type, opposite discharge at the time of input is generated even in the non-selective type only in the display cell included in the first sustaining electrode group. Although the intensity of opposite discharge itself is not so intense, when it is generated only in the first sustaining electrode group, there is a case that in all the panels, linear noise occurs with a pitch of twice of display line pitch. However, as above described, it can be prevented from being acknowledged as noise with changing the addressing sequence by field to average discharge due to unnecessary input in all the panels.

A step of changing a sequence of the selecting operation in every step of address or in plural times of steps of address between a plurality of display lines or between the display line including the sustaining electrode belonging to the first sustaining electrode group and the display line including the sustaining electrode belonging to the second sustaining electrode group can be provided. As described above, in some cases of fixing the addressing sequence, although there is a case that linear noise may occur, because the selection of each sub-field is considered as substantially random in a natural image, it can be prevented from being acknowledged as noise with changing the addressing sequence by sub-field to average discharge due to unnecessary input in all the panels.

If changing the address sequence by sub-field and changing the address sequence by field are combined, the discharge due to unnecessary input can be further averaged.

According to another aspect of the present invention, a driving method of a plasma display panel, the plasma display panel having: a first substrate and a second substrate disposed opposite to each other; a plurality of scanning electrodes provided on a face side of the first substrate opposite to the second substrate and extended parallel to a first direction, the scanning electrodes being shared between adjacent display lines; a plurality of sustaining electrodes disposed by two between adjacent two scanning electrodes among the scanning electrodes, the sustaining electrodes being separated into a first sustaining electrode group in which a plurality of sustaining electrodes disposed at one side of the scanning electrode are commonly connected and a second sustaining electrode group in which a plurality of sustaining electrodes disposed at the other side of the scanning electrode are commonly connected; a plurality of data electrodes provided on a face side of the second substrate opposite to the first substrate and extended to a second direction perpendicular to the first direction; a dielectric layer covering the scanning electrodes and the sustaining electrodes; and a partition wall partitioning the scanning electrodes into two regions in the second direction, the method comprises the step of: selecting subfield in consideration of each input gradation level of two display cells sharing the scanning electrode and data electrode, a plurality of gradation levels being expressed with a combination of the selected subfields.

According to another aspect of the present invention, a driving method of a plasma display panel, the plasma display panel having: a first substrate and a second substrate disposed opposite to each other; a plurality of scanning electrodes provided on a face side of the first substrate opposite to the second substrate and extended parallel to a first direction, the scanning electrodes being shared between adjacent display lines; a plurality of sustaining electrodes disposed by one between adjacent two scanning electrodes among the scanning electrodes, the sustaining electrodes being shared between adjacent display lines and being separated into a first sustaining electrode group in which an odd number of the sustaining electrodes are commonly connected and a second sustaining electrode group in which an even number of the sustaining electrodes are commonly connected; a plurality of data electrodes provided on a face side of the second substrate opposite to the first substrate and extended to a second direction perpendicular to the first direction; a dielectric layer covering the scanning electrodes and the sustaining electrodes; and a partition wall partitioning the scanning electrodes and the sustaining electrodes into two regions, respectively, in the second direction, the method comprises the step of: selecting subfield in consideration of each input gradation level of two display cells sharing the scanning electrode and data electrode, a plurality of gradation levels being expressed with a combination of the selected subfields.

Selecting subfield may comprise a step of considering a relation between an input gradation level of the both display cells and an amount of light emission due to interference of the both display cells. It is preferable that the selecting subfield may be performed such that difference between output gradation level including an amount of light emission due to the interference of the both display cells and the input gradation level is minimized.

According to these driving methods, unnecessary light emission (crosstalk) generated between the adjacent display cells is used as a part of display light in accordance with the sub-field selection state in each display cell. Thus, deviation between input gradation and display gradation (output gradation) due to the unnecessary light emission is remarkably suppressed.

In accordance with a plasma display panel and a driving method thereof according to the present invention, because it can be controlled whether the selection is performed by a pre-discharge performed between sustaining electrode corresponding to each scanning electrode or not, the number of outputs of scan driver IC required for display can be reduced. Also, because a sustaining discharge period is shared in all the display lines and only the sustaining discharge can be performed, frequency of sustaining discharge pulse can be increased and then high brightness can be easily achieved.

Using the step of input selective type, brightness of black level can be sufficiently lowered so that high contrast can be achieved.

At least scanning electrode, preferably, including sustaining electrode, can be shared between the upper and lower adjacent display cells so that the number of metal trace electrodes can be reduced and opening rate can be increased.

In such a manner, cost of circuit can be reduced with reducing the substantial number of scanning electrodes with respect to the number of display lines, namely, the number of outputs of scan drivers IC. Also, driving for controlling ON/OFF of display in all the display cells, that is, a complete progressive driving can be achieved in all the fields and sub-fields. Also, even in case where crosstalk occurs, disorder of gradation can be suppressed low. And, high sustaining frequency can be used, and because non-display brightness can be suppressed to be low, image display of high brightness and high contrast can be achieved.

BRIEF DESCRIPTION OF THE DRAWINGS

The above objects, other objects, features and advantages of the present invention will be better understood from the following description taken in conjunction with the accompanying drawings, in which:

FIG. 27 illustrates a part of LUT showing a relation between input gradation and sub-field selection according to the eighth embodiment;

DETAILED DESCRIPTION OF THE PREFERRED EMBODIMENTS

Figure 6:
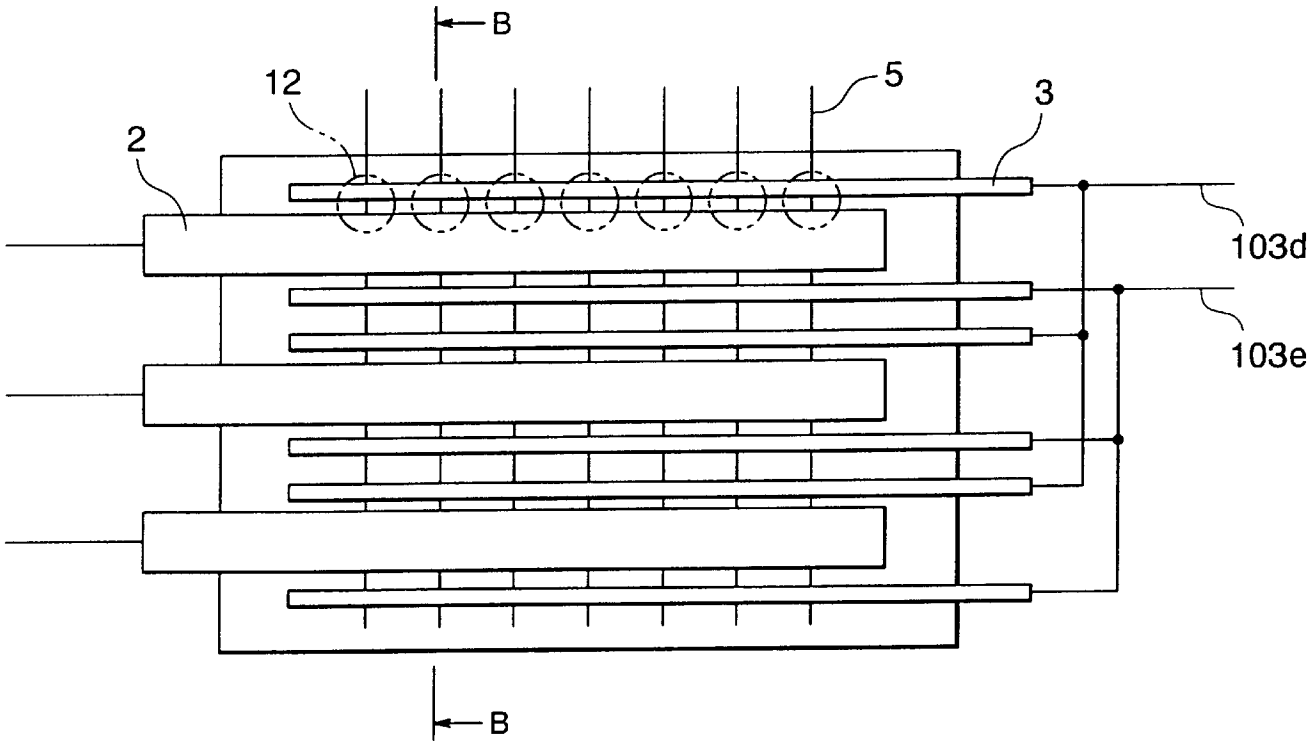
FIG. 6 is a schematic diagram illustrating an electrode arrangement in a plasma display panel according to a first embodiment of the present invention.
Figure 7:
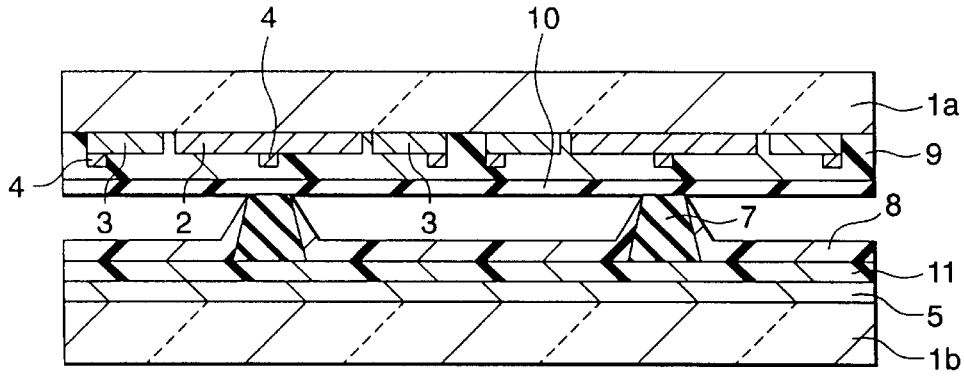
FIG. 7 is a cross sectional view taken along line B—B in FIG. 6.

Hereinafter, preferred embodiments of the present invention will be described in detail with reference to the accompanying drawings. FIG. 6 is a schematic diagram illustrating an electrode arrangement in a plasma display panel according to a first embodiment of the present invention, and FIG. 7 is a cross sectional view taken along line B—B in FIG. 6.

In the first embodiment, a plurality of scanning electrodes 2 and sustaining electrodes 3 which are extended in the same direction with each other are disposed. In the uppermost and the lowermost portions, the sustaining electrode 3 is disposed, and in the inner side thereof, the scanning electrode 2 is disposed. And, in the further inner side thereof, a pair of sustaining electrodes consisting of two sustaining electrodes 3 and one scanning electrode 2 are alternately disposed. Also, a plurality of data electrodes 5 which are extended perpendicularly to the scanning electrodes 2 and the sustaining electrodes 3 are disposed. And, one display cell 12 is provided at the intersection of a pair of the scanning electrode 2 and the sustaining electrode 3 parallel to each other and one data electrode perpendicular to those electrodes.

In the present embodiment, the scanning electrode 2 is shared between upper and lower adjacent display cells 12 and connected to output pins of a scan driver IC (not shown). Consequently, the number of outputs of the scan driver IC is ½ of the number of display lines. On the other hand, the sustaining electrodes 3 are divided into a first sustaining electrode group 103*d* which is placed at the upper side of each of the scanning electrodes 2, and a second sustaining electrode group 103*e* which is placed at the lower side of each of the scanning electrodes 2, and are electrically commonly connected in the outside of display region every group.

In the plasma display panel of the first embodiment, two isolation substrates 1*a* and 1*b* of a front surface and a rear surface made of glass are provided.

On the isolation substrate 1*a*, the transparent scanning electrode 2 and the sustaining electrode 3 are formed, and a trace electrode 4 is arranged to overlap the scanning electrode 2 and the sustaining electrode 3 in order to make the resistance values of these electrodes be lowered. Also, a first dielectric layer 9 is formed to cover the scanning electrode 2, the sustaining electrode 3, and the trace electrode 4, and a protective layer 10 made of magnesium oxide or the like is formed to protect the dielectric layer 9 from discharge.

On the isolation substrate 1*b*, the data electrodes 5 which are extended in perpendicular to the scanning electrodes 2 and the sustaining electrodes 3 are formed. Also, a second dielectric layer 11 is formed to cover the data electrodes 5. On the dielectric layer 11, a partition wall 7 which is extended in the direction in perpendicular to the data electrode 5 is formed to partition the scanning electrodes 2 into every display cell that is a unit of display. Moreover, on the side surface of the partition wall 7 and the surface of the dielectric layer 11 on which the partition wall 7 is not formed, a fluorescent layer 8 is formed to transform ultraviolet light generated by discharge of discharge gas into visible light.

A space sandwiched between the isolation substrates 1*a* and 1*b* and partitioned by the partition wall 7 becomes a discharge space 6 filled by discharge gas consisting of helium, neon, xenon, and the like, or mixture of gases thereof. Also, in the direction parallel to the data electrode 5, a partition wall is formed in order to separate the discharge space 6 every unit of display and simultaneously to acquire the discharge space 6.

Figure 8:
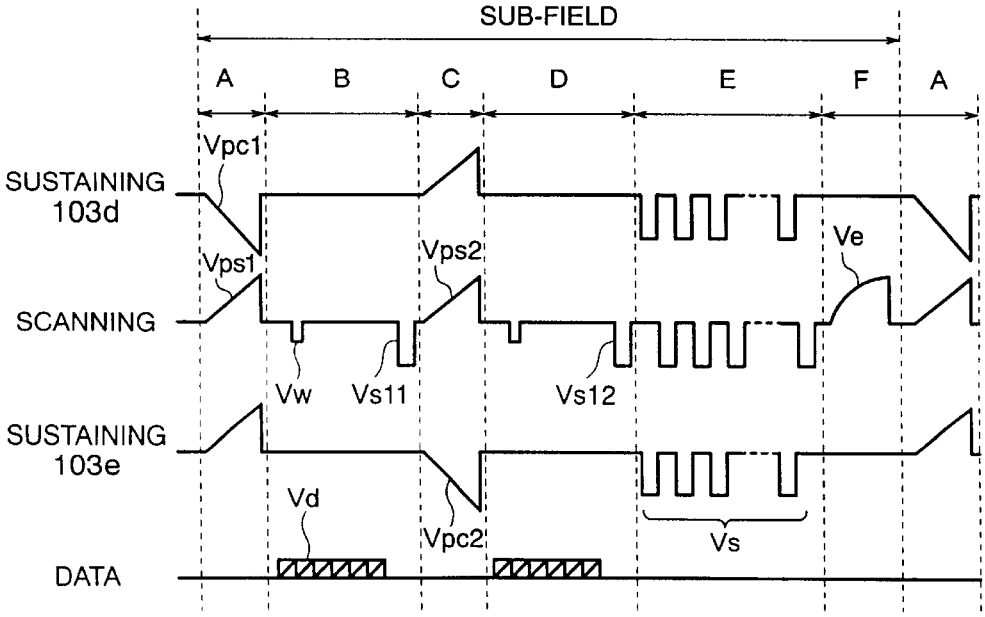
FIG. 8 is a timing chart illustrating a driving method of the plasma display panel according to the first embodiment of the present invention.
Figures 9A, 9B, 9C, 9D:
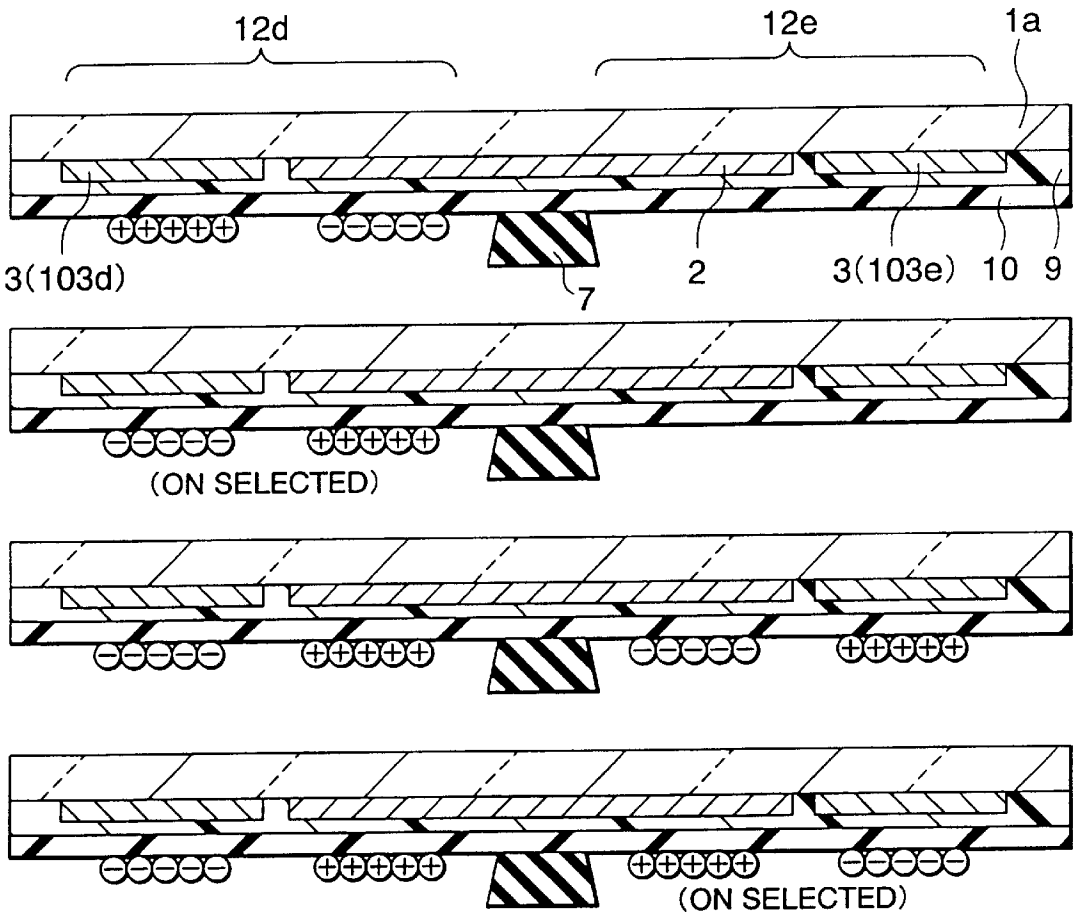
FIG. 9A to FIG. 9D are schematic diagrams illustrating states of wall charge within display cells on the cross section taken along line B—B in FIG. 6.

Next, an operation of the plasma display panel of the first embodiment configured as described above, namely, a driving method thereof will be described. FIG. 8 is a timing chart illustrating the driving method of the plasma display panel according to the first embodiment of the present invention. Also, FIGS. 9 are schematic diagrams illustrating states of wall charge within display cells on the cross section taken along line B—B in FIG. 6, in which FIG. 9A to FIG. 9D illustrate states of wall charge at the time when periods A to D in FIG. 8 are ended, respectively.

First, in a first pre-discharge period A, a pre-discharge pulse Vpc1 which has a negative polarity and a saw tooth shape is applied to the sustaining electrode group 103*d*, and a pre-discharge pulse Vps1 which has an opposite polarity and the same phase is applied to the scanning electrode 2. At that time, the attained potential difference between the scanning electrode 2 and the sustaining electrode 3 due to the pre-discharge pulses Vps1 and Vpc1 is set to be higher than a discharge start voltage between the scanning electrode 2 and the sustaining electrode 3. Also, a pulse having the same voltage waveform as that of the scanning electrode 2 is applied to the sustaining electrode group 103*e*.

In the first pre-discharge period A, with applying such pulses, in a display cell 12*d* having the sustaining electrode 3 belonging to the sustaining electrode group 103*d*, a discharge in which the scanning electrode 2 is an anode is generated from the point of time when exceeding the discharge start voltage, during applying the pre-discharge pulses Vpc1 and Vps1. Thus, as shown in FIG. 9A, negative wall charge is formed on the scanning electrode 2, and positive wall charge is formed on the sustaining electrode 3. On the other hand, because potential difference is not generated in a display cell 12*e* having the sustaining electrode 3 belonging to the sustaining electrode group 103*e*, such discharge is not generated, as shown in FIG. 9A.

Next, in a first selecting operation period B, a scan pulse Vw is applied to the scanning electrode 2. At that time, the voltage of the scan pulse Vw is set to such a degree of voltage that discharge is not generated solely even in the display cell 12 where wall charge is formed due to the pre-discharge. Also, for the data electrode 5, a data pulse Vd synchronized with the scan pulse Vw is applied to only the OFF display cell where display is not performed in accordance with the image data. Here, the potential difference between the data pulse Vd and the scan pulse Vw is set not to exceed the discharge start voltage between the scanning electrode 2 and the data electrode 5 solely, but it is set to exceed the discharge start voltage only in case where negative wall charges formed on the scanning electrode 2 are overlapped. Consequently, in the display cell to which the data pulse Vd is applied, out of the display cells 12*d*, discharge is generated between the scanning electrode 2 and the data electrode 5 by the scan pulse Vw and the data pulse Vd, and the discharge is used as a trigger that discharge is also generated between the scanning electrode 2 and the sustaining electrode 3. Here, the time interval of applying each scan pulse Vw is set to be short, for example, about 1.5 $\mu$s. Consequently, although discharge is generated between the scanning electrode 2 and the sustaining electrode 3, discharge is ended before wall charge having an opposite polarity is formed. Accordingly, in the display cell to which the data pulse Vd is applied, out of the display cells 12*d*, wall charge formed during the pre-discharge period A is erased. On the other hand, because discharge is not generated in the display cell to which the data pulse Vd is not applied, there is no change of wall charge. After that, a first sustaining discharge pulse Vs11 is applied to the scanning electrode 2. As a result, discharge is generated only in the display cell in which wall charge is not erased, that is, the ON display cell, and at the same time, wall charge having an opposite polarity is formed on the scanning electrode 2 and the sustaining electrode 3, as shown in FIG. 9B. FIG. 9B illustrates the case where the display cell 12*d* is ON. On the other hand, in the display cell 12*e* having the sustaining electrode 3 belonging to the sustaining electrode group 103*e*, any discharge is not generated because wall charge is not formed on the scanning electrode 2 during the first pre-discharge period A.

Next, in a second pre-discharge period C, a pre-discharge pulse Vpc2 which has a negative polarity and a saw tooth shape is applied to the sustaining electrode group 103*e*, and a pre-discharge pulse Vps2 which has an opposite polarity and the same phase is applied to the scanning electrode 2. Also, a pulse having the same voltage waveform as that of the scanning electrode 2 is applied to the sustaining electrode group 103*d*. Therefore, discharge is generated in the display cell 12*e* having the sustaining electrode 3 belonging to the sustaining electrode group 103*e*, negative wall charge is formed on the scanning electrode 2, as shown in FIG. 9C, and positive wall charge is formed on the sustaining electrode 3. On the other hand, because potential difference is not generated in the display cell 12*d* having the sustaining electrode 3 belonging to the sustaining electrode group 103*d*, discharge is not generated.

Subsequently, in a second selecting operation period D, in the same manner as the first selecting operation period B, negative scan pulses Vw are sequentially applied to the scanning electrode 2, and a positive data pulse Vd is applied to the data electrode 5 in accordance with the image data of the display cell 12*e* having the sustaining electrode 3 belonging to the sustaining electrode group 103*e*. Therefore, wall charge can be erased only in the OFF display cell 12*e*. After that, a second sustaining discharge pulse Vs12 is applied to the scanning electrode 2. As a result, discharge is generated only in the display cell in which wall charge is not disappeared, that is, an ON display cell, and at the same time, wall charge having an opposite polarity is formed on the scanning electrode 2 and the sustaining electrode 3 as shown in FIG. 9D. FIG. 9D illustrates the case where the display cell 12*d* is ON. At that time, on the scanning electrode 2 of the display cell 12*d* having the sustaining electrode 3 belonging to the sustaining electrode group 103*d*, positive wall charge is formed if the selection is in ON state, and wall charge is not formed if the selection is in OFF state. Accordingly, in the second selecting operation period, any discharge is not generated in the display cell 12*d* having the sustaining electrode 3 belonging to the sustaining electrode group 103*d*.

After that, in a sustaining discharge period E, sustaining discharge pulses Vs are applied to all the scanning electrodes 2 and the sustaining electrodes 3, which have the polarities inverted each other. As a result, discharge is generated and light emission for display is achieved only in the display cell 12 in which wall charge is not erased in the selecting operation periods B and D.

Subsequently, in a sustaining erasing period F, with applying a sustaining erasing pulse Ve having a dull waveform to the scanning electrode 2, wall charge is erased, and at the same time, discharge is stopped to be transferred to the next sub-field.

By the above-mentioned operation, control of ON/OFF of display becomes possible for all the display cells 12 within one sub-field.

Accordingly, the number of outputs of scan driver IC required for display can be reduced to ½ of the number of display lines. On the other hand, because a sustaining discharge period is shared with all the display lines so that only sustaining discharge is performed, high brightness can be easily achieved with increasing the frequency of the sustaining discharge pulse. And, because a voltage pulse which is applied sequentially to the scanning electrode is one type, there is no case that scan circuit becomes complex.

Also, in the first embodiment, the scanning electrode is shared to the upper and lower adjacent display cells so that the number of metal trace electrodes can be reduced. Because metal trace electrode is not transparent, opening rate of the plasma display panel is decreased, thereby causing brightness reduction, but the number of the trace electrodes is reduced, and simultaneously, disposed between the display cells, where intensity of light emission is lower, so that the opening rate becomes high. And, selecting operation can be individually performed by the corresponding sustaining electrode in such a plasma display panel that electrode is shared.

Also, in the present embodiment, the partition wall 7 adhered to the protective layer 10 on the isolation substrate 1*a* is formed as a structural body for separating the scanning electrode 2 shared between the adjacent display cells into a unit of display cell. However, practically, it is not necessary that discharge space is completely separated, and other structures that can prevent discharge from being transferring between the adjacent display cells can be appropriately used.

Figure 10:
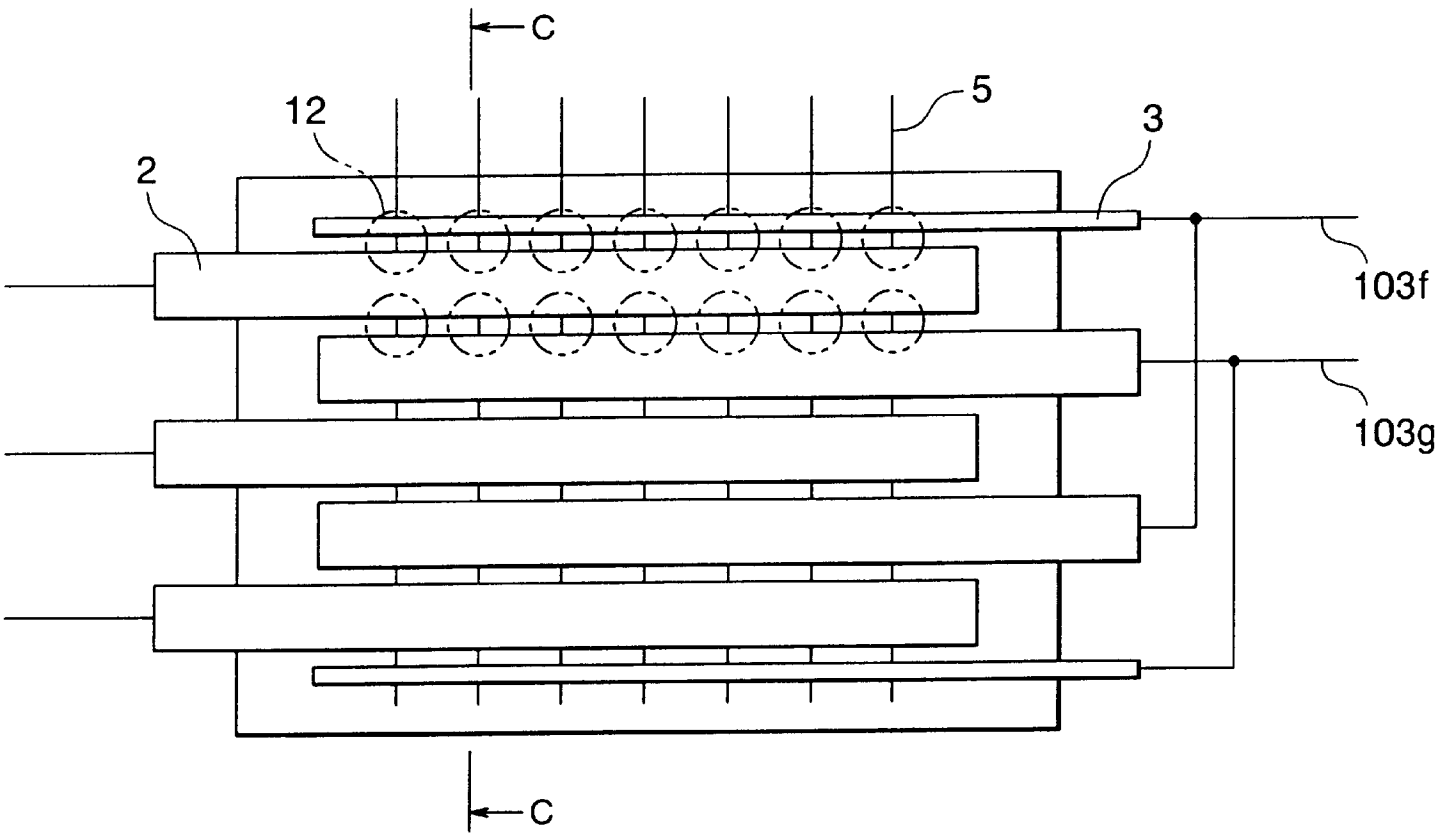
FIG. 10 is a schematic diagram illustrating an electrode arrangement in a plasma display panel according to a second embodiment of the present invention.
Figure 11:
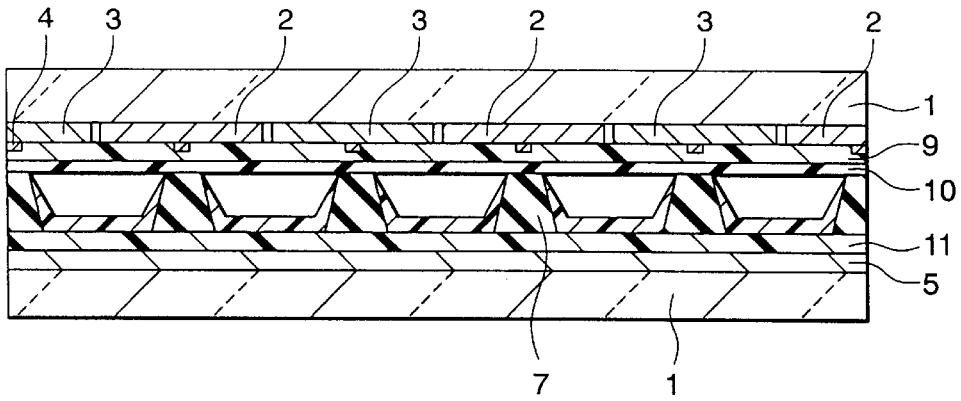
FIG. 11 is a cross sectional view taken along line C—C in FIG. 10.

Subsequently, the second embodiment of the present invention will be described. FIG. 10 is a schematic diagram illustrating an electrode arrangement in a plasma display panel according to the second embodiment of the present invention, and FIG. 11 is a cross sectional view taken along line C—C in FIG. 10.

In the second embodiment, a plurality of scanning electrodes 2 and sustaining electrodes 3 which are extended in the same direction with each other are alternately disposed. Also, a plurality of data electrodes 5 which are extended perpendicularly to the scanning electrodes 2 and the sustaining electrodes 3 are disposed. And, one display cell 12 is provided at the intersection of a pair of the scanning electrode 2 and the sustaining electrode 3 parallel to each other and one data electrode perpendicular to those electrodes.

In the present embodiment, the scanning electrode 2 is shared between upper and lower adjacent display cells 12 and connected to output pins of a scan driver IC (not shown). Therefore, the number of outputs of the scan driver IC is ½ of the number of display lines. Also, the sustaining electrodes 3 are shared between adjacent display cells 12 in the vertical direction, divided into an odd-numbered sustaining electrode group 103*f* and an even-numbered sustaining electrode group 103*g* from the upper portion, and electrically commonly connected in the outside of display region every group.

Also, in the plasma display panel of the second embodiment, two isolation substrates 1*a* and 1*b* of a front surface and a rear surface made of glass are provided.

On the isolation substrate 1*b*, data electrodes 5 which are extended in perpendicular to the scanning electrodes 2 and the sustaining electrodes 3 are formed. Also, a second dielectric layer 11 is formed to cover the data electrodes 5. On the dielectric layer 11, a partition wall 7 which is extended in the direction perpendicular to the data electrode 5 is formed to partition a display cell that is a unit of display. Moreover, on the side surface of the partition wall 7 and the surface of the dielectric layer 11 on which the partition wall 7 is not formed, a fluorescent layer 8 is formed to transform ultraviolet light generated by discharge of discharge gas into visible light.

A space sandwiched between the isolation substrates 1*a* and 1*b* and partitioned by the partition wall 7 becomes a discharge space 6 filled by discharge gas consisting of helium, neon, xenon, and the like, or mixture of gases thereof. Also, in the direction parallel to the data electrode 5, a partition wall is formed in order to separate the discharge space 6 every unit of display and simultaneously to acquire the discharge space 6.

Figure 12:
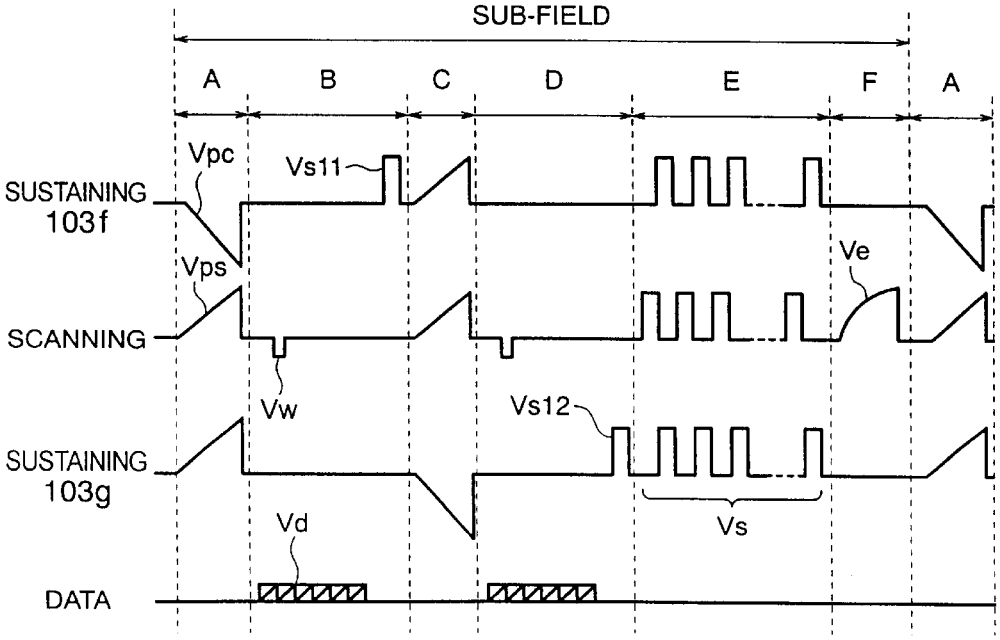
FIG. 12 is a timing chart illustrating a driving method of the plasma display panel according to the second embodiment of the present invention.
Figures 13A, 13B, 13C, 13D:
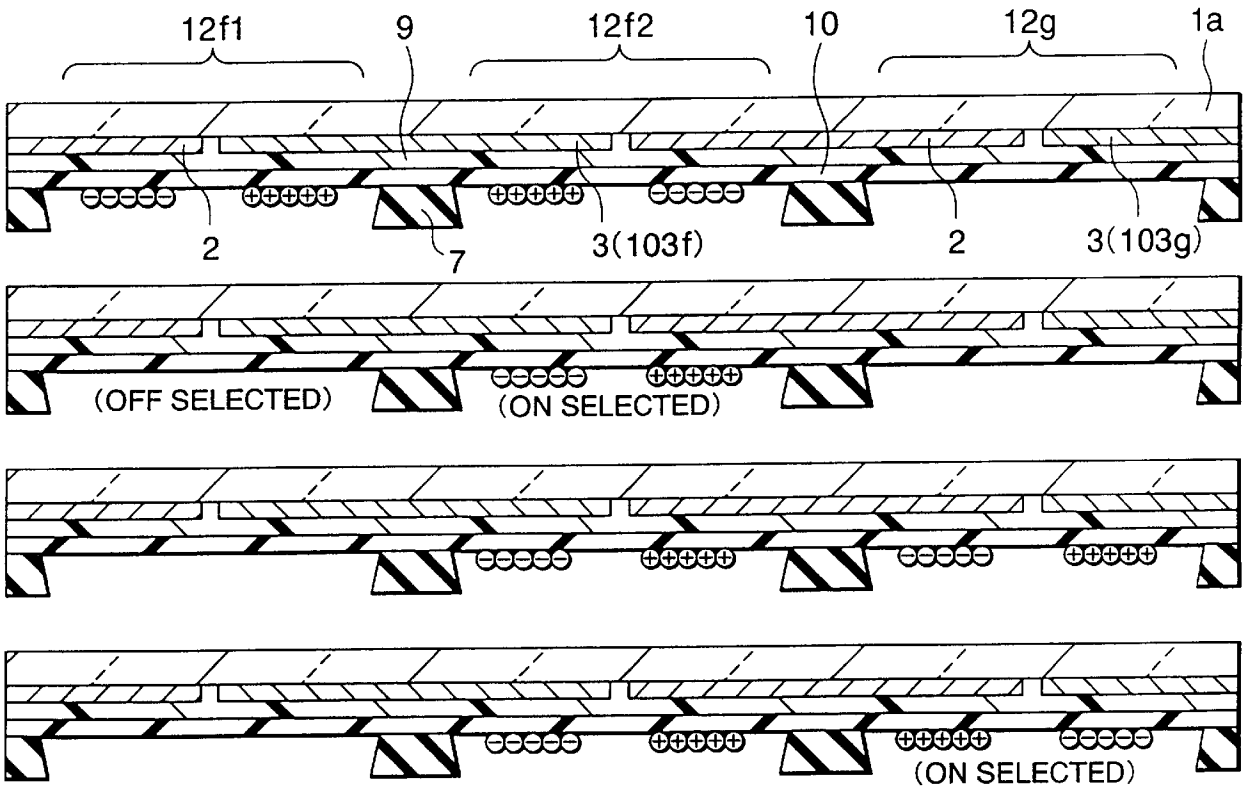
FIG. 13A to FIG. 13D are schematic diagrams illustrating states of wall charge within display cells on the cross section taken along line C—C in FIG. 10.

Next, an operation of the plasma display panel of the second embodiment configured as described above, namely, a driving method thereof will be described. FIG. 12 is a timing chart illustrating the driving method of the plasma display panel according to the second embodiment of the present invention. Also, FIGS. 13 are schematic diagrams illustrating states of wall charge within display cells on the cross section taken along line C—C in FIG. 10, in which FIG. 13A to FIG. 13D illustrate states of wall charge at the time when periods A to D in FIG. 12 are ended, respectively.

First, in a first pre-discharge period A, a pre-discharge pulse Vpc which has a negative polarity and a saw tooth shape is applied to the sustaining electrode group 103*f*, and a pre-discharge pulse Vps which has an opposite polarity and the same phase is applied to the scanning electrode 2. At that time, the attained potential difference between the scanning electrode 2 and the sustaining electrode 3 due to the pre-discharge pulses Vps and Vpc is set to be higher than a discharge start voltage between the scanning electrode 2 and the sustaining electrode 3. Also, a pulse having the same voltage waveform as that of the scanning electrode 2 is applied to the sustaining electrode group 103*g*.

In the first pre-discharge period A, with applying such pulses, in display cells 12*f*1 and 12*f*2 having the sustaining electrode 3 belonging to the sustaining electrode group 103*f*, discharge in which the scanning electrode 2 is an anode is generated from the point of time when exceeding the discharge start voltage, during applying the pre-discharge pulses Vpc and Vps. Thus, as shown in FIG. 13A, negative wall charge is formed on the scanning electrode 2, and positive wall charge is formed on the sustaining electrode 3. On the other hand, because potential difference is not generated in a display cell 12*g* having the sustaining electrode group 103*g*, discharge is not generated, as shown in FIG. 13A.

Next, in a first selecting operation period B, a scan pulse Vw is applied to the scanning electrode 2, and a data pulse Vd according to the image data is applied to the data electrode 5. As a result, in the same manner as the first embodiment, wall charge is disappeared only in the OFF display cell 12*f*1 out of the display cells 12*f*1 and 12*f*2 to which the data pulse Vd is applied. After that, a first sustaining discharge pulse Vs11 is applied to the sustaining electrode group 103*f*. As a result, as shown in FIG. 13B, discharge is generated only in the display cell in which wall charge is not disappeared, that is, the ON display cell 12*f*2, and at the same time, wall charge having an opposite polarity is formed on the scanning electrode 2 and the sustaining electrode 3. FIG. 13B illustrates the case where the display cell 12*f*1 is OFF and the display cell 12*f*2 is ON.

Next, similarly, in a second pre-discharge period C and a second selecting operation period D, selecting operation is performed only in the display cell 12*g* having the sustaining electrode 3 belonging to the sustaining electrode group 103*g* so that wall charge is formed only in the ON display cell out of the display cells 12*g*. FIG. 13D illustrates the case where the display cell 12*g* is ON. At that time, in the same manner as the first embodiment, there is no change in the display cells 12*f*1 and 12*f*2 having the sustaining electrode 3 belonging to the sustaining electrode group 103*f*, and the wall charge formed in the previous step is sustained, as it is.

After that, in a sustaining discharge period E, sustaining discharge pulses Vs are applied to all the scanning electrodes 2 and the sustaining electrodes 3, which have the polarities inverted each other. As a result, discharge is generated and light emission for display is achieved only in the display cell 12 in which wall charge is not erased in the selecting operation periods B and D.

Subsequently, in a sustaining erasing period F, with applying a sustaining erasing pulse Ve having a dull waveform to the scanning electrode 2, wall charge is erased, and at the same time, discharge is stopped to be transferred to the next sub-field.

By the above-mentioned operation, control of ON/OFF of display becomes possible for all the display cells 12 within one sub-field.

Accordingly, the number of outputs of scan driver IC required for display can be reduced to ½ of the number of display lines. On the other hand, because a sustaining discharge period is shared with all the display lines so that the only sustaining discharge is performed, high brightness can be easily achieved with increasing the frequency of the sustaining discharge pulse. And, because a voltage pulse which is applied sequentially to the scanning electrode is one type, there is no case that scan circuit becomes complex.

Also, in the second embodiment, the scanning electrode and the sustaining electrode are shared to the adjacent display cells in the vertical direction so that the number of metal trace electrodes may be reduced. Because metal trace electrode is not transparent, opening rate of the plasma display panel is decreased, thereby causing brightness reduction, but the number of the trace electrodes is reduced, and simultaneously, disposed between the display cells, where intensity of light emission is lower, so that the opening rate becomes high. And, selecting operation can be individually performed by the corresponding sustaining electrode in such a plasma display panel that electrode is shared.

Figure 14:
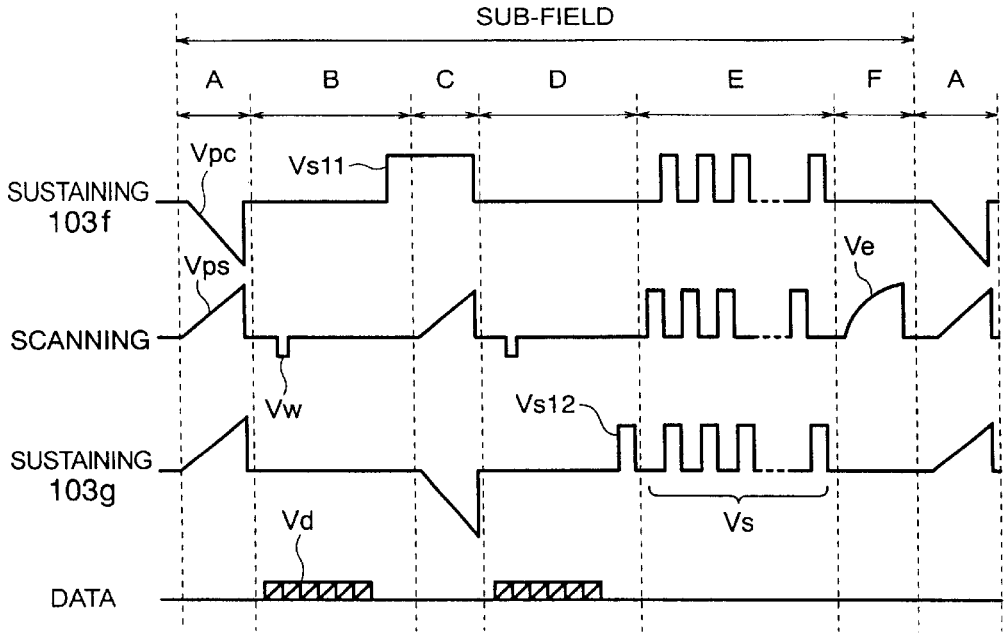
FIG. 14 is a timing chart illustrating a driving method of a plasma display panel according to a third embodiment of the present invention.

Next, a third embodiment of the present invention will be described. The configuration of the plasma display panel according to the third embodiment is the same as the second embodiment, but a driving method thereof is different. FIG. 14 is a timing chart illustrating the driving method of the plasma display panel according to the third embodiment of the present invention.

In the driving method, the same operations as those of the second embodiment shown in FIG. 12 are performed, except that the first sustaining discharge pulse Vs11 applied to the sustaining electrode group 103*f* at the end of the first selecting operation period B is extended until the second pre-discharge period C.

In such a third embodiment, in the second pre-discharge period C, a voltage having the same polarity as that of the pre-discharge pulse Vps applied to the scanning electrode 2 is applied to the sustaining electrode group 103*f* so that there is no case that discharge is generated in the display cell 12 having the sustaining electrode 3 belonging to the sustaining electrode group 103*f*, in this period. Accordingly, in the third embodiment, the same operation as the second embodiment is also performed.

As a result, a pre-discharge pulse in the second pre-discharge period is omitted so that invalid charge and discharge currents due to capacitance component of the plasma display panel can be reduced.

Figure 15:
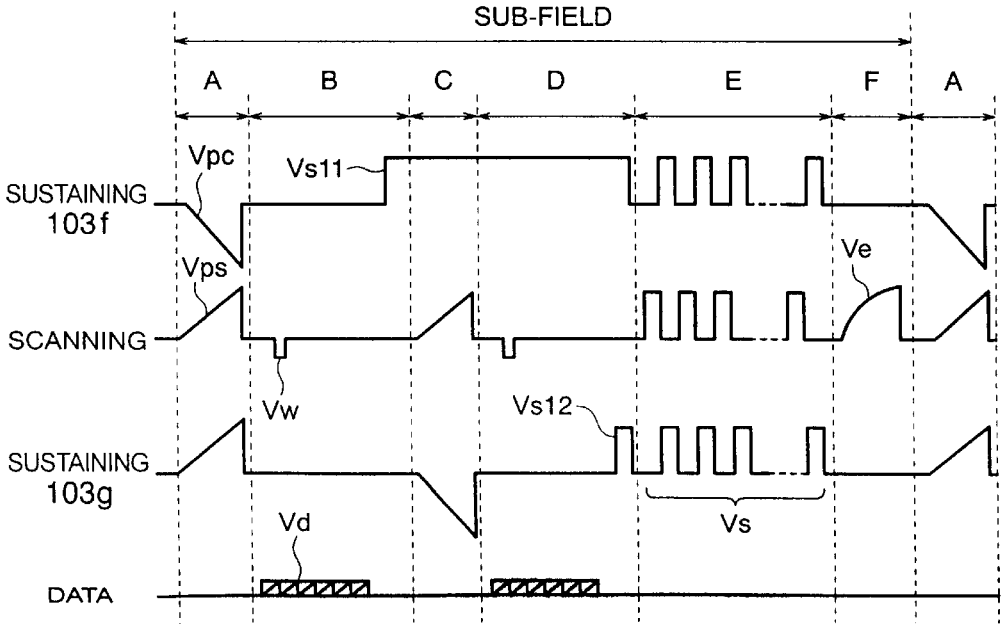
FIG. 15 is a timing chart illustrating a driving method of a plasma display panel according to a forth embodiment of the present invention.

Next, a fourth embodiment of the present invention will be described. In a plasma display panel according to the fourth embodiment, the configuration is the same as that of the second embodiment, but a driving method thereof is different. FIG. 15 is a timing chart illustrating the driving method of the plasma display panel according to the forth embodiment of the present invention.

In the driving method, the same operations as those of the second embodiment shown in FIG. 12 are performed, except that the first sustaining discharge pulse Vs11 applied to the sustaining electrode group 103*f* at the end of the first selecting operation period B is extended until the first sustaining discharge pulse Vs12 applied to the sustaining electrode group 103*g* at the end of the second selecting operation period D is dropped.

In such a fourth embodiment, in the second pre-discharge period C, a voltage having the same polarity as that of the pre-discharge pulse Vps applied to the scanning electrode 2 is applied to the sustaining electrode group 103*f* so that there is no case that discharge is generated in the display cell 12 having the sustaining electrode 3 belonging to the sustaining electrode group 103*f*, in this period. Also, in the second selecting operation period D, although the first sustaining discharge pulse Vs11 is applied to the sustaining electrode group 103*f*, potential difference between the scan pulse Vw and the first sustaining discharge pulse Vs11 is lower than the discharge start voltage so that there is no case that discharge is generated in the display cell 12 having the sustaining electrode 3 belonging to the sustaining electrode group 103*f* even in this period. Accordingly, in the fourth embodiment, the same operations as those of the second embodiment are performed.

As a result, a pre-discharge pulse in the second pre-discharge period is omitted so that invalid charge and discharge currents due to capacitance component of the plasma display panel can be more reduced.

Figure 16:
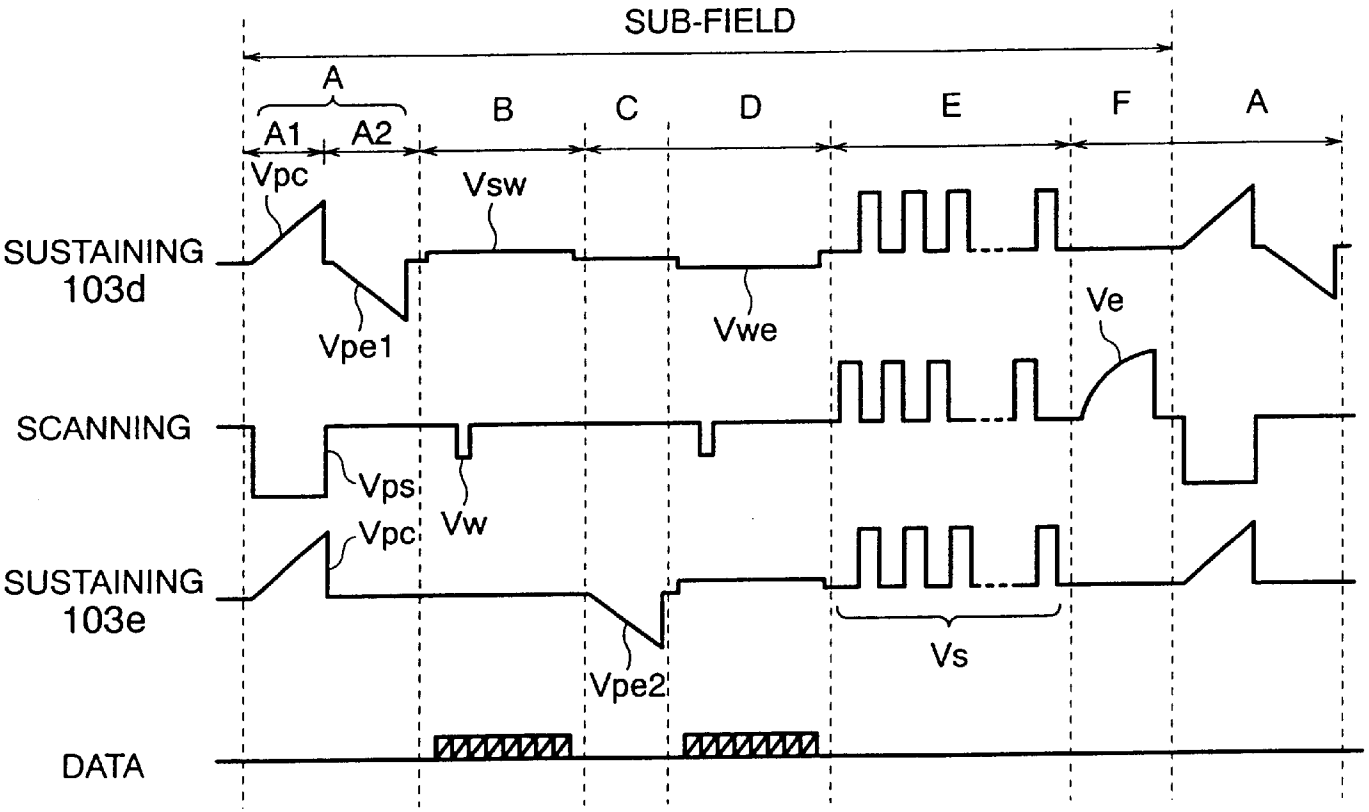
FIG. 16 is a timing chart illustrating a driving method of a plasma display panel according to a fifth embodiment of the present invention.
Figures 17A, 17B, 17C, 17D:
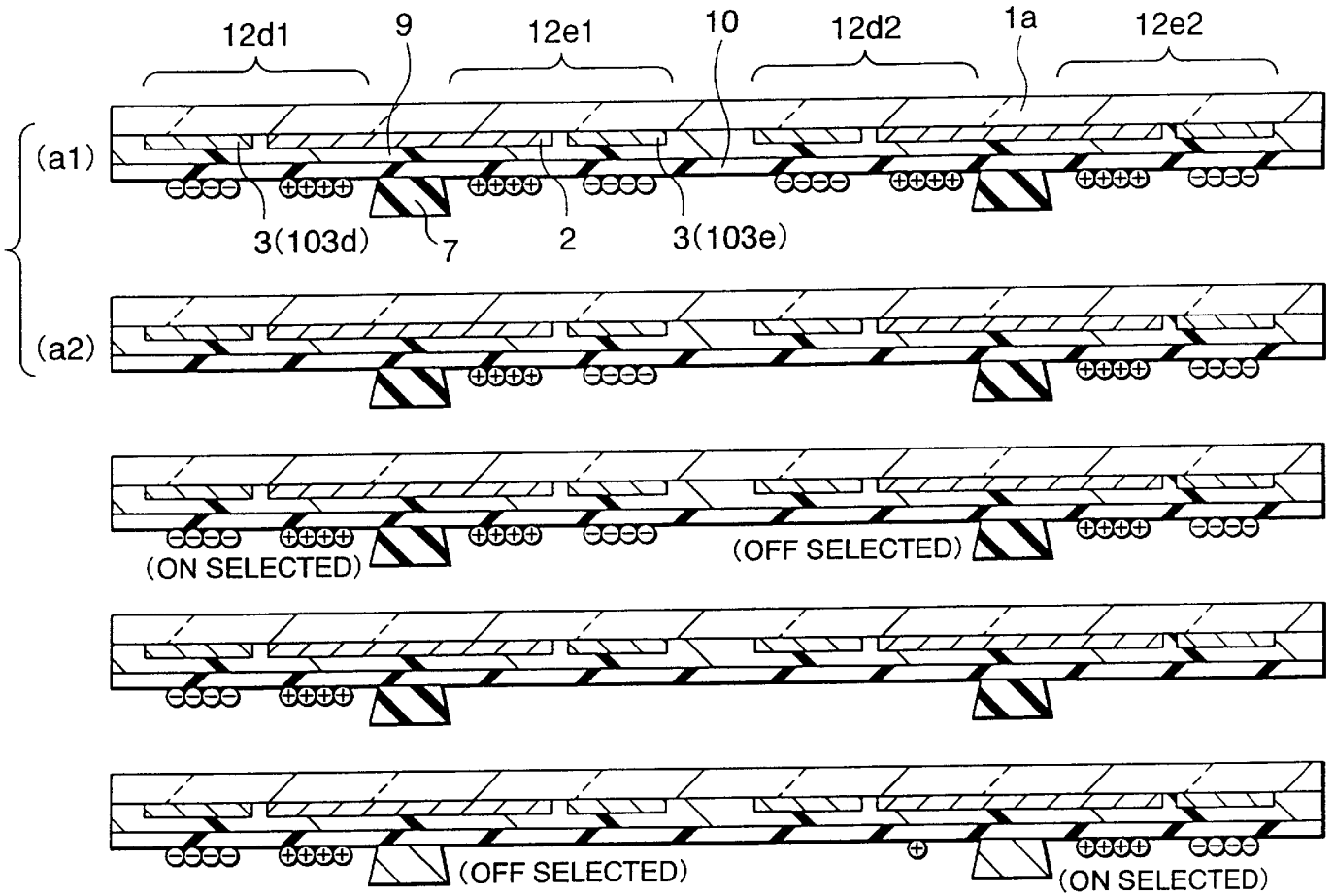
FIG. 17A to FIG. 17D are schematic diagrams illustrating states of wall charge within display cells on the cross section taken along line C—C in FIG. 10.

Next, a fifth embodiment of the present invention will be described. The configuration of a plasma display panel according to the fifth embodiment is the same as that of the first embodiment, but a driving method thereof is different. FIG. 16 is the timing chart illustrating the driving method of the plasma display panel according to the fifth embodiment of the present invention. Also, FIGS. 17 are schematic diagrams illustrating states of wall charge within display cells on the cross section taken along line B—B in FIG. 6, in which FIG. 17A to FIG. 17D illustrate states of wall charge at the time when periods A to D in FIG. 16 are ended, respectively.

First, in a first period A1 in the first pre-discharge period A, a positive pre-discharge pulse Vpc having a saw tooth shape is applied to the sustaining electrode groups 103*d* and 103*e*, and at the same time, a negative pre-discharge pulse Vps having a rectangular waveform is applied to the scanning electrode 2. Thereby, discharge is generated with the scanning electrode 2 as a cathode, and then, as shown in a1 of FIG. 17A, positive wall charge is formed on each scanning electrode 2, and negative wall charge is formed on each sustaining electrode 3.

Subsequently, in a second period A2 in the first pre-discharge period A, a negative pre-discharge erasing pulse Vpe1 having a saw tooth shape is applied to the sustaining electrode group 103*d*. On the other hand, the scanning electrode 2 and the sustaining electrode group 103*e* are not applied with a pulse and are fixed to the same potential with each other. As a result, although weak discharge is generated between the sustaining electrode group 103*d* and the scanning electrode 2, the resultant attained potential difference is low so that new wall charge is not generated. As shown in a2 of FIG. 17A, in display cells 12*d*1 and 12*d*2 having the sustaining electrode belonging to the sustaining electrode group 103*d*, discharge is ended only with wall charge formed due to the pre-discharge pulses Vps and Vpc disappearing.

Next, in the first selecting operation period B, the negative scan pulse Vw is sequentially applied to the scanning electrode 2, and the positive data pulse Vd is applied to the data electrode 5 in accordance with the image data of the display cells 12*d*1 and 12*d*2 having the sustaining electrodes belonging to the sustaining electrode group 103*d*. On the other hand, a positive supplementary scan pulse Vsw is applied to the sustaining electrode group 103*d*.

Therefore, the scan pulse Vw and the data pulse Vd are applied to the display cell 12*d*1 where the image data is ON so that discharge is generated between the scanning electrode 2 and the data electrode 5. Also, substantially at the same time, this discharge is used as a trigger that discharge with the scanning electrode 2 as a cathode is generated between the scanning electrode 2 and the sustaining electrode 3. And, positive charge is formed on the scanning electrode 2 due to the potential difference between the scan pulse Vw and the supplementary scan pulse Vsw, and an intense negative wall charge is formed on the sustaining electrode 3.

On the other hand, because a data pulse is not applied to the display cell 12*d*2 where the image data is OFF, any discharge is not generated. Also, in display cells 12*e*1 and 12*e*2 having the sustaining electrode 3 belonging to the sustaining electrode group 103*e*, because positive wall charge is formed on the scanning electrode 2 in the first pre-discharge period A, the potential difference due to the scan pulse Vw is compensated. Consequently, there is no case that discharge is generated between the scanning electrode 2 and the data electrode 5 even in case where the data pulse Vd is applied.

As a result, as shown in FIG. 17B, positive wall charge is formed on the scanning electrode 2 and negative wall charge is formed on the sustaining electrode 3 only in the display cell 12*d*1 having the sustaining electrode 3 belonging to the sustaining electrode group 103*d* where the image data is ON. FIG. 17B illustrates the case where the display cell 12*d*1 is ON and the display cell 12*d*2 is OFF.

Subsequently, in the second pre-discharge period C, a pre-discharge erasing pulse Vpe2 is applied to the sustaining electrode group 103*e*. At that time, the sustaining electrode group 103*d* and the scanning electrode 2 are not applied with a pulse, and are kept to the same potential with each other. Therefore, as shown in FIG. 17C, in the display cells 12*e*1 and 12*e*2 having the sustaining electrode 3 belonging to the sustaining electrode group 103*e*, the wall charge formed in the first pre-discharge period A is disappeared.

After that, in the second selecting operation period D, the negative scan pulses Vw are sequentially applied to the scanning electrode 2, and the positive data pulse Vd is applied to the data electrode 5 in accordance with the image data of the display cells 12*e*1 and 12*e*2 having the sustaining electrode 3 belonging to the sustaining electrode group 103*e*. On the other hand, the positive supplementary scan pulse Vsw is applied to the sustaining electrode group 103*e*, and a negative scan erasing pulse Vwe is applied to the sustaining electrode group 103*d*. Therefore, in the same manner as the first selecting operation period B, positive wall charge is formed on the scanning electrode 2 and negative wall charge is formed on the sustaining electrode 3, only in the display cell 12*e*2 where the image data is ON, as shown in FIG. 17D. FIG. 17D illustrates the case where the display cell 12*e*1 is OFF and the display cell 12*e*2 is ON.

Next, the operation of the display cells 12*d*1 and 12*d*2 having the sustaining electrode 3 belonging to the sustaining electrode group 103*d* during the second selecting operation period D will be described.

In the display cell 12*d*1, where the image data is ON, out of the display cells, because the positive wall charge is formed on the scanning electrode 2 in the first selecting operation period A, a potential difference due to the scan pulse Vw is compensated so that discharge is not generated. On the other hand, because wall charge is not formed in the display cell 12*d*2, where the image data is OFF, discharge is generated between the scanning electrode 2 and the data electrode 5 in case where the data pulse Vd is applied. However, at that time, because the scan erasing pulse Vwe is applied to the sustaining electrode group 103*d*, an intense discharge is not generated between the scanning electrode 2 and the sustaining electrode 3, and sufficient wall charge is not formed, as shown in FIG. 17D.

After that, in the sustaining discharge period E, the sustaining discharge pulses Vs are applied to the scanning electrode 2 and the sustaining electrode 3, which have the polarities inverted each other. As a result, discharge is generated and light emission for display is achieved only in the display cell 12 where intense wall charge is formed in the selecting operation periods B and D.

Subsequently, in the sustaining erasing period F, with applying the sustaining erasing pulse Ve having a dull waveform to the scanning electrode 2, wall charge is erased, and at the same time, discharge is stopped to be transferred to the next sub-field.

By the above-mentioned operation, control of ON/OFF of display becomes possible for all the display cells 12 within one sub-field.

Consequently, according to the fifth embodiment, light emission is reduced in the non-display cell due to addressing so that contrast can be improved.

Figure 18:
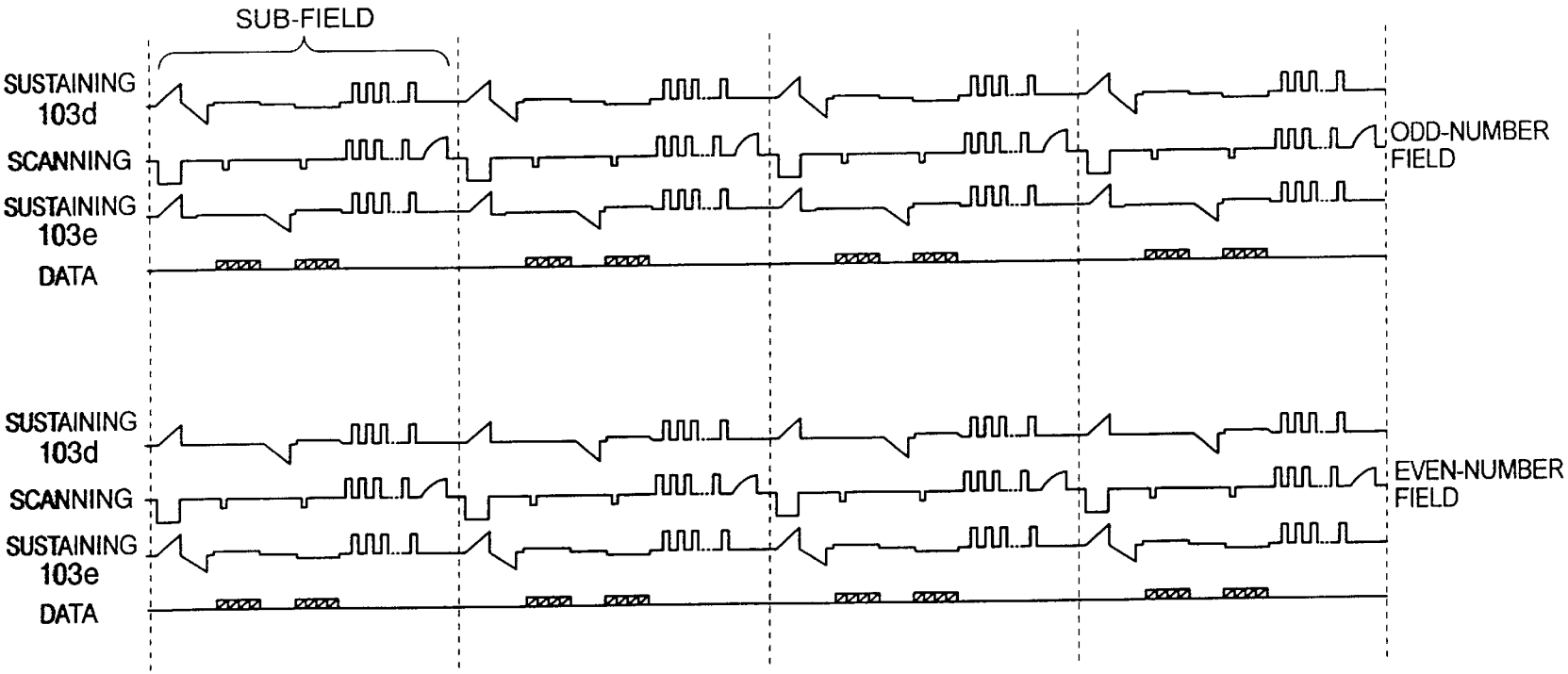
FIG. 18 is a timing chart illustrating a driving method for changing an addressing sequence of the sustaining electrode groups 103*d* and 103*e* between an odd-numbered field and an even-numbered field in the fifth embodiment.

In the present embodiment, in case where the image data of the display cell 12 having the sustaining electrode 3 belonging to the sustaining electrode group 103*e* is OFF, discharge is generated only when the pre-discharge pulses Vps and Vpc and the pre-discharge erasing pulse Vpe are applied. On the other hand, in the display cell 12 having the sustaining electrode 3 belonging to the sustaining electrode group 103*d*, an opposite discharge due to the scan pulse Vw and the data pulse Vd is also generated in the second selecting operation period D as well as in case where the pre-discharge pulses Vps and Vpc and the pre-discharge erasing pulse Vpe are applied. Although the intensity of the opposite discharge is not stronger so much, there is a possibility that resolution in the scanning direction is deteriorated in such a case where the sustaining electrode group is changed every one-display line as in the present embodiment. In such a case, an addressing sequence of the sustaining electrode groups 103*d* and 103*e* between an odd-numbered field and an even-numbered field may be changed. FIG. 18 is a timing chart illustrating a driving method for changing the addressing sequence of the sustaining electrode groups 103*d* and 103*e* between the odd-numbered field and the even-numbered field in the fifth embodiment.

Brightness is averaged with changing the addressing sequence of the sustaining electrode groups 103*d* and 103*e*, as shown in FIG. 18, so that excellent display can be achieved.

Figure 19:
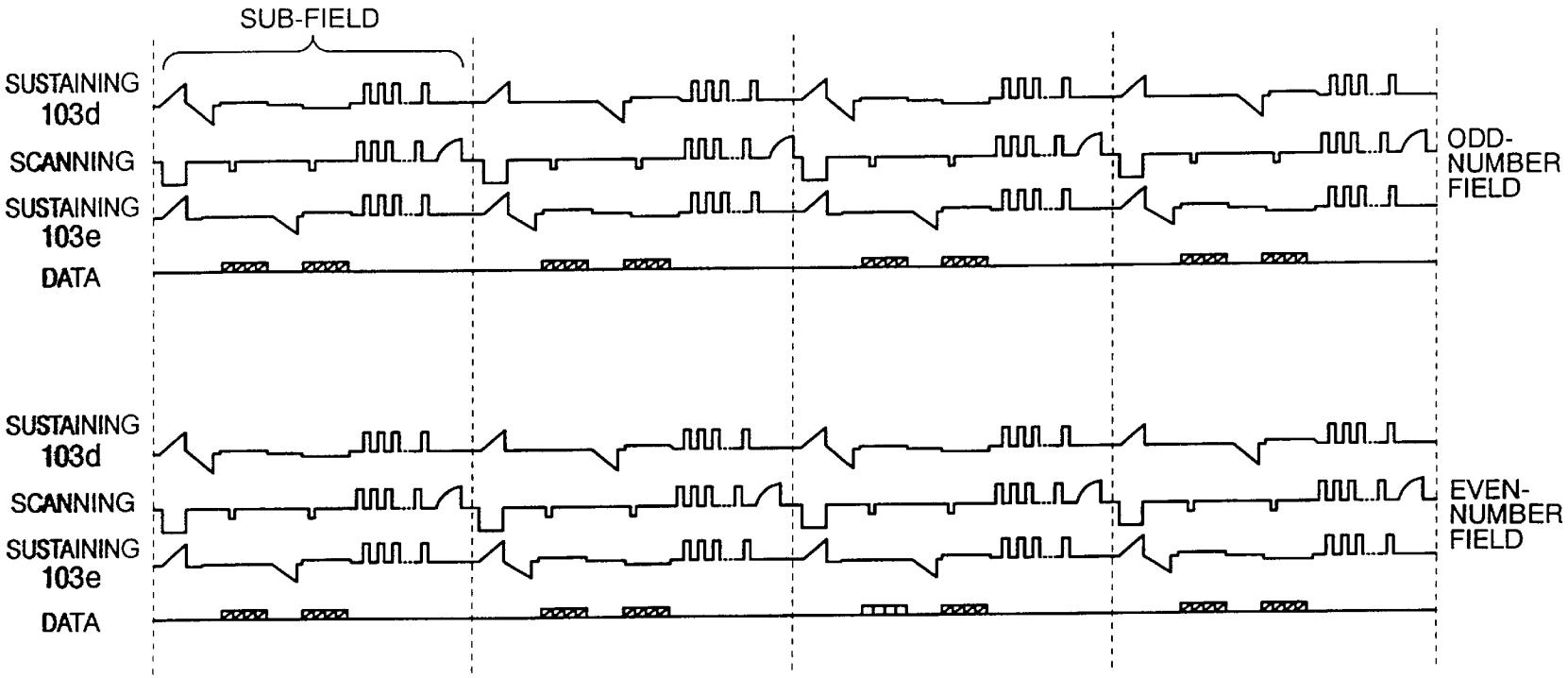
FIG. 19 is a timing chart illustrating a driving method for changing an addressing sequence of the sustaining electrode groups 103*d* and 103*e* every sub-field in the fifth embodiment.

Further, in changing each field, there is a case that flicker is detected although it is a little. In such a case, the addressing sequence of the sustaining electrode groups 103*d* and 103*e* every sub-field may be changed. FIG. 19 is a timing chart illustrating a driving method for changing the addressing sequence of the sustaining electrode groups 103*d* and 103*e* every sub-field in the fifth embodiment.

Brightness is averaged with changing the addressing sequence of the sustaining electrode groups 103*d* and 103*e* every sub-field, as shown in FIG. 19, so that excellent display can be achieved.

Figure 20:
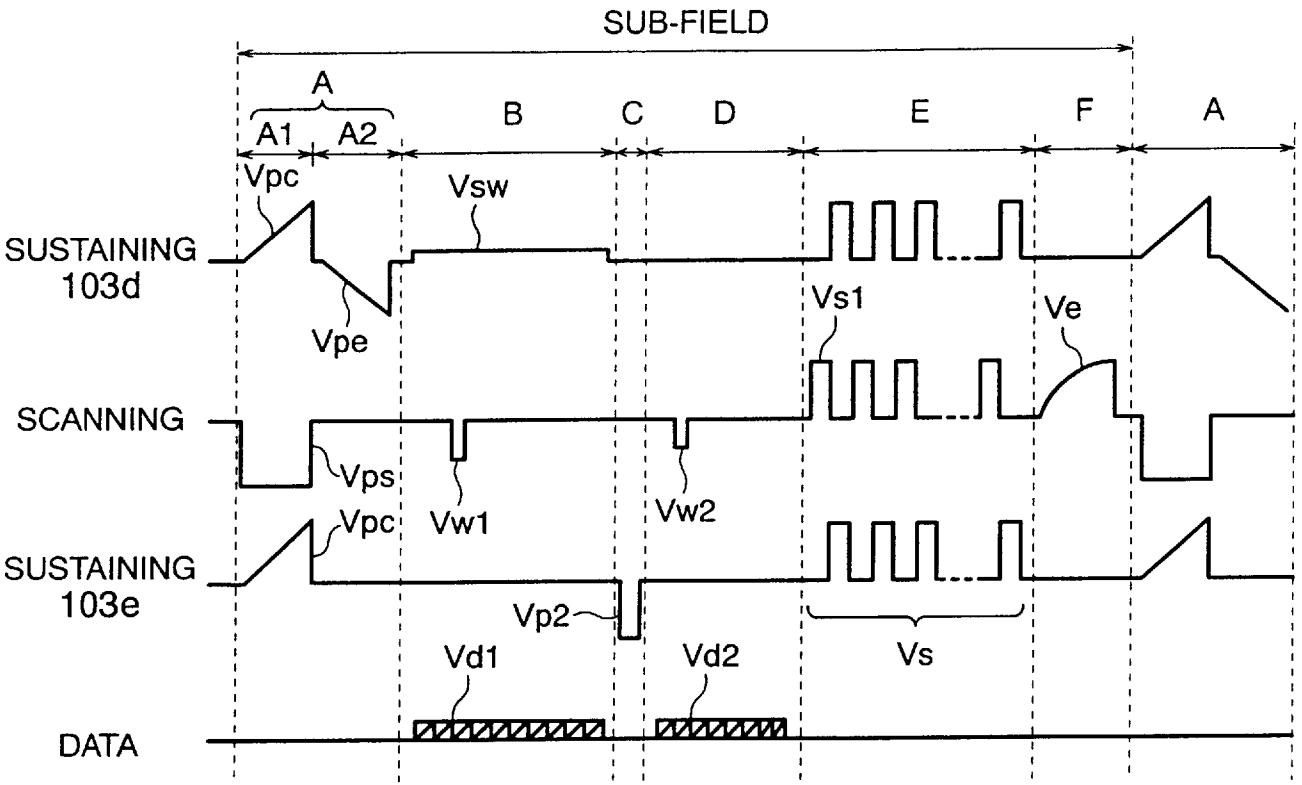
FIG. 20 is a timing chart illustrating a driving method of a plasma display panel according to a sixth embodiment of the present invention.
Figures 21A, 21B, 21C, 21D:
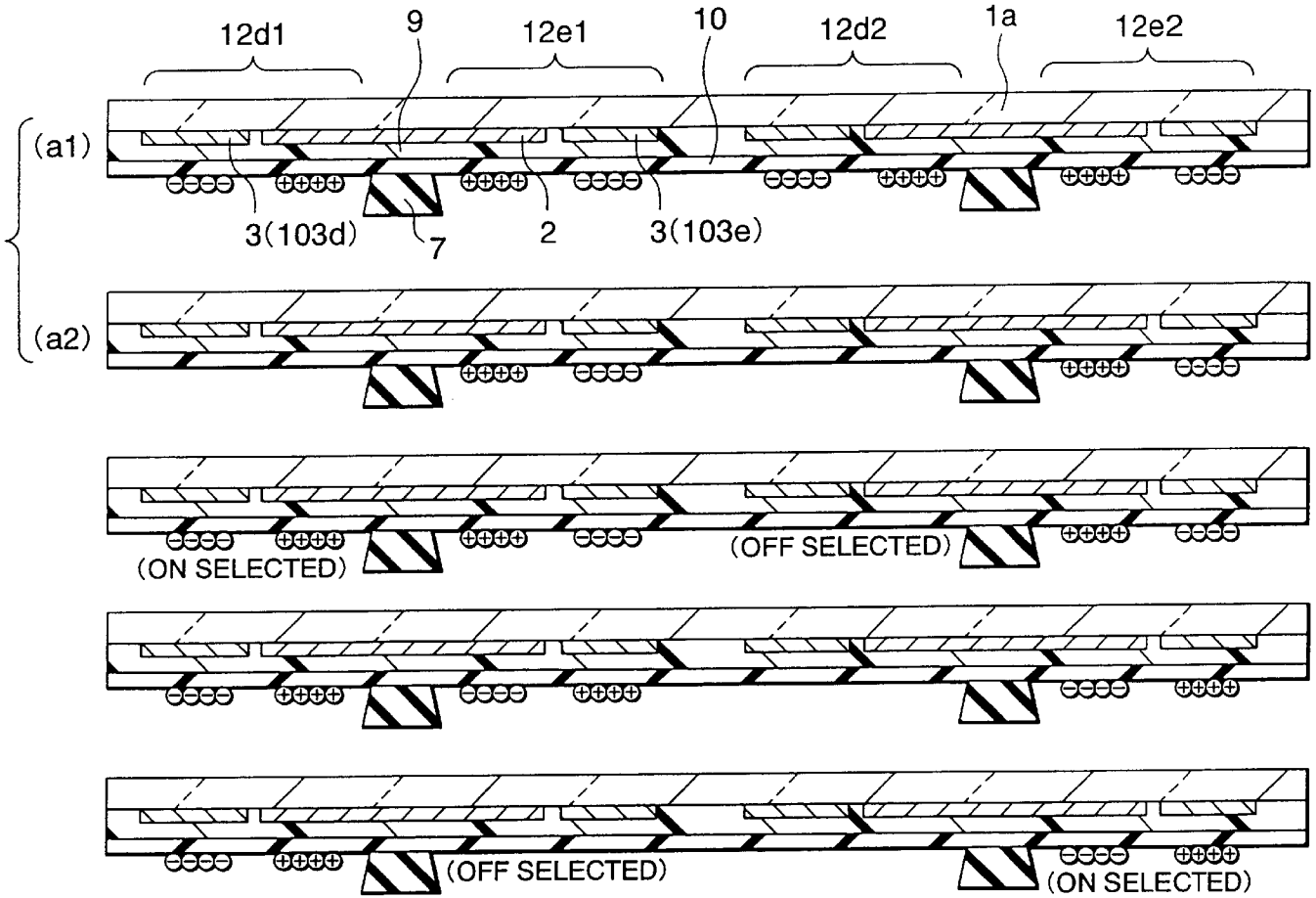
FIG. 21A to FIG. 21D are schematic diagrams illustrating states of wall charge within display cells on the cross section taken along line C—C in FIG. 10.

Next, a sixth embodiment of the present invention will be described. The configuration of a plasma display panel according to the sixth embodiment is the same as that of the first embodiment, but a driving method thereof is different. FIG. 20 is a timing chart illustrating the driving method of the plasma display panel according to the sixth embodiment of the present invention. Also, FIGS. 21 are schematic diagrams illustrating states of wall charge within display cells on the cross section taken along line B—B in FIG. 6, in which FIG. 21A to FIG. 21D illustrate states of wall charge at the time when periods A to D in FIG. 20 are ended, respectively.

First, in a first period A1 in the first pre-discharge period A, a positive pre-discharge pulse Vpc having a saw tooth shape is applied to the sustaining electrode groups 103*d* and 103*e*, and at the same time, a negative pre-discharge pulse Vps having a rectangular waveform is applied to the scanning electrode 2. Therefore, discharge is generated with the scanning electrode 2 as a cathode, and then, as shown in a1 of FIG. 21A, positive wall charge is formed on each scanning electrode 2, and negative wall charge is formed on each sustaining electrode 3.

Subsequently, in a second period A2 in the first pre-discharge period A, a negative pre-discharge erasing pulse Vpe having a saw tooth shape is applied to the sustaining electrode group 103*d*. On the other hand, the scanning electrode 2 and the sustaining electrode group 103*e* are not applied with a pulse and are fixed to the same potential with each other. As a result, although weak discharge is generated between the sustaining electrode group 103*d* and the scanning electrode 2, the resultant attained potential difference is low so that new wall charge is not formed. As shown in a2 of FIG. 21A, in display cells 12*d*1 and 12*d*2 having the sustaining electrode belonging to the sustaining electrode group 103*d*, discharge is ended only with wall charge formed due to the pre-discharge pulses Vps and Vpc disappearing.

Next, in the first selecting operation period B, negative first scan pulses Vw1 are sequentially applied to the scanning electrode 2, and a positive first data pulse Vd1 is applied to the data electrode 5 in accordance with the image data of the display cells 12*d*1 and 12*d*2 having the sustaining electrode 3 belonging to the sustaining electrode group 103*d*. On the other hand, a positive supplementary scan pulse Vsw is applied to the sustaining electrode group 103*d*.

Therefore, the scan pulse Vw1 and the data pulse Vd1 are applied to the display cell 12*d*1, where the image data is ON, and discharge is generated between the scanning electrode 2 and the data electrode 5. Also, substantially at the same time, discharge is used as a trigger that discharge with the scanning electrode 2 as a cathode is generated between the scanning electrode 2 and the sustaining electrode 3. And, positive charge is formed on the scanning electrode 2 due to the potential difference between the scan pulse Vw1 and the supplementary scan pulse Vsw, and intense negative wall charge is formed on the sustaining electrode 3.

On the other hand, because a data pulse is not applied to the display cell 12*d*2, where the image data is OFF, any discharge is not generated. Also, in display cells 12*e*1 and 12*e*2 having the sustaining electrode 3 belonging to the sustaining electrode group 103*e*, positive wall charge is formed on the scanning electrode 2 in the first pre-discharge period A so that the potential difference due to the scan pulse Vw1 is compensated. Consequently, there is no case that discharge is generated between the scanning electrode 2 and the data electrode 5 even in case where the data pulse Vd1 is applied.

As a result, as shown in FIG. 21B, positive wall charge is formed on the scanning electrode 2 and negative wall charge is formed on the sustaining electrode 3 only in the display cell 12*d*1 having the sustaining electrode 3 belonging to the sustaining electrode group 103*d*, where the image data is ON. FIG. 21B illustrates the case where the display cell 12*d*1 is ON and the display cell 12*d*2 is OFF.

Subsequently, in the second pre-discharge period C, a negative pre-discharge pulse Vp2 is applied to the sustaining electrode group 103*e*. At that time, the sustaining electrode group 103*d* and the scanning electrode 2 are not applied with a pulse and are kept to the same potential with each other. Therefore, discharge is generated in the display cells 12*e*1 and 12e2 having the sustaining electrode 3 belonging to the sustaining electrode group 103e. And, as shown in FIG. 21C, wall charge formed in the first pre-discharge period A is inverted, negative wall charge is formed on the scanning electrode 2, and positive wall charge is formed on the sustaining electrode 3.

After that, in the second selecting operation period D, negative second scan pulses Vw2 are sequentially applied to the scanning electrode 2, and a positive second data pulse Vd2 is applied to the data electrode 5 in accordance with the image data of the display cells 12e1 and 12e2 having the sustaining electrode 3 belonging to the sustaining electrode group 103e. At that time, the voltage magnitude of the second scan pulse Vw2 and the second data pulse Vd2 is set to such a voltage that discharge is not generated in case where wall charge does not exist on the scanning electrode 2, but an opposite discharge is generated in case where negative wall charge formed in the second pre-discharge period C exists on the scanning electrode 2. Also, pulse width of the second scan pulse Vw2 is set to be sufficiently short, for example, 1.5 μs. Consequently, there is no case that wall charge on the scanning electrode 2 and the sustaining electrode 3 is inverted by surface discharge generated between the scanning electrode 2 and the sustaining electrode 3 following the opposite discharge, and wall charge is disappeared.

Accordingly, wall charge can be disappeared only in the OFF display cell 12e1 with applying the second data pulse Vd2 to the display cell 12e1, where the image data is OFF. At that time, on the scanning electrode 2 of the display cells 12d1 and 12d2 having the sustaining electrode 3 belonging to the sustaining electrode group 103d, positive wall charge is formed if the selection is in ON state (for example, the display cell 12d1), and wall charge is not formed if the selection is in OFF state (for example, the display cell 12d2). Consequently, in the second selecting operation period D, any discharge is not generated.

After that, in the sustaining discharge period E, the sustaining discharge pulses Vs are applied to the scanning electrode 2 and the sustaining electrode 3, which have the polarities inverted each other. As a result, in the display cell 12 in which wall charge is formed, discharge is generated, and light emission for display is achieved. Also, at the time when an initial sustaining discharge pulse Vs1 of the sustaining discharge period E is applied, the scanning electrode becomes an anode. This is because, until the second selecting operation period D is ended, as shown a1 of FIG. 21A, polarity of wall charge is inverted between the display cell 12 having the sustaining electrode 3 belonging to the sustaining electrode group 103d (for example, the display cell 12d1) and the display cell 12 having the sustaining electrode 3 belonging to the sustaining electrode group 103e (for example, the display cell 12d2), and discharge has been already generated once in the display cell 12 having the sustaining electrode 3 belonging to the sustaining electrode group 103e in the second pre-discharge period C. That is, the polarity of the first sustaining discharge pulse Vs1 is determined in order to match the number of discharge times between both the display cells so that initial discharge is generated in the display cell 12 having the sustaining electrode 3 belonging to the sustaining electrode group 103d in the sustaining discharge period E.

After the sustaining discharge is ended, in the sustaining erasing period F, with applying the sustaining erasing pulse Ve having a dull waveform to the scanning electrode 2, wall charge is erased, and at the same time, discharge is stopped to be transferred to the next sub-field.

By the above-mentioned operation, control of ON/OFF of display becomes possible for all the display cells 12 within one sub-field.

Consequently, according to the sixth embodiment, light emission is reduced in the non-display cell due to addressing so that contrast can be improved.

Also, in the present embodiment, the number of light emissions is not matched between each display cell 12 having the sustaining electrode 3 belonging to the sustaining electrode groups 103d and 103e, respectively. In case where the image data is ON, there is light emission due to the pre-discharge erasing pulse Vpe and the first scan pulse Vw1 in the display cell 12 having the sustaining electrode 3 belonging to the sustaining electrode group 103d, but there is not such a discharge in the display cell having the sustaining electrode 3 belonging to the sustaining electrode group 103e. Also, in case where the image data is OFF, there is a weak light emission due to the pre-discharge erasing pulse Vpe in the display cell 12 having the sustaining electrode 3 belonging to the sustaining electrode group 103d. On the other hand, there is not such a light emission in the display cell 12 having the sustaining electrode 3 belonging to the sustaining electrode group 103e, whereas there is light emission due to the pre-discharge pulse Vp2 and the second scan pulse Vw2. Consequently, light emission brightness is varied every display line so that image quality such as resolution may be deteriorated. In such a case, in the same manner as the fifth embodiment, brightness is averaged with changing the addressing sequence every field or every sub-field so that deterioration of image quality can be avoided.

Figure 22:
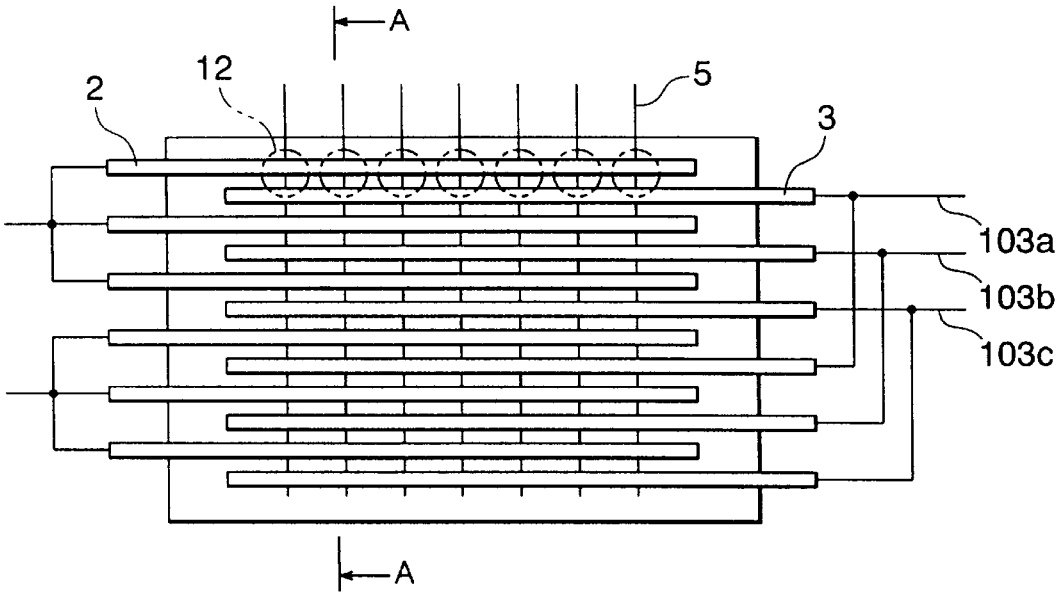
FIG. 22 is a schematic diagram illustrating an electrode arrangement of a plasma display panel (PDP) used in a driving method according to a seventh embodiment of the present invention.

Next, a seventh embodiment of the present invention will be described. FIG. 22 is a schematic diagram illustrating an electrode arrangement in a plasma display panel (PDP) used in a driving method according to the second embodiment of the present invention.

In the seventh embodiment, a plurality of scanning electrodes 2 and sustaining electrodes 3 which are extended in the same direction with each other are alternately disposed. Also, a plurality of data electrodes 5 which are extended perpendicularly to the scanning electrodes 2 and the sustaining electrodes 3 are disposed. And, one display cell 12 is provided at the intersection of a pair of the scanning electrodes 2 and the sustaining electrode 3 parallel to each other and one data electrode perpendicular to those electrodes.

Figure 1:
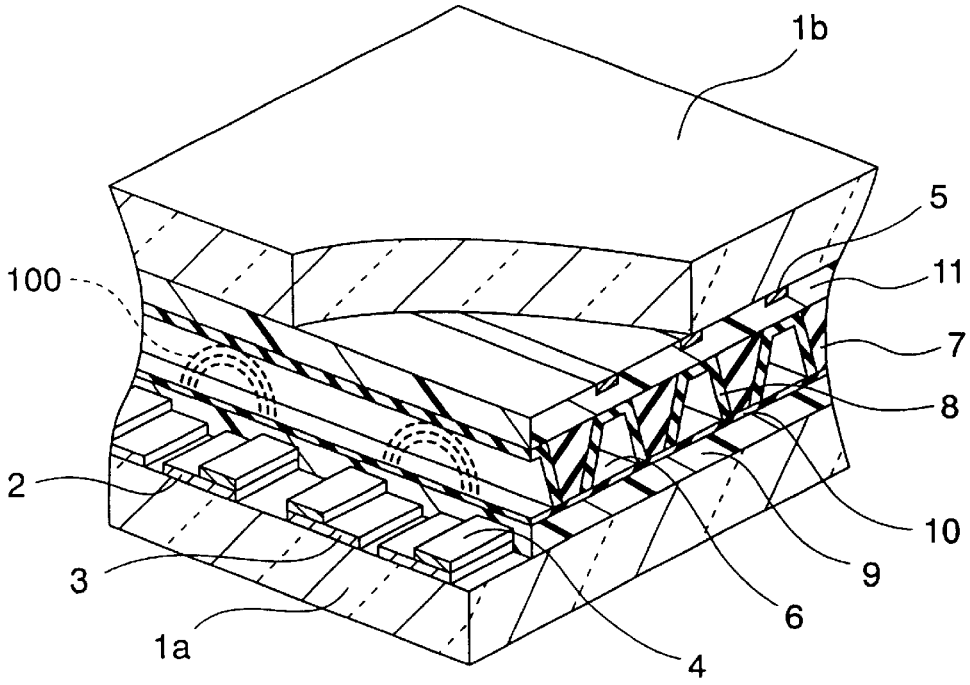
FIG. 1 (PRIOR ART)
FIG. 1 is a partially cross sectional view illustrating a conventional plasma display panel.
Figure 2:
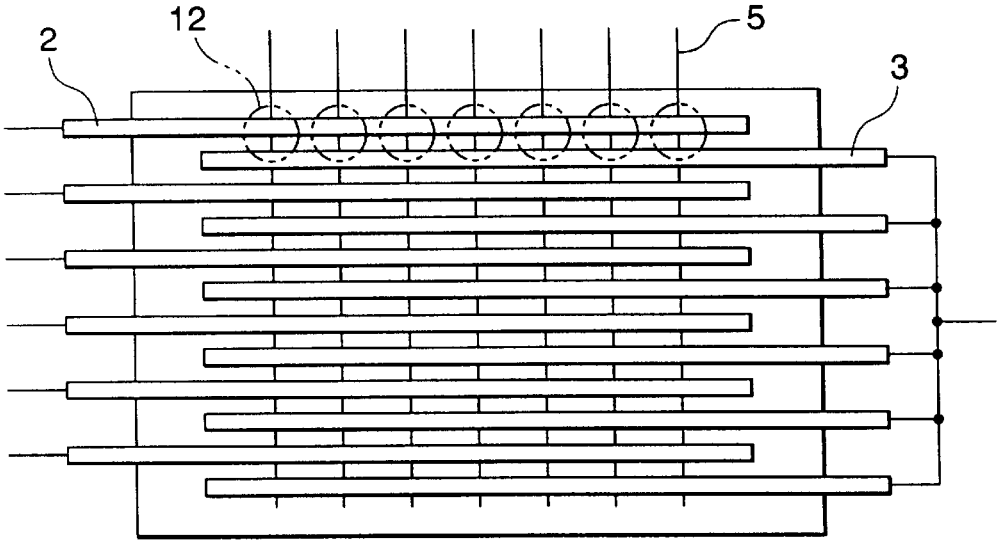
FIG. 2 (PRIOR ART)
FIG. 2 is a schematic diagram illustrating an electrode arrangement in a conventional plasma display panel.
Figure 3:
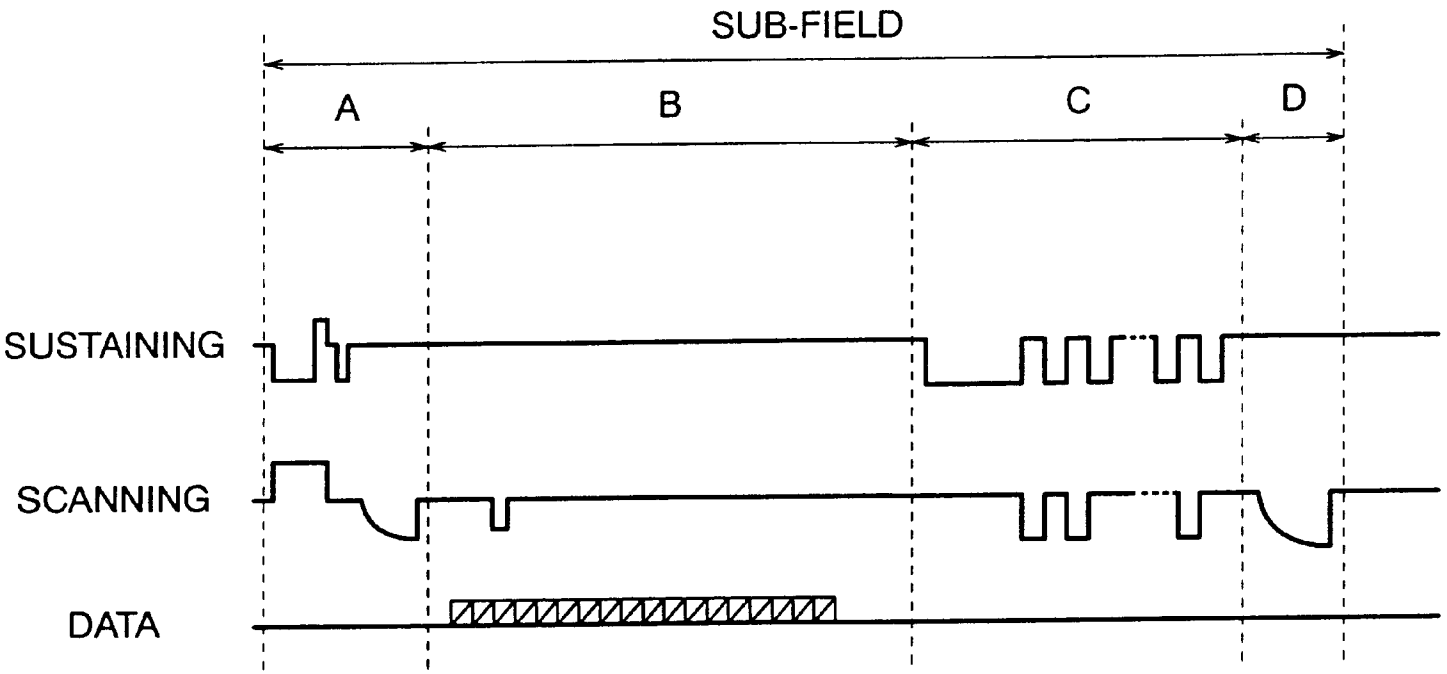
FIG. 3 (PRIOR ART)
FIG. 3 is a timing chart illustrating a voltage pulse applied to each electrode.
Figure 4:
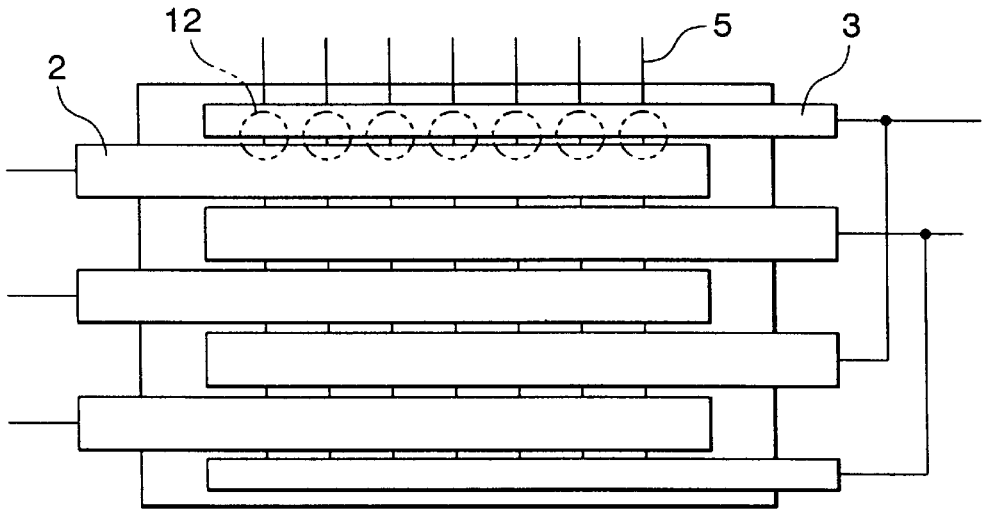
FIG. 4 (PRIOR ART)
FIG. 4 is a schematic diagram illustrating an electrode arrangement in a conventional plasma display panel having an electrode structure in which a scanning electrode is shared between upper and lower adjacent display cells.
Figure 5:
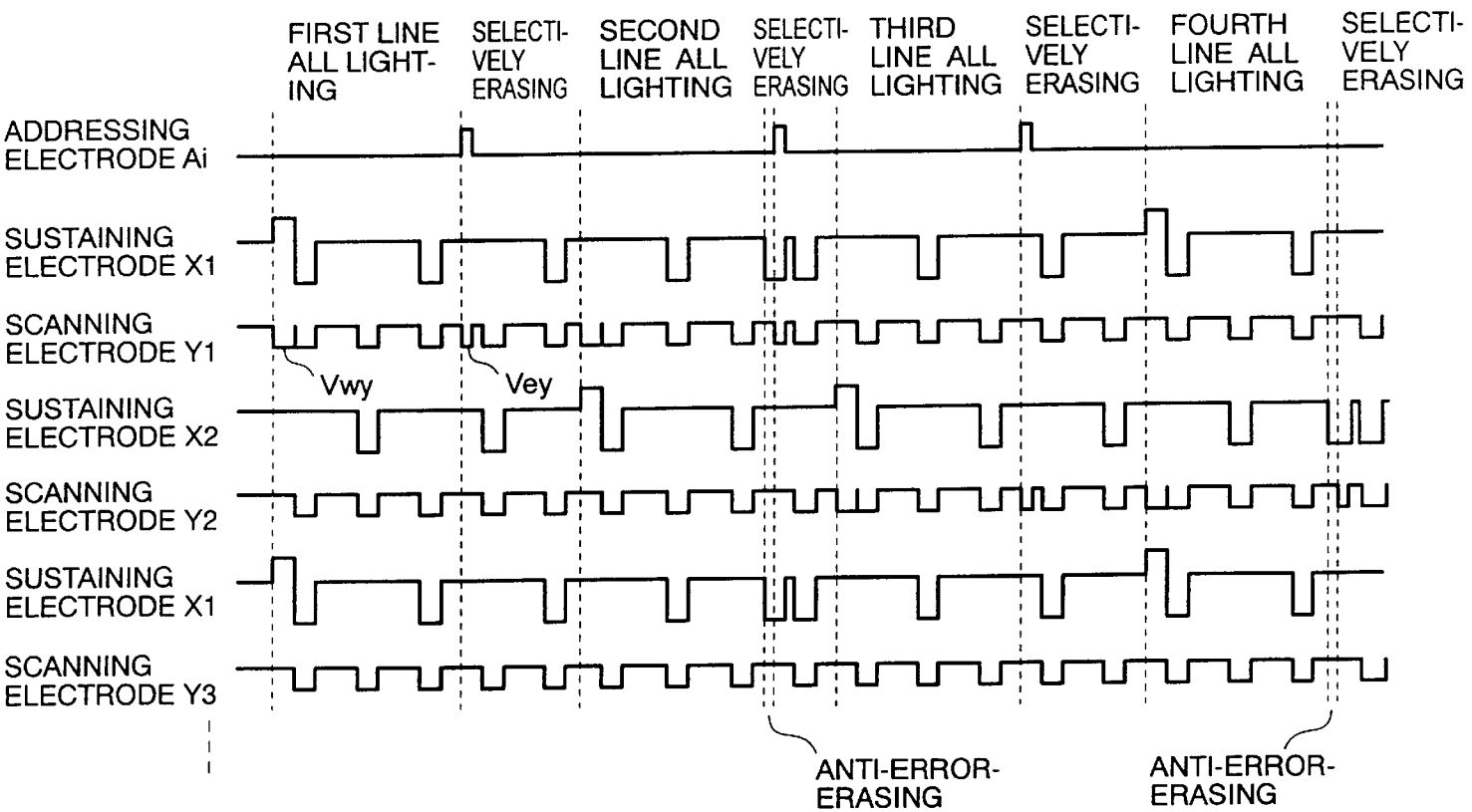
FIG. 5 (PRIOR ART)
FIG. 5 is a timing chart illustrating a conventional driving method disclosed in Japanese Patent No. 2629944.

In the present embodiment, every three scanning electrodes 2 are electrically commonly connected, and the common intersection is connected to output pins of a scan driver IC (not shown). Therefore, the number of outputs of the scan driver IC becomes ⅓ of the number of display lines. On the other hand, the sustaining electrodes 3 are electrically commonly connected every other two in the outside of display region, and three sustaining electrode groups 103a to 103c are constituted. The PDP has the same configuration as that of the conventional PDP shown in FIG. 1 in the points other than the connection relating to the scanning electrode 2 and the sustaining electrode 3.

Figure 23:
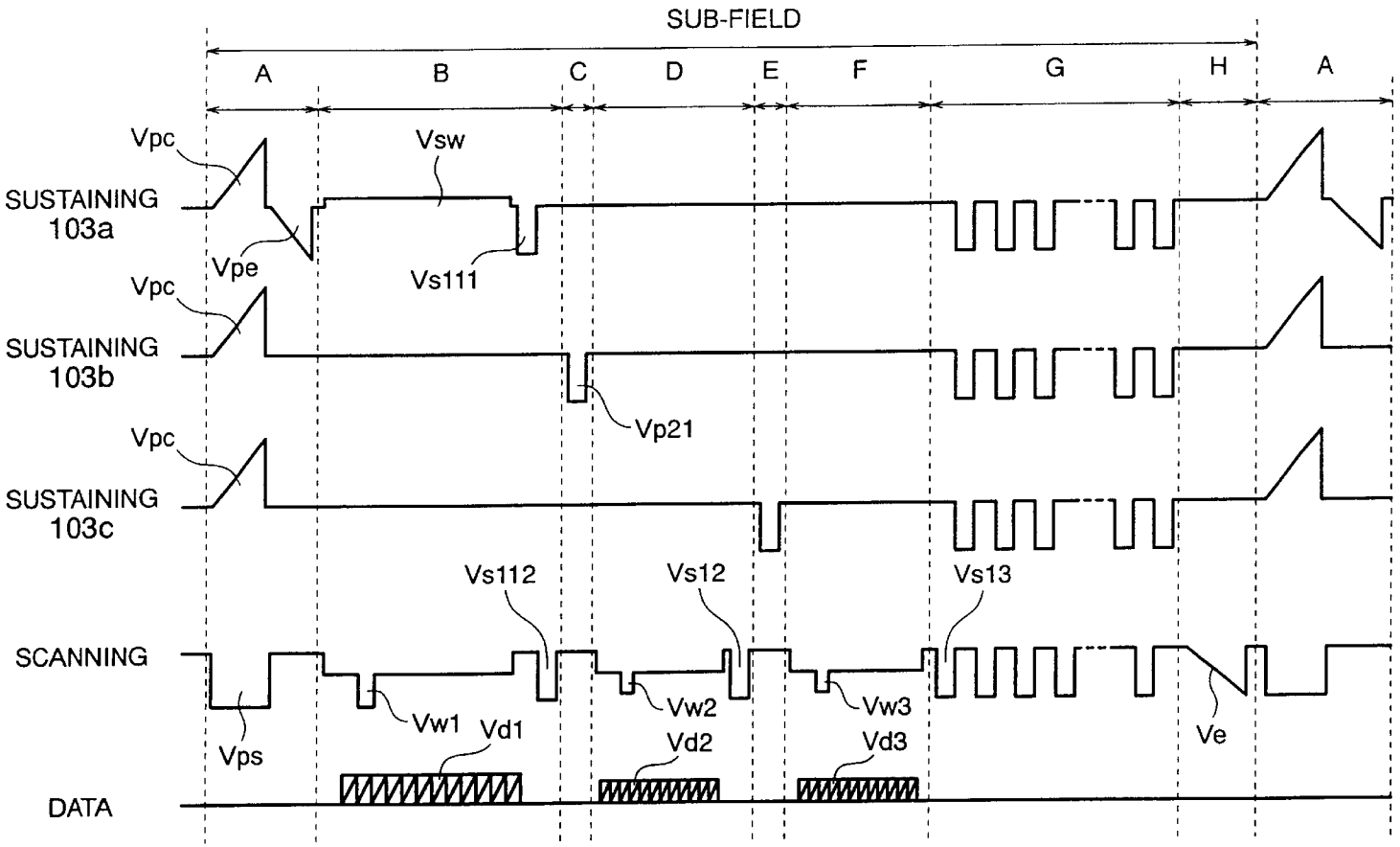
FIG. 23 is a timing chart illustrating a driving method of the plasma display panel according to the seventh embodiment of the present invention.
Figures 24A, 24B, 24C, 24D, 24E, 24F:
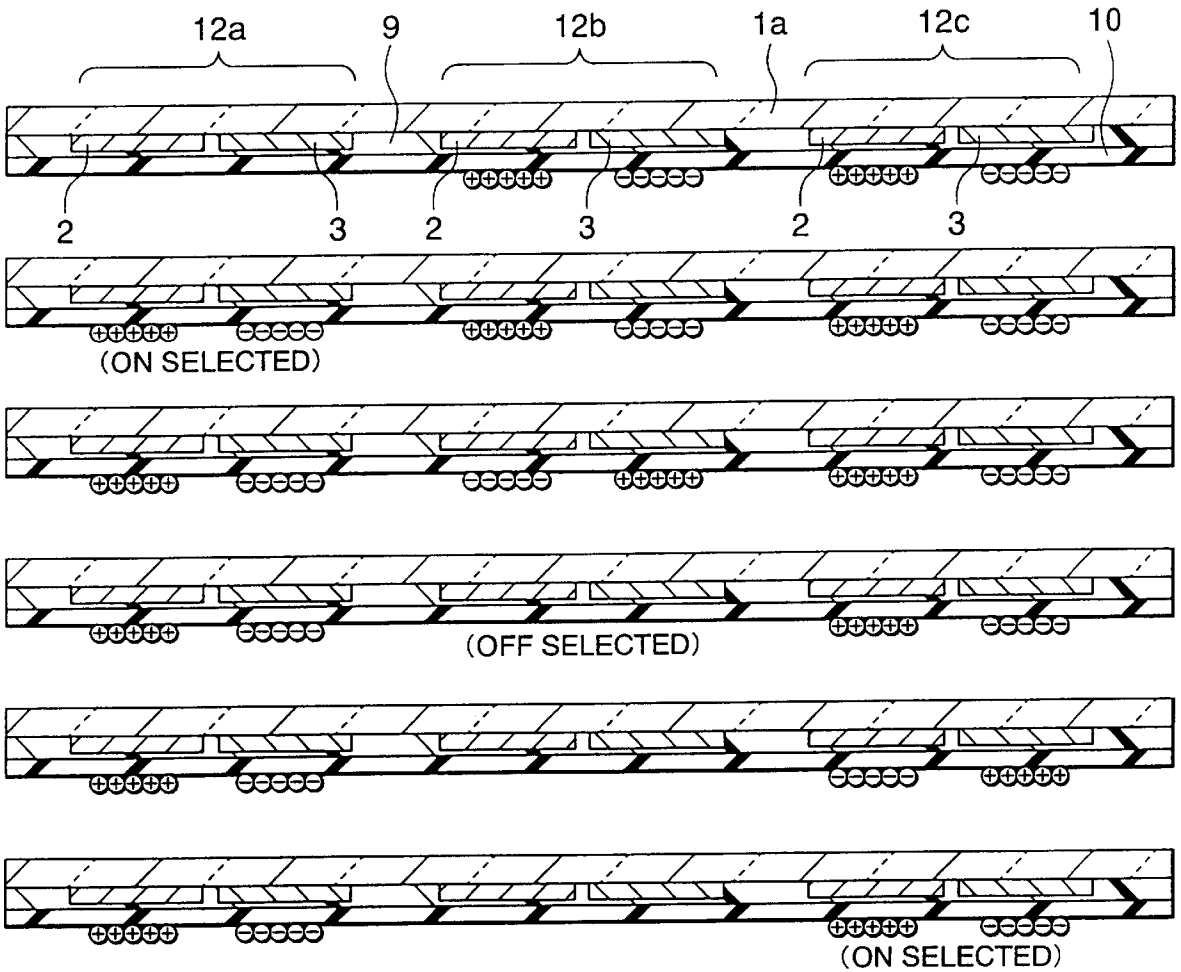
FIG. 24A to FIG. 24F are schematic diagrams illustrating states of wall charge within display cells on the cross section taken along line A—A in FIG. 22.

Next, an operation of the plasma display panel of the above-configured seventh embodiment, that is, a driving method thereof will be described. FIG. 23 is a timing chart illustrating the driving method of the plasma display panel according to the seventh embodiment of the present invention. Also, FIGS. 24 are schematic diagrams illustrating states of wall charge within display cells on the cross section taken along line A—A in FIG. 22, in which FIG. 24A to FIG. 24F illustrate states of wall charge at the time when periods A to F in FIG. 23 are ended, respectively.

First, in a first pre-discharge period A, a first pre-discharge pulse Vpc having a positive polarity and a saw tooth shape is applied to the sustaining electrode groups 103*a* to 103*c*, and at the same time, a pre-discharge pulse Vps having a negative polarity and a rectangular waveform is applied to the scanning electrode 2. Therefore, discharge is generated with the scanning electrode 2 as a cathode, positive wall charge is formed on each scanning electrode 2, and negative wall charge is formed on each sustaining electrode 3. Subsequently, a pre-discharge erasing pulse Vpe having a negative polarity and a saw tooth shape is applied to the sustaining electrode group 103*a*. On the other hand, the scanning electrode 2 and the sustaining electrode groups 103*b* and 103*c* are not applied with a pulse and are fixed to the same potential with each other. As a result, although weak discharge is generated between the sustaining electrode group 103*a* and the scanning electrode 2, the resultant attained potential difference is low so that new wall charge is not formed, and as shown in FIG. 24A, in a display cell 12*a* having the sustaining electrode 3 belonging to the sustaining electrode group 103*a*, wall charge is disappeared. There is no change in display cells 12*b* and 12*c* having the sustaining electrode 3 belonging to the sustaining electrode groups 103*b* or 103*c*, respectively.

Next, in a first selecting operation period B, a positive supplementary scan pulse Vsw is applied to the sustaining electrode group 103*a*, and scan pulses Vw1 having a negative polarity are sequentially applied to each scanning electrode 2. The voltage of the pulse Vw1 is set to a voltage in which discharge is not generated solely even in the display cell 12*a* where wall charge is erased due to pre-discharge. Also, for the data electrode 5, a data pulse Vd1 synchronized with a scan pulse Vw is applied only to the ON display cell performing display in accordance with the image data. The potential difference between the data pulse Vd1 and the scan pulse Vw1 is set not to exceed the discharge start voltage between the scanning electrode 2 and the data electrode 5 in such display cells as the display cells 12*b* and 12*c* in which positive wall charge is formed on the scanning electrode 2, and is set to exceed the discharge start voltage only in case where wall charge is not formed on the scanning electrode 2. Accordingly, in the display cell 12*a* where the data pulse Vd1 is applied, with applying the scan pulse Vw1 and the data pulse Vd1, discharge is generated between the scanning electrode 2 and data electrode 5, and discharge is used as a trigger that discharge with the scanning electrode 2 as a cathode is generated between the scanning electrode 2 and the sustaining electrode 3. And, as shown in FIG. 24B, positive wall charge is formed on the scanning electrode 2 and intense negative wall charge is formed on the sustaining electrode 3 due to the potential difference between the scan pulse Vw1 and the supplementary scan pulse Vsw. After that, an initial sustaining pulse Vs111 is applied to the sustaining electrode group 103*a*, and again, a second sustaining pulse Vs112 is applied to the scanning electrode 2.

On the other hand, because a data pulse is not applied to the display cell 12*a* where the image data is OFF, any discharge is not generated. Also, in the display cells 12*b* and 12*c* having the sustaining electrode 3 belonging to the sustaining electrode group 103*b* or 103*c*, positive wall charge is formed on the scanning electrode 2 in the first pre-discharge period A so that the potential difference due to the scan pulse Vw1 is compensated. Consequently, there is no case that discharge is generated between the scanning electrode 2 and the data electrode 5 even in case where the data pulse Vd1 is applied. Also, because the potential difference is compensated with respect to the second sustaining pulse Vs112, there is no case that discharge is generated.

As a result, in the display cell 12*a* where the image data is ON, as shown in FIG. 24B, wall charge having a polarity opposite to each other is formed on the scanning electrode 2 and the sustaining electrode 3, respectively. FIG. 24B illustrates the case where the display cell 12*a* is ON.

Next, in a second pre-discharge period C, a negative pre-discharge pulse Vp21 is applied to the sustaining electrode group 103*b*. At that time, the sustaining electrode groups 103*a* and 103*c* and the scanning electrode 2 are not applied with a pulse and are kept to the same potential with each other. Therefore, discharge is generated in the display cell 12*b* having the sustaining electrode 3 belonging to the sustaining electrode group 103*b*. And, as shown in FIG. 24C, wall charge formed in the first pre-discharge period A is inverted, negative wall charge is formed on the scanning electrode 2, and positive wall charge is formed on the sustaining electrode 3. On the other hand, in the display cells 12*a* and 12*c* having the sustaining electrode 3 belonging to the sustaining electrode group 103*a* or 103*c*, the previous state is sustained.

Next, in a second selecting operation period D, negative second scan pulses Vw2 are sequentially applied to the scanning electrode 2, and a positive second data pulse Vd2 is applied to the data electrode 5 in accordance with the image data of the display cell 12*b* having the sustaining electrode 3 belonging to the sustaining electrode group 103*b*. At that time, the voltage magnitude of the second scan pulse Vw2 and the second data pulse Vd2 is set to such a voltage that discharge is not generated in case where wall charge does not exist on the scanning electrode 2 or in case where positive wall charge exists, but an opposite discharge is generated in case where negative wall charge formed in the second pre-discharge period C exists. Also, pulse width of the second scan pulse Vw2 is set to be sufficiently short, for example, 1.5 $\mu$s. Consequently, there is no case that wall charge on the scanning electrode 2 and the sustaining electrode 3 is inverted by surface discharge generated between the scanning electrode 2 and the sustaining electrode 3 following the opposite discharge, and the wall charge is disappeared.

Accordingly, wall charge can be disappeared only in the OFF display cell 12*b* with applying the second data pulse Vd2 to the display cell 12*b* where the image data is OFF. At that time, on the scanning electrode 2 of the display cell 12*a* having the sustaining electrode 3 belonging to the sustaining electrode group 103*a*, positive wall charge is formed if the selection is in ON state, and wall charge is not formed if the selection is in OFF state. Also, positive wall charge is formed on the scanning electrode 2 of the display cell 12*c* having the sustaining electrode 3 belonging to the sustaining electrode group 103*c*. Consequently, in the second selecting operation period, any discharge is not generated in the sustaining electrode groups 103*a* and 103*c*.

After the scan pulses Vw2 are sequentially applied to all the scanning electrodes 2, with applying a first sustaining discharge pulse Vs12 to the scanning electrode 2, sustaining discharge is generated in the ON display cell having the sustaining electrode 3 belonging to the sustaining electrode group 103*b*. Therefore, wall charge having the inverted polarity is formed on the scanning electrode 2 and the sustaining electrode 3. FIG. 24D illustrates the case where the display cell 12*b* is OFF.

In a third pre-discharge period E and a third selecting operation period F, selecting operation is performed only in the display cell 12*c* having the sustaining electrode 3 belonging to the sustaining electrode group 103*c*, in the same manner as the second pre-discharge period C and the second selecting operation period D, as shown in FIG. 24E and FIG. 24F. Accordingly, there is no change in the display cells 12*a* and 12*b* having the sustaining electrode 3 belonging to the sustaining electrode group 103*a* or 103*b*. FIG. 24F illustrates the case where the display cell 12*c* is ON.

After that, in a sustaining discharge period G, sustaining discharge pulses Vs having a polarity opposite to each other are applied to all the scanning electrodes 2 and the sustaining electrodes 3 so that discharge is generated only in the display cell 12 where wall charge is not erased in the selecting operation periods B, D and F. Therefore, light emission for display is achieved. Also, at the time when applying an initial sustaining discharge pulse Vs13 of the sustaining discharge period G, the scanning electrode 2 becomes a cathode. This is because in the display cell 12*c* having the sustaining electrode 3 belonging to the sustaining electrode group 103*c*, discharge is generated only one time in the third pre-discharge period E. In other words, in the display cell 12*a* having the sustaining electrode 3 belonging to the sustaining electrode group 103*a*, two times of discharges are generated with applying the first sustaining discharge pulse Vs111 and the second sustaining discharge pulse Vs112. In the display cell 12*b* having the sustaining electrode 3 belonging to the sustaining electrode group 103*b*, two times of discharges are generated with applying a pre-discharge pulse Vp21 and the first sustaining discharge pulse Vs12. Therefore, the polarity of the first sustaining discharge pulse Vs13 is determined in order to match the number of discharge times between the display cells 12*a* to 12*c* so that initial discharge is generated in the display cell 12*c* having the sustaining electrode 3 belonging to the sustaining electrode group 103*c* in the sustaining discharge period G.

In a sustaining erasing period H, with applying a sustaining erasing pulse Ve having a saw tooth shape to the scanning electrode 2, wall charge is erased, and at the same time, discharge is stopped to be transferred to the next sub-field.

By the above-mentioned operation, control of ON/OFF of display becomes possible for all the display cells 12 within one sub-field.

Therefore, the number of outputs of the scan driver IC required for display can be reduced to ⅓ of the number of display lines. On the other hand, because the sustaining discharge period is shared with all the display lines so that the only sustaining discharge is performed, high brightness can be easily achieved with increasing the frequency of the sustaining discharge pulse. And, because voltage pulse which is applied sequentially to the scanning electrode is one type, there is no case that scan circuit becomes complex.

Also, in the present embodiment, the number of light emission times is not matched among the respective display cells 12*a* to 12*c* having the sustaining electrode 3 belonging to the sustaining electrode groups 103*a* to 103*c*, respectively. Consequently, light emission brightness is varied every display line so that image quality such as resolution may be deteriorated. In such a case, in the same manner as the fifth embodiment, brightness is averaged with changing the addressing sequence every field or every sub-field so that deterioration of image quality can be avoided.

Figure 25:
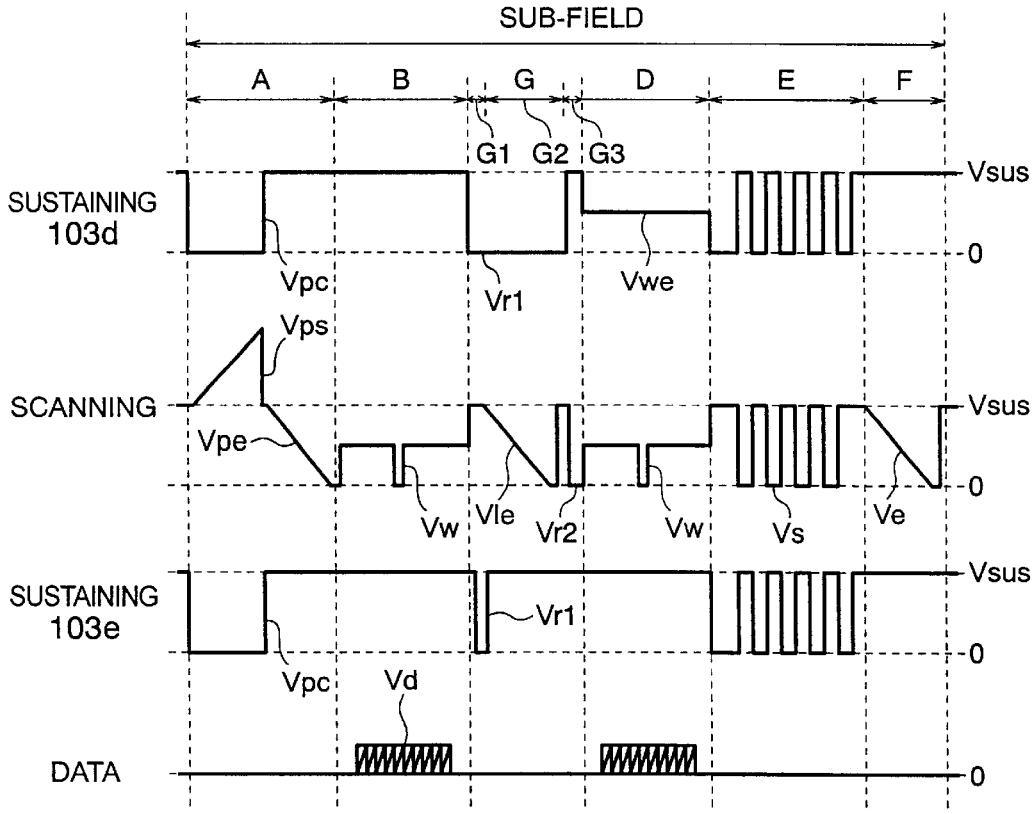
FIG. 25 is a timing chart illustrating a driving method of the plasma display panel according to an eighth embodiment of the present invention.
Figures 26A, 26B, 26C, 26D:
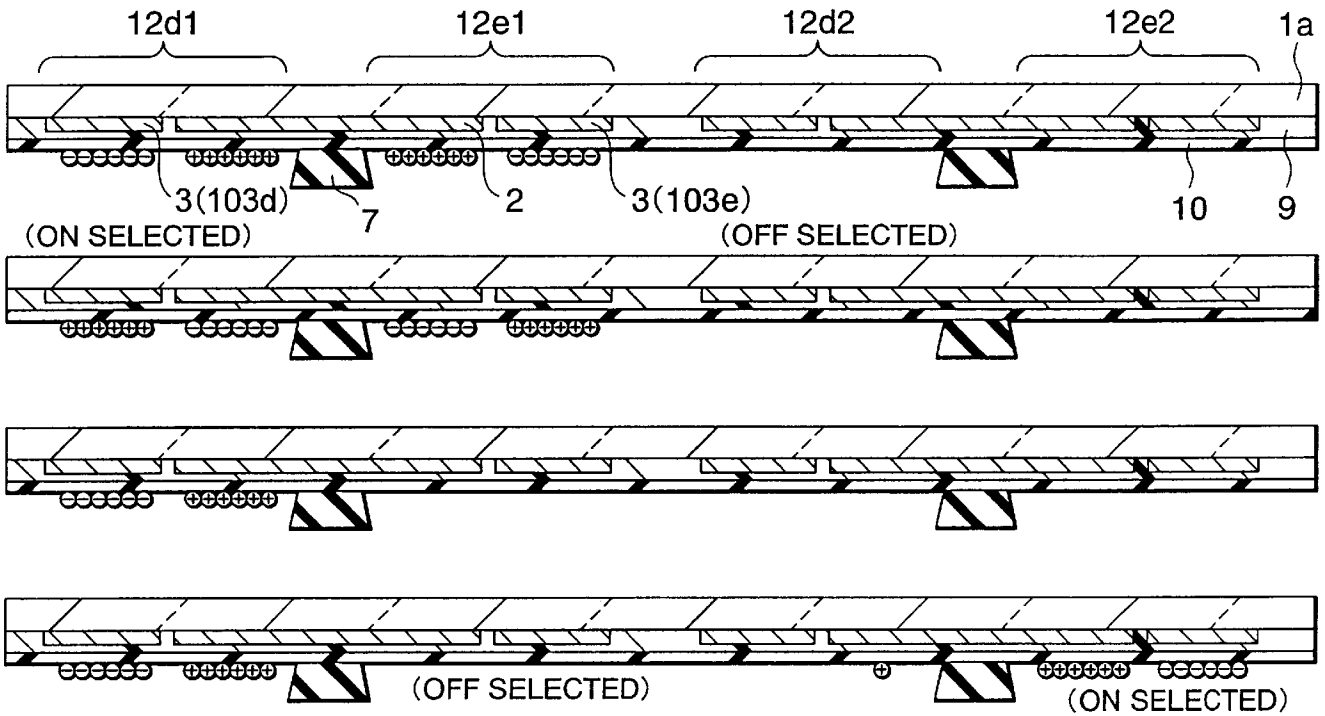
FIG. 26A to 26D are schematic diagrams illustrating states of wall charge within display cells on the cross section taken along line B—B in FIG. 6.

Next, an eighth embodiment of the present invention will be described. The configuration of the plasma display panel according to the eighth embodiment is the same as that of the first embodiment, but the driving method is different. In the driving method of the eighth embodiment, the second pre-discharge period C is not provided between the first and the second selecting operation periods, whereas a regulating period G is provided. The regulating period G consists of the first to the third periods G1 to G3. FIG. 25 is a timing chart illustrating a driving method of the plasma display panel according to the eighth embodiment of the present invention. Also, FIGS. 26 are schematic diagrams illustrating states of wall charge within display cells on the cross section taken along line B—B in FIG. 6, in which FIG. 26A to FIG. 26D sequentially illustrate states of wall charge at the time when the periods B, G1, G3, and D in FIG. 25 are ended, respectively. In addition, in the present embodiment, a reference potential of plane electrode consisting of a scanning electrode 2 and a sustaining electrode 3 is taken a sustaining voltage Vsus for sustaining discharge in a sustaining period. Accordingly, with respect to the scanning electrode 2 and the sustaining electrode 3, higher potential than the sustaining voltage Vsus is represented as a potential having positive polarity, and lower potential than the sustaining voltage Vsus is represented as a potential having negative polarity. Also, the potential of a data electrode 5 is taken from a reference of 0V.

First, in a pre-discharge period A, positive pre-discharge pulse Vps having a saw tooth shape is applied to the scanning electrode 2, and at the same time, negative pre-discharge pulse Vpc having a rectangular waveform is applied to the sustaining electrode groups 103*d* and 103*e*. Therefore, discharge is generated with the scanning electrode 2 as an anode, negative wall charge is formed on each scanning electrode 2, and positive wall charge is formed on each sustaining electrode 3. Subsequently, negative pre-discharge erasing pulse Vpe having a saw tooth shape is applied to the scanning electrode 2. On the other hand, the sustaining electrode group 103*d* and the sustaining electrode group 103*e* are not applied with a pulse and are fixed to the sustaining voltage Vsus. As a result, although weak discharge is generated between the sustaining electrode groups 103*d* and 103*e* and the scanning electrode 2, the resultant attained potential difference is low so that new wall charge is not formed, and in all the display cells 12, discharge is ended only with wall charge formed due to the pre-discharge pulses Vps and Vpc disappearing.

Next, in a first selecting operation period B, a negative scan pulse Vw is sequentially applied to the scanning electrode 2, and a positive data pulse Vd is applied to the data electrode 5 in accordance with the image data of the display cells 12*d*1 and 12*d*2 having the sustaining electrodes 3 belonging to the sustaining electrode group 103*d*. The potentials of the sustaining electrode groups 103*d* and 103*e* are fixed to the sustaining voltage Vsus.

Therefore, the scan pulse Vw and the data pulse Vd are applied to the display cell 12*d*1 where the image data is ON so that discharge is generated between the scanning electrode 2 and the data electrode 5. Also, substantially at the same time, this discharge is used as a trigger that discharge with the scanning electrode 2 as a cathode is generated between the scanning electrode 2 and the sustaining electrode 3. And, positive wall charge is formed on the scanning electrode 2 due to the potential difference between the scan pulse Vw and the sustaining voltage Vsus, and intense negative wall charge is formed on the sustaining electrode 3. In the display cell 12*e*1, which shares the scanning electrode 2 with the display cell 12*d*1, the same discharge is generated, positive wall charge is formed on the scanning electrode 2, and negative wall charge is formed on the sustaining electrode 3.

On the other hand, because a data pulse is not applied to the display cell 12*d*2 where the image data is OFF, any discharge is not generated. Also, in the display cells 12$e$2, which shares the scanning electrode 2 with the display cell 12$d$2, any discharge is not generated.

As a result, as shown in FIG. 26A, positive wall charge is formed on the scanning electrode 2 and negative wall charge is formed on the sustaining electrode 3 only in the display cell 12$d$1 having the sustaining electrode 3 belonging to the sustaining electrode group 103$d$ where the image data is ON and the display cell 12$e$1, which shares the scanning electrode 2 with the display cell 12$d$1. FIG. 26A illustrates the case where the display cell 12$d$1 is ON and the display cell 12$d$2 is OFF.

Subsequently, in a first period G1 of the regulating period G, a first charge inverting pulse Vr1 is applied to the sustaining electrode groups 103$d$ and 103$e$. At this time, a pulse is not applied to the scanning electrode 2, which is fixed to the sustaining voltage Vsus. Therefore, as shown in FIG. 26B, in the display cells 12$d$1 and 12$e$1, the polarity of the wall charge formed in the first selecting operation period B is inverted.

Also, in a second period G2 of the regulating period G, an intermediate erasing pulse Vie which has negative polarity and a saw tooth shape is applied to the scanning electrode 2. At this time, the first charge inverting pulse Vr1 is continuously applied to the sustaining electrode group 103$d$ from the first period G1. On the other hand, the potential of the sustaining electrode group 103$e$ is fixed to the sustaining voltage Vsus. Therefore, only in the display cell 12$e$1 having the sustaining electrode 3 belonging to the sustaining electrode group 103$e$ where discharge is generated in the first selecting operation period B, weak discharge is generated between the scanning electrode 2 and the sustaining electrode 3. As a result, wall charge formed on the scanning electrode 2 and the sustaining electrode 3 due to applying the first charge inverting pulse Vr1 is erased.

Subsequently, in a third period G3 of the regulating period G, a second charge inverting pulse Vr2 is applied to the scanning electrode 2. At this time, the potentials of the sustaining electrode groups 103$d$ and 103$e$ are fixed to the sustaining voltage Vsus. Therefore, as shown in FIG. 26C, only in the display cell 12$d$1 having the sustaining electrode 3 belonging to the sustaining electrode group 103$d$ where discharge is generated in the first selecting operation period B, discharge is generated and the polarity of the wall charge on the scanning electrode 2 and the sustaining electrode 3 is inverted.

After that, in a second selecting operation period D, negative scan pulses Vw are sequentially applied to the scanning electrode 2, and a positive data pulse Vd is applied to the data electrode 5 in accordance with the image data of the display cells 12$e$1 and 12$e$2 having the sustaining electrode 3 belonging to the sustaining electrode group 103$e$. The potential of the sustaining electrode 103$e$ is fixed to the sustaining voltage Vsus, and a negative scan erasing pulse Vwe is applied to the sustaining electrode group 103$d$. Therefore, positive wall charge is formed on the scanning electrode 2 and negative wall charge is formed on the sustaining electrode 3, only in the display cell 12$e$2 where the image data is ON, as shown in FIG. 26D. FIG. 26D illustrates the case where the display cell 12$e$1 is OFF and the display cell 12$e$2 is ON.

Next, the operation of the display cells 12$d$1 and 12$d$2 having the sustaining electrode 3 belonging to the sustaining electrode group 103$d$ during the second selecting scan period D will be described.

In the display cell 12$d$1 where the image data is ON, because positive wall charge is formed on the scanning electrode 2 in the third period G3, potential difference due to the scan pulse Vw is compensated so that discharge is not generated. On the other hand, because wall charge is not formed in the display cell 12$d$2 where the image data is OFF, discharge is generated between the scanning electrode 2 and the data electrode 5 in case where the data pulse Vd is applied. However, at this time, because a scan erasing pulse Vwe is applied to the sustaining electrode group 103$d$, intense discharge is not generated between the scanning electrode 2 and the sustaining electrode 3, and sufficient wall charge is not formed due to the sustaining discharge, as shown in FIG. 26D.

After that, in a sustaining discharge period E, sustaining discharge pulses Vs are applied to the scanning electrode 2 and the sustaining electrode 3, which have the polarities inverted each other. As a result, in the selecting scan periods B and D, discharge is generated and light emission for display is achieved only in the display cell 12 where intense wall charge is formed.

Subsequently, in a sustaining erasing period F, with applying a sustaining erasing pulse Ve having an attenuating waveform to the scanning electrode 2, wall charge is erased, and discharge is stopped to be transferred to the next sub-field.

By the above-mentioned operation, control of ON/OFF of display becomes possible for all the display cells 12 within one sub-field.

According to the eighth embodiment, a circuit generating a pulse having a saw tooth shape can be facilitated with only the side of the scanning electrode 2. Therefore, it is unnecessary that a circuit generating a pulse having a saw tooth shape is provided separately to the sustaining electrode groups 103$d$ and 103$e$ as the fifth embodiment. Accordingly, it is possible that cost of driving circuit is suppressed low.

Next, sub-field selection method for the input gradation in the present embodiment will be described. In the present embodiment, the number of sub-fields is, for example, 10, and the number of display gradation levels is, for example, 256. The weighting of luminance of each sub-field is shown in Table 1. The numerical value of weighting is a value of subtracting the display luminance in the regulating period G from the display luminance in cell selected in the first selecting operation period B. In addition, the regulating period G and second selecting operation period D are not provided in a sub-field (SF1) for displaying the lowest luminance among each sub-field. Accordingly, a period right after the first selecting operation period B is the sustaining period E in the sub-field (SF1). Also, by sub-field in SF2 to SF10, the waveform applied to the sustaining electrode group 103$d$ and the waveform applied to the sustaining electrode group 103$e$ are exchanged, and then, the sequence of the selecting operation is changed. Further, in SF2 to SF10, the applied waveform is changed even by field. In addition, the total sum of weighting of each sub-field does not become 255. This is because change of luminance due to crosstalk light emission is considered as described below.

TABLE 1

| SF | 1 | 2 | 3 | 4 | 5 | 6 | 7 | 8 | 9 | 10 |
|---|---|---|---|---|---|---|---|---|---|---|
| Weighting | 1 | 2 | 3 | 8 | 15 | 25 | 34 | 44 | 55 | 66 |

FIG. 27 illustrates a part of LUT showing a relation of input gradation and sub-field selection according to the eighth embodiment. In FIG. 27, the title part at the left end illustrates the input gradation level with respect to the display cell 12*d* having the sustaining electrode 3 belonging to the sustaining electrode group103*d*, and the title part at the upper end illustrates the input gradation level with respect to the display cell 12*e* having the sustaining electrode 3 belonging to the sustaining electrode group103*e*. Also, the upper column of each section illustrates the sub-field selection state of the display cell 12*d* and the lower column thereof illustrates the sub-field selection state of the display cell 12*e*. "0" illustrates the non-selection, and "1" illustrates the selection. In each column, 10 numerals are described, the numerals of the right end illustrate the selection/non-selection in SF1, and the numerals of the left end illustrate the selection/non-selection in SF10. As shown in FIG. 27, the selection of sub-field with respect to the input gradation level of each display cell 12 is uniquely determined by both input gradation levels of the two display cells 12*d* and 12*e* sharing one of the scanning electrodes 2.

Next, a method for determining the contents of LUT will be described. As described above, in the driving method according to the eighth embodiment, in the display cell 12*e* having the sustaining electrode 3 belonging to the sustaining electrode group 103*e*, discharge is generated in the first selecting operation period B, the first period G1 and the second period G2, although the image data is OFF, in case where display cell 12*d* sharing the scanning electrode 2 is ON.

Also, in the display cell 12*d* having the sustaining electrode 3 belonging to the sustaining electrode group 103*d*, opposite discharge is generated in the second selecting operation period D, although the image data is OFF. These discharges induce unnecessary light emission (crosstalk) with respect to display. And, in case where both the display cell 12*d* having the sustaining electrode 3 belonging to the sustaining electrode group 103*d* and the display cell 12*e* having the sustaining electrode 3 belonging to the sustaining electrode group 103*e* are ON, difference of display luminance occurs in accordance with difference of discharge form in the regulating period G and existence of discharge in the second selection scan period D. That is, although the same SF selection in the display cell 12*d* is performed, output luminance of the display cell 12*d* is varied in accordance with selection state of the display cell 12*e*.

Therefore, the contents of LUT in the present embodiment are determined by acquiring the combination of sub-field selections in which the difference of output level is the lowest with respect to each combination of input gradations of the two display cells 12 sharing the scanning electrode 2.

Figure 28:
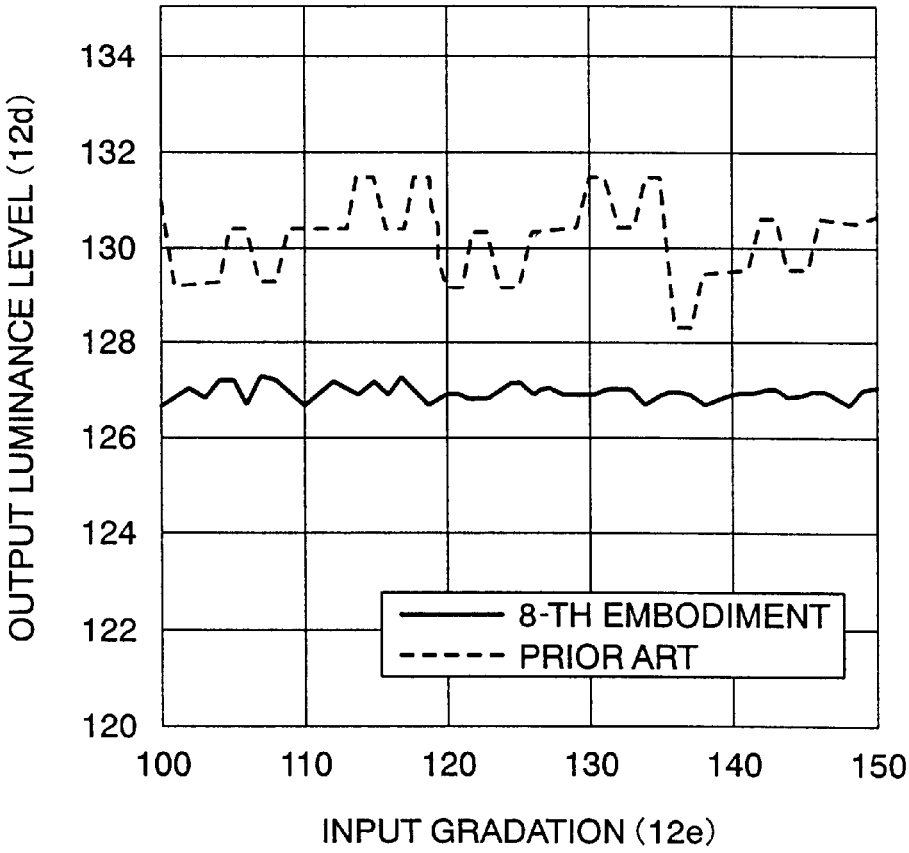
FIG. 28 is a graph illustrating change of output level of display cell 12*d* in case where input gradation level of display cell 12*d* is fixed to 127 and input gradation level of display cell 12*e* is changed into 100 to 150.
Figure 29:
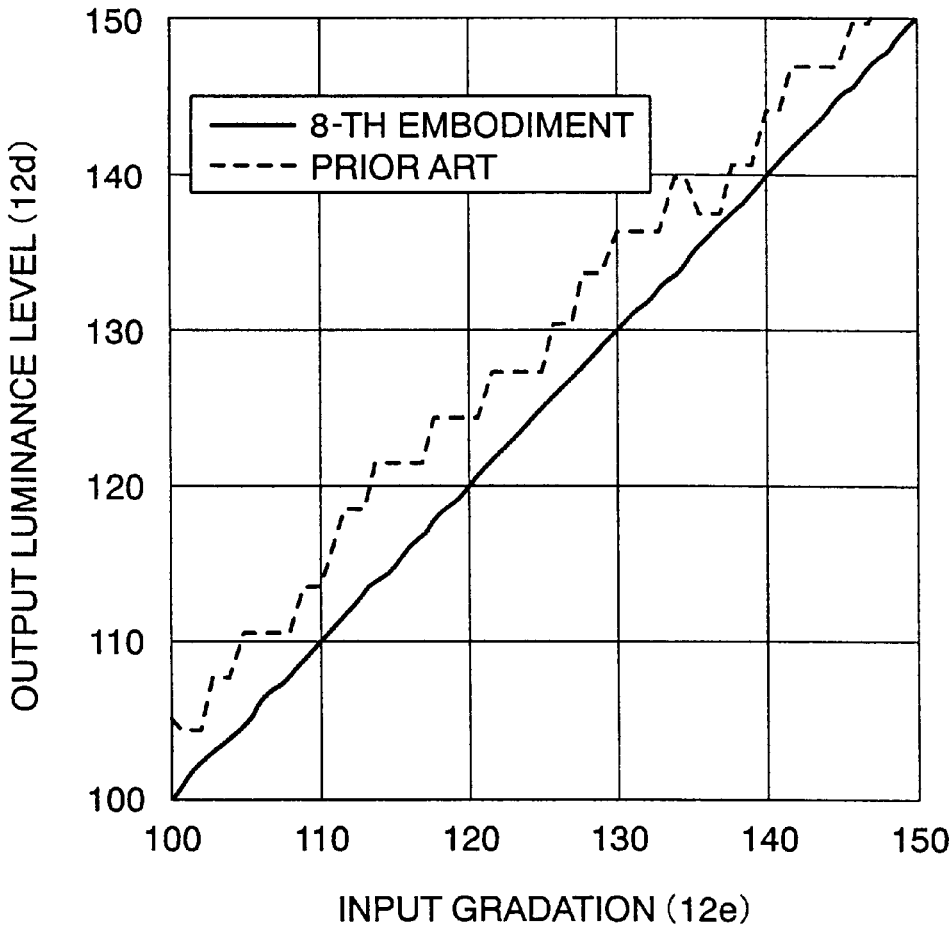
FIG. 29 is a graph illustrating change of output level of display cell 12*e* in case where input gradation level of display cell 12*d* is fixed to 127 and input gradation level of display cell 12*e* is changed into 100 to 150.

FIG. 28 is a graph illustrating change of output level of display cell 12*d* in case where input gradation level of display cell 12*d* is fixed to 127 and input gradation level of display cell 12*e* is changed into 100 to 150. FIG. 29 is a graph illustrating change of output level of display cell 12*e* in case where input gradation level of display cell 12*d* is fixed to 127 and input gradation level of display cell 12*e* is changed into 100 to 150. The solid line of the figures illustrates the change in case where LUT is used in the eighth embodiment, and the broken line illustrates the change in case where the conventional LUT is used. As shown in FIG. 28 and FIG. 29, by employing the sub-field selection method in the eighth embodiment, deviation between the input gradation level and the output luminance level is suppressed to not more than 1 gradation level. Accordingly, reversion of gradation level does not occur.

In such a manner, by combining the driving method and the sub-field selection method in the present embodiment, a progressive driving of the plasma display panel having high opening rate becomes available with maintaining natural gradation display.

In addition, crosstalk occurs even in the fifth embodiment, although it is low. In this regard, more strict gradation expression can be performed with employing the sub-field selection method illustrated in the present embodiment.

Figure 30:
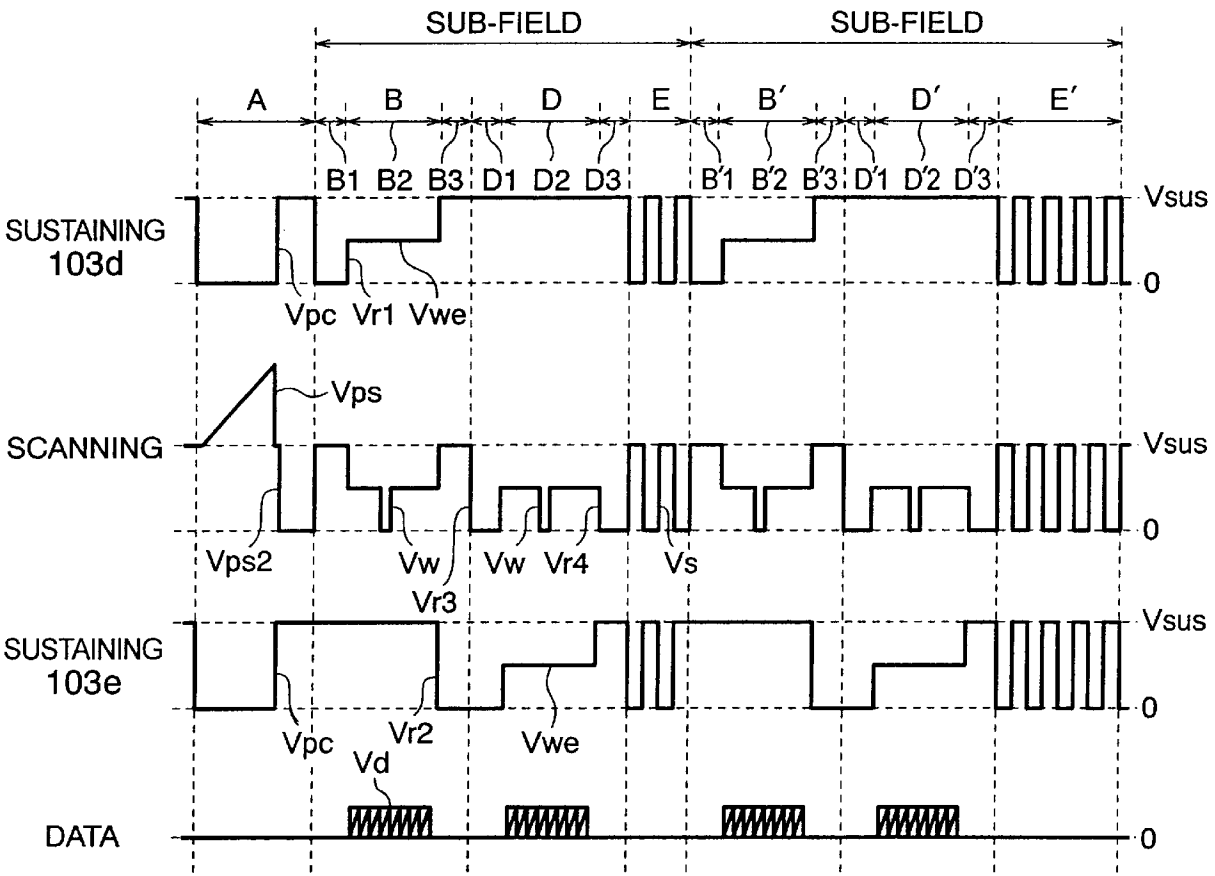
FIG. 30 is a timing chart illustrating a driving method of the plasma display panel according to a ninth embodiment of the present invention.
Figures 31A, 31B, 31C:
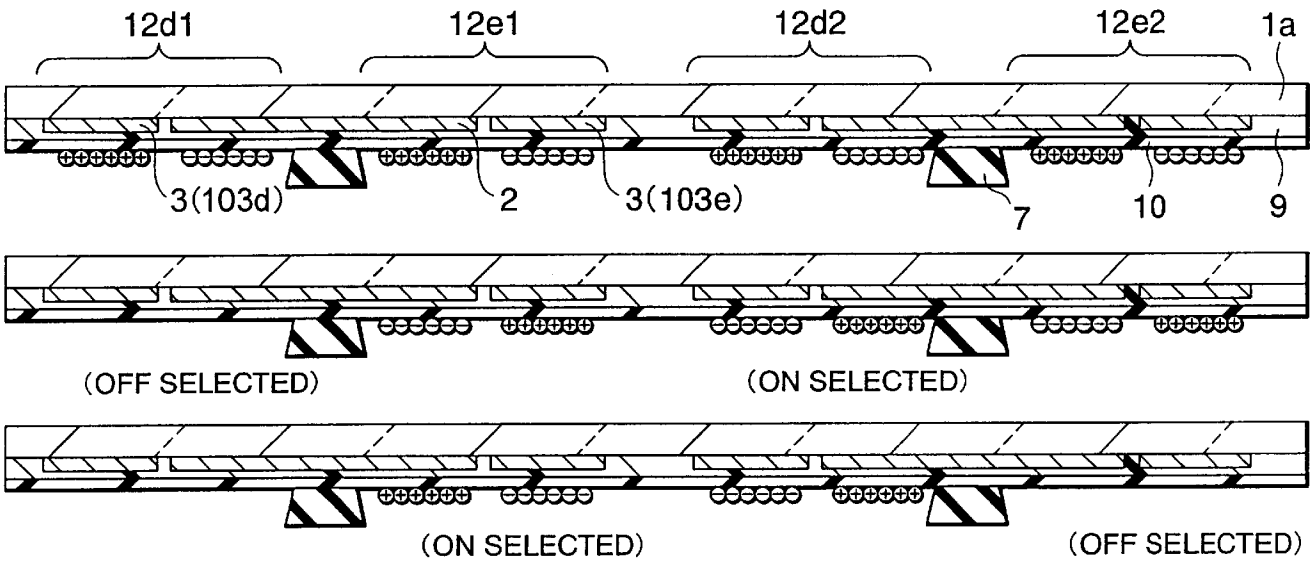
FIGS. 31 are schematic diagrams illustrating states of wall charge within display cells on the cross section taken along line B—B in FIG. 6.

Next, a ninth embodiment of the present invention will be described. The configuration of the plasma display panel according to the ninth embodiment is the same as that of the first embodiment, but the driving method is different. FIG. 30 is a timing chart illustrating a driving method of the plasma display panel according to the ninth embodiment of the present invention. Also, FIGS. 31 are schematic diagrams illustrating states of wall charge within display cells on the cross section taken along line B—B in FIG. 6, in which FIG. 31A to FIG. 31C sequentially illustrate states of wall charge at the time when periods B1, D1 and D3 in FIG. 30 are ended, respectively. In addition, in the present embodiment, a reference potential of plane electrode consisting of a scanning electrode 2 and a sustaining electrode 3 is taken a sustaining voltage Vsus for sustaining discharge in the sustaining period E. Accordingly, with respect to the scanning electrode 2 and the sustaining electrode 3, higher potential than the sustaining voltage Vsus is represented as a potential having positive polarity, and lower potential than the sustaining voltage Vsus is represented as a potential having negative polarity. Also, the potential of a data electrode 5 is taken from a reference of 0V.

First, in a pre-discharge period A, a first positive pre-discharge pulse Vps1 having a saw tooth shape is applied to the scanning electrode 2, and at the same time, a first negative pre-discharge pulse Vpc having a rectangular waveform is applied to the sustaining electrode groups 103*d* and 103*e*. Therefore, discharge is generated with the scanning electrode 2 as an anode, negative wall charge is formed on each scanning electrode 2, and positive wall charge is formed on each sustaining electrode 3. Subsequently, a second negative pre-discharge pulse Vps2 is applied to the scanning electrode 2. On the other hand, the sustaining electrode groups 103*d* and 103*e* are not applied with a pulse and are fixed to the sustaining voltage Vsus. As a result, the polarity of the wall charge on the sustaining electrode 3 and the scanning electrode 2 is inverted due to discharge, positive wall charge is formed on the scanning electrode 2, and negative wall charge is formed on the sustaining electrode 3.

Next, in a first period B1 of the first selecting operation period B, a first charge inverting pulse Vr1 having negative polarity is applied to the sustaining electrode group 103*d*. At this time, the scanning electrode 2 and the sustaining electrode group 103*e* are not applied with a pulse and are fixed to the sustaining voltage Vsus. Therefore, as shown in FIG. 31A, discharge is generated only in the display cell 12*d* having the sustaining electrode 3 belonging to the sustaining electrode group 103*d*. As a result, the polarity of the wall charge on the scanning electrode 2 and the sustaining electrode 3 is inverted, negative wall charge is formed on the scanning electrode 2, and positive wall charge is formed on the sustaining electrode 3.

After that, in a second period B2, negative scan pulses Vw are sequentially applied to the scanning electrode 2, and positive data pulse Vd is applied to the data electrode 5 in accordance with the image data of the display cells 12*d*1 and 12*d*2 having the sustaining electrode 3 belonging to the sustaining electrode group 103*d*. On the other hand, a scan erasing pulse Vwe is applied to the sustaining electrode group 103*d*, and the potential of the sustaining electrode group 103*e* is fixed to the sustaining voltage Vsus.

Therefore, the scan pulse Vw and the data pulse Vd are applied to the display cell 12*d*1 where the image data is OFF so that discharge is generated between the scanning electrode 2 and the data electrode 5. Also, substantially at the same time, this discharge is used as a trigger that discharge with the scanning electrode 2 as a cathode is generated between the scanning electrode 2 and the sustaining electrode 3. The applying time of the scan pulse Vw is set to be short, for example, about 1.5 μs. Also, the scan erasing pulse Vwe is applied to the sustaining electrode group 103*d* and the potential difference between the scanning electrode 2 and the sustaining electrode 3 is small. Therefore, there is no case that new wall charge is generated due to the discharge generated between the scanning electrode 2 and the sustaining electrode 3. On the other hand, because the data pulse Vd is not applied to the display cell 12*d*2 where the image data is ON, any discharge is not generated, and wall charge is maintained. Also, in the display cell 12*e* having the sustaining electrode 3 belonging to the sustaining electrode group 103*e*, positive wall charge is formed on the scanning electrode 2 so that the voltage due to the scan pulse Vw is compensated. Accordingly, discharge is not generated even in case where the data pulse Vd is applied.

After that, in a third period B3, a second charge inverting pulse Vr2 is applied to the sustaining electrode group 103*e*. At this time, the potentials of the scanning electrode 2 and the sustaining electrode group 103*d* are fixed to the sustaining voltage Vsus. Therefore, discharge is generated in the display cell 12*e* having the sustaining electrode 3 belonging to the sustaining electrode group 103*e*, and the polarity of wall charge on the scanning electrode 2 and the sustaining electrode 3 is inverted. As a result, negative wall charge is formed on the scanning electrode 2, and positive wall charge is formed on the sustaining electrode 3.

Subsequently, in a first period D1 of the second selecting operation period D, a third charge inverting pulse Vr3 having negative polarity is applied to the scanning electrode 2. At this time, the sustaining electrode group 103*d* is not applied with a pulse and is fixed to the sustaining voltage Vsus. The second inverting pulse Vr2 is continuously applied to the sustaining electrode group 103*e* from the third period B3. Therefore, as shown in FIG. 31B, discharge is generated only in the display cell 12*d*2, where discharge was not generated in the first selecting operation period B among the display cell 12*d*1 having the sustaining electrode 3 belonging to the sustaining electrode group 103*d*, and the polarity of wall charge on the scanning electrode 2 and the sustaining electrode 3 is inverted. As a result, positive wall charge is formed on the scanning electrode 2, and negative wall charge is formed on the sustaining electrode 3. FIG. 31B illustrates the case where the display cell 12*d*1 is in OFF selection and the display cell 12*d*2 is in ON selection.

After that, in a second period D2, negative scan pulses Vw are sequentially applied to the scanning electrode 2, and positive data pulse Vd is applied to the data electrode 5 in accordance with the image data of the display cells 12*d*1 and 12*d*2 having the sustaining electrode 3 belonging to the sustaining electrode group 103*e*. On the other hand, the scan erasing pulse Vwe is applied to the sustaining electrode group 103*e*, and the potential of the sustaining electrode group 103*d* is fixed to the sustaining voltage Vsus. Therefore, discharge is generated and wall charge is erased only in the display cell 12*e*2, where the image data is OFF and to which the data pulse Vd is applied.

After that, in a third period D3, a forth charge inverting pulse Vr4 is applied to the scanning electrode 2. At this time, the potentials of both the sustaining electrode groups 103*d* and 103*e* are fixed to the sustaining voltage Vsus. Therefore, discharge is generated only in the display cell 12*e*1, where discharge was not generated in the second period D2 among the display cell 12*e* having the sustaining electrode 3 belonging to the sustaining electrode 103*e*. As a result, the polarity of wall charge on the scanning electrode 2 and the sustaining electrode 3 is inverted, positive wall charge is formed on the scanning electrode 2, and negative wall charge is formed on the sustaining electrode 3. At this time, discharge is not generated in the display cell 12*d* having the sustaining electrode 3 belonging to the sustaining electrode group 103*d* because the polarity of the forth charge inverting pulse Vr4 is the same as that of the third charge inverting pulse Vr3. By these processes, as shown in FIG. 31C, positive wall charge is formed on the scanning electrode 2, and negative wall charge is formed on the sustaining electrode 3 in all the display cells 12 where display is performed. FIG. 31C illustrates the case where the display cell 12*e*1 is in ON selection and the display cell 12*e*2 is in OFF selection.

After that, in a sustaining discharge period E, sustaining discharge pulses Vs are applied to the scanning electrode 2 and the sustaining electrode 3, which have the polarities inverted each other. As a result, discharge is generated and light emission for display is achieved only in the display cell 12 in which wall charge was not erased, in the selecting operation periods B and D. The sustaining discharge period E is ended by discharge with the scanning electrode 2 as a cathode, and is continued as a first selecting operation period B' in the next sub-field.

The sustaining discharge is ended only in the final sub-field, in each field, by discharge with the scanning electrode 2 as an anode. After that, in a sustaining erasing period (not shown), with applying a sustaining erasing pulse (not shown) having an attenuating waveform to the scanning electrode 2, wall charge is erased, and discharge is stopped to be transferred to the next field.

As described above, according to the present embodiment, with the adjacent display cells 12 sharing the scanning electrode 2, a progressive driving of the plasma display panel with which high opening rate can be obtained becomes available.

In addition, as described above, in the driving method according to the present embodiment, the pre-discharge period A, in which wall charge is formed with respect to the display cell 12, is provided only in the sub-field positioned at the front end of each field. Accordingly, the address discharge is performed only one time in any one of sub-fields in all the display cells 12 in each field, and all becomes the non-selection state in the subsequent sub-fields. Accordingly, luminance level which can be expressed becomes the value that each luminance of sub-field is sequentially added from the front end thereof. And, the number of gradation levels which can be expressed is the value that 1 is added to the number of sub-fields.

Also, although these embodiments illustrates examples of combination of electrode arrangements and driving methods, the present invention is not limited to the combination of the electrode arrangements and the driving methods according to the above-mentioned embodiments, but includes all available combinations thereof. For example, the eighth or the ninth embodiment may be adapted to the plasma display panel having the structure shown in FIG. 10 and FIG. 11.

Although the technical spirits of the present invention has been disclosed with reference to the appended drawings and the preferred embodiments of the present invention corresponding to the drawings, the descriptions in the present specification are only for illustrative purpose, not for limiting the present invention.

Also, those who are skilled in the art will appreciate that various modifications, additions and substitutions are possible without departing from the scope and spirit of the present invention. Therefore, it should be understood that the present invention is limited only to the accompanying claims and the equivalents thereof, and includes the aforementioned modifications, additions and substitutions.

What is claimed is:

1. A plasma display panel comprising:

a first substrate and a second substrate disposed opposite to each other;

a plurality of scanning electrodes provided on a face side of said first substrate opposite to said second substrate and extended parallel to a first direction, said scanning electrodes being shared between adjacent display lines;

a plurality of sustaining electrodes provided by two between adjacent two scanning electrodes among said scanning electrodes, said sustaining electrodes being separated into a first sustaining electrode group in which a plurality of said sustaining electrodes disposed at one side of said scanning electrode are commonly connected and a second sustaining electrode group in which a plurality of sustaining electrodes disposed at the other side of said scanning electrode are commonly connected to be independently driven;

a plurality of data electrodes provided on a face side of said second substrate opposite to said first substrate and extended to a second direction perpendicular to said first direction;

a dielectric layer covering said scanning electrodes and said sustaining electrodes; and a partition wall partitioning said scanning electrodes into two regions in said second direction.

2. A driving method of a plasma display panel, said plasma display panel having: a first substrate and a second substrate disposed opposite to each other; a plurality of scanning electrodes provided on a face side of said first substrate opposite to said second substrate and extended parallel to a first direction, said scanning electrodes being commonly connected by a plural number in a sequence of order to make scanning electrode groups; a plurality of sustaining electrodes disposed by one between adjacent two scanning electrodes among said scanning electrodes, said sustaining electrodes being commonly connected so that the sustaining electrodes forming display lines between said scanning electrodes belonging to one of said scanning electrode groups belong to different sustaining electrode groups; a plurality of data electrodes provided on a face side of said second substrate opposite to said first substrate and extended to a second direction perpendicular to said first direction; and a dielectric layer covering said scanning electrodes and said sustaining electrodes, said method comprising the steps of:

generating a pre-discharge between one of said sustaining electrode groups and each of said scanning electrode groups; and performing a selecting operation in accordance with a image data of each of display cells in display lines generated with said pre-discharge, generating said pre-discharge and performing said selecting operation being repeated while sequentially selecting said sustaining electrode group, and at least one of the steps of performing said selecting operation having a step of generating an opposite discharge between said scanning electrode and said data electrode in a display cell performing display, thereby forming wall charge on said scanning electrode and said sustaining electrode.

3. A driving method of a plasma display panel, said plasma display panel having: a first substrate and a second substrate disposed opposite to each other; a plurality of scanning electrodes provided on a face side of said first substrate opposite to said second substrate and extended parallel to a first direction, said scanning electrodes being shared between adjacent display lines; a plurality of sustaining electrodes disposed by two between adjacent two scanning electrodes among said scanning electrodes, said sustaining electrodes being separated into a first sustaining electrode group in which a plurality of sustaining electrodes disposed at one side of said scanning electrode are commonly connected and a second sustaining electrode group in which a plurality of sustaining electrodes disposed at the other side of said scanning electrode are commonly connected; a plurality of data electrodes provided on a face side of said second substrate opposite to said first substrate and extended to a second direction perpendicular to said first direction; a dielectric layer covering said scanning electrodes and said sustaining electrodes; and a partition wall partitioning said scanning electrodes into two regions in said second direction, said method comprising the steps of:

generating a first pre-discharge between said first sustaining electrode group and said scanning electrodes;

performing a selecting operation in display lines generated with said first pre-discharge;

generating a second pre-discharge between said second sustaining electrode group and said scanning electrodes; and performing a selecting operation in display lines generated with said second pre-discharge.

4. A driving method of a plasma display panel, said plasma display panel having: a first substrate and a second substrate disposed opposite to each other; a plurality of scanning electrodes provided on a face side of said first substrate opposite to said second substrate and extended parallel to a first direction, said scanning electrodes being shared between adjacent display lines; a plurality of sustaining electrodes disposed by one between adjacent two scanning electrodes among said scanning electrodes, said sustaining electrodes being shared between adjacent display lines and being separated into a first sustaining electrode group in which an odd number of said sustaining electrodes are commonly connected and a second sustaining electrode group in which an even number of said sustaining electrodes are commonly connected; a plurality of data electrodes provided on a face side of said second substrate opposite to said first substrate and extended to a second direction perpendicular to said first direction; a dielectric layer covering said scanning electrodes and said sustaining electrodes; and a partition wall partitioning said scanning electrodes and said sustaining electrodes into two regions, respectively, in said second direction, said method comprising the steps of:

generating a first pre-discharge between said first sustaining electrode group and said scanning electrodes;

performing a selecting operation in display lines generated with said first pre-discharge;

generating a second pre-discharge between said second sustaining electrode group and said scanning electrodes; and performing a selecting operation in display lines generated with said second pre-discharge.

5. The driving method of a plasma display panel according to claim 3, wherein at least one of said steps of generating said pre-discharge comprises a step of forming wall charges having an opposite polarity with each other on said scanning electrode and said sustaining electrode, and performing a selecting operation right after said step of forming wall charges comprises a step of erasing wall charge of a display cell which does not perform display by generating opposite discharge between said scanning electrode and said data electrode.

6. The driving method of a plasma display panel according to claim 4, wherein at least one of said steps of generating said pre-discharge comprises a step of forming wall charges having an opposite polarity with each other on said scanning electrode and said sustaining electrode, and performing a selecting operation right after said step of forming wall charges comprises a step of erasing wall charge of a display cell which does not perform display by generating opposite discharge between said scanning electrode and said data electrode.

7. The driving method of a plasma display panel according to claim 5, further comprising the step of, after erasing said wall charge, generating discharge in a display cell in which wall charge was not erased to invert the polarity of wall charge.

8. The driving method of a plasma display panel according to claim 6, further comprising the step of, after erasing said wall charge, generating discharge in a display cell in which wall charge was not erased to invert the polarity of wall charge.

9. The driving method of a plasma display panel according to claim 3, wherein at least one of said steps of performing said selecting operation comprises a step of generating opposite discharge between said scanning electrode and said data electrode in a display cell which performs display, thereby forming wall charge on said scanning electrode and said sustaining electrode.

10. The driving method of a plasma display panel according to claim 4, wherein at least one of said steps of performing said selecting operation comprises a step of generating opposite discharge between said scanning electrode and said data electrode in a display cell which performs display, thereby forming wall charge on said scanning electrode and said sustaining electrode.

11. The driving method of a plasma display panel according to claim 3, wherein generating said first pre-discharge comprises the steps of: forming wall charge having opposite polarity with respect to a voltage pulse applied to said scanning electrode in performing said selecting operation on all of said scanning electrodes by pre-discharge; and applying an erasing pulse between said first sustaining electrode group and said scanning electrode to erase wall charge by pre-discharge;

performing said selecting operation in display lines generated with said first pre-discharge comprises the steps of: sustaining a voltage of said first sustaining electrode group as a voltage for generating sustaining discharge between said scanning electrodes; and generating opposite discharge between said scanning electrode and said data electrode in a display cell performing display on the display line in which erasing of wall charge is performed by said pre-discharge, thereby forming wall charge;

generating said second pre-discharge comprises the step of applying an erasing pulse between said second sustaining electrode group and said scanning electrode, thereby erasing said wall charge by pre-discharge, and performing said selecting operation in display lines generated with said second pre-discharge comprises the steps of: sustaining a voltage of said first sustaining electrode group as a voltage for not generating a sustaining discharge between said scanning electrodes; and generating opposite discharge between said scanning electrode and said data electrode in a display cell performing display on the display line in which erasing of wall charge is performed by said pre-discharge, thereby forming wall charge.

12. The driving method of a plasma display panel according to claim 4, wherein generating said first pre-discharge comprises the steps of: forming wall charge having opposite polarity with respect to a voltage pulse applied to said scanning electrode in performing said selecting operation on all of said scanning electrodes by pre-discharge; and applying an erasing pulse between said first sustaining electrode group and said scanning electrode to erase wall charge by pre-discharge;

performing said selecting operation in display lines generated with said first pre-discharge comprises the steps of: sustaining a voltage of said first sustaining electrode group as a voltage for generating sustaining discharge between said scanning electrodes; and generating opposite discharge between said scanning electrode and said data electrode in a display cell performing display on the display line in which erasing of wall charge is performed by said pre-discharge, thereby forming wall charge;

generating said second pre-discharge comprises the step of applying an erasing pulse between said second sustaining electrode group and said scanning electrode, thereby erasing said wall charge by pre-discharge, and performing said selecting operation in display lines generated with said second pre-discharge comprises the steps of: sustaining a voltage of said first sustaining electrode group as a voltage for not generating a sustaining discharge between said scanning electrodes; and generating opposite discharge between said scanning electrode and said data electrode in a display cell performing display on the display line in which erasing of wall charge is performed by said pre-discharge, thereby forming wall charge.

13. A driving method of a plasma display panel, said plasma display panel having: a first substrate and a second substrate disposed opposite to each other; a plurality of scanning electrodes provided on a face side of said first substrate opposite to said second substrate and extended parallel to a first direction, said scanning electrodes being shared between adjacent display lines; a plurality of sustaining electrodes disposed by two between adjacent two scanning electrodes among said scanning electrodes, said sustaining electrodes being separated into a first sustaining electrode group in which a plurality of sustaining electrodes disposed at one side of said scanning electrode are commonly connected and a second sustaining electrode group in which a plurality of sustaining electrodes disposed at the other side of said scanning electrode are commonly connected; a plurality of data electrodes provided on a face side of said second substrate opposite to said first substrate and extended to a second direction perpendicular to said first direction; a dielectric layer covering said scanning electrodes and said sustaining electrodes; and a partition wall partitioning said scanning electrodes into two regions in said second direction, said method comprising the steps of:

forming wall charge in a display cell having said sustaining electrode belonging to said first sustaining electrode group on the basis of image data, thereby the same polarity of wall charge is formed in a display cell sharing said scanning electrode and data electrode with said display cell and having said sustaining electrode belonging to said second sustaining electrode group;

erasing wall charge formed in a display cell having said sustaining electrode belonging to said second sustaining electrode group; and forming wall charge in a display cell having said sustaining electrode belonging to said second sustaining electrode group on the basis of display data.

14. A driving method of a plasma display panel, said plasma display panel having: a first substrate and a second substrate disposed opposite to each other; a plurality of scanning electrodes provided on a face side of said first substrate opposite to said second substrate and extended parallel to a first direction, said scanning electrodes being shared between adjacent display lines; a plurality of sustaining electrodes disposed by one between adjacent two scanning electrodes among said scanning electrodes, said sustaining electrodes being shared between adjacent display lines and being separated into a first sustaining electrode group in which an odd number of said sustaining electrodes are commonly connected and a second sustaining electrode group in which an even number of said sustaining electrodes are commonly connected; a plurality of data electrodes provided on a face side of said second substrate opposite to said first substrate and extended to a second direction perpendicular to said first direction; a dielectric layer covering said scanning electrodes and said sustaining electrodes; and a partition wall partitioning said scanning electrodes and said sustaining electrodes into two regions, respectively, in said second direction, said method comprising the steps of:

forming wall charge in a display cell having said sustaining electrode belonging to said first sustaining electrode group on the basis of image data, thereby the same polarity of wall charge is formed in a display cell sharing said scanning electrode and data electrode with said display cell and having said sustaining electrode belonging to said second sustaining electrode group;

erasing wall charge formed in a display cell having said sustaining electrode belonging to said second sustaining electrode group; and forming wall charge in a display cell having said sustaining electrode belonging to said second sustaining electrode group on the basis of display data.

15. A driving method of a plasma display panel, said plasma display panel having: a first substrate and a second substrate disposed opposite to each other; a plurality of scanning electrodes provided on a face side of said first substrate opposite to said second substrate and extended parallel to a first direction, said scanning electrodes being shared between adjacent display lines; a plurality of sustaining electrodes disposed by two between adjacent two scanning electrodes among said scanning electrodes, said sustaining electrodes being separated into a first sustaining electrode group in which a plurality of sustaining electrodes disposed at one side of said scanning electrode are commonly connected and a second sustaining electrode group in which a plurality of sustaining electrodes disposed at the other side of said scanning electrode are commonly connected; a plurality of data electrodes provided on a face side of said second substrate opposite to said first substrate and extended to a second direction perpendicular to said first direction; a dielectric layer covering said scanning electrodes and said sustaining electrodes; and a partition wall partitioning said scanning electrodes into two regions in said second direction, said method comprising the steps of:

forming wall charges having different polarities between a display cell having said sustaining electrode belonging to said first sustaining electrode group and a display cell having said sustaining electrode belonging to said second sustaining electrode group, on said scanning electrode and said sustaining electrode;

erasing said wall charge in a display cell having said sustaining electrode belonging to said first sustaining electrode group on the basis of display data;

inverting the polarity of said wall charges, respectively, in a display cell having said sustaining electrode belonging to said first and second sustaining electrode group; and erasing said wall charge in a display cell having said sustaining electrode belonging to said second sustaining electrode group on the basis of display data.

16. A driving method of a plasma display panel, said plasma display panel having: a first substrate and a second substrate disposed opposite to each other; a plurality of scanning electrodes provided on a face side of said first substrate opposite to said second substrate and extended parallel to a first direction, said scanning electrodes being shared between adjacent display lines; a plurality of sustaining electrodes disposed by one between adjacent two scanning electrodes among said scanning electrodes, said sustaining electrodes being shared between adjacent display lines and being separated into a first sustaining electrode group in which an odd number of said sustaining electrodes are commonly connected and a second sustaining electrode group in which an even number of said sustaining electrodes are commonly connected; a plurality of data electrodes provided on a face side of said second substrate opposite to said first substrate and extended to a second direction perpendicular to said first direction; a dielectric layer covering said scanning electrodes and said sustaining electrodes; and a partition wall partitioning said scanning electrodes and said sustaining electrodes into two regions, respectively, in said second direction, said method comprising the steps of:

forming wall charges having different polarities between a display cell having said sustaining electrode belonging to said first sustaining electrode group and a display cell having said sustaining electrode belonging to said second sustaining electrode group, on said scanning electrode and said sustaining electrode;

erasing said wall charge in a display cell having said sustaining electrode belonging to said first sustaining electrode group on the basis of display data;

inverting the polarity of said wall charges, respectively, in a display cell having said sustaining electrode belonging to said first and second sustaining electrode group; and erasing said wall charge in a display cell having said sustaining electrode belonging to said second sustaining electrode group on the basis of display data.

17. The driving method of a plasma display panel according to claim 5, further comprising the step of:

changing a sequence of said selecting operations between a display line including said sustaining electrode belonging to said first sustaining electrode group and a display line including said sustaining electrode belonging to said second sustaining electrode group by a field forming one image.

18. The driving method of a plasma display panel according to claim 6, further comprising the step of:

changing a sequence of said selecting operations between a display line including said sustaining electrode belonging to said first sustaining electrode group and a display line including said sustaining electrode belonging to said second sustaining electrode group by a field forming one image.

19. The driving method of a plasma display panel according to claim 7, further comprising the step of:

changing a sequence of said selecting operations between a display line including said sustaining electrode belonging to said first sustaining electrode group and a display line including said sustaining electrode belonging to said second sustaining electrode group by a field forming one image.

20. The driving method of a plasma display panel according to claim 8, further comprising the step of:

changing a sequence of said selecting operations between a display line including said sustaining electrode belonging to said first sustaining electrode group and a display line including said sustaining electrode belonging to said second sustaining electrode group by a field forming one image.

21. The driving method of a plasma display panel according to claim 9, further comprising the step of:

changing a sequence of said selecting operations between a display line including said sustaining electrode belonging to said first sustaining electrode group and a display line including said sustaining electrode belonging to said second sustaining electrode group by a field forming one image.

22. The driving method of a plasma display panel according to claim 10, further comprising the step of:

changing a sequence of said selecting operations between a display line including said sustaining electrode belonging to said first sustaining electrode group and a display line including said sustaining electrode belonging to said second sustaining electrode group by a field forming one image.

23. The driving method of a plasma display panel according to claim 11, further comprising the step of:

changing a sequence of said selecting operations between a display line including said sustaining electrode belonging to said first sustaining electrode group and a display line including said sustaining electrode belonging to said second sustaining electrode group by a field forming one image.

24. The driving method of a plasma display panel according to claim 12, further comprising the step of:

changing a sequence of said selecting operations between a display line including said sustaining electrode belonging to said first sustaining electrode group and a display line including said sustaining electrode belonging to said second sustaining electrode group by a field forming one image.

25. The driving method of a plasma display panel according to claim 13, further comprising the step of:

changing a sequence of said selecting operations between a display line including said sustaining electrode belonging to said first sustaining electrode group and a display line including said sustaining electrode belonging to said second sustaining electrode group by a field forming one image.

26. The driving method of a plasma display panel according to claim 14, further comprising the step of:

changing a sequence of said selecting operations between a display line including said sustaining electrode belonging to said first sustaining electrode group and a display line including said sustaining electrode belonging to said second sustaining electrode group by a field forming one image.

27. The driving method of a plasma display panel according to claim 15, further comprising the step of:

changing a sequence of said selecting operations between a display line including said sustaining electrode belonging to said first sustaining electrode group and a display line including said sustaining electrode belonging to said second sustaining electrode group by a field forming one image.

28. The driving method of a plasma display panel according to claim 16, further comprising the step of:

changing a sequence of said selecting operations between a display line including said sustaining electrode belonging to said first sustaining electrode group and a display line including said sustaining electrode belonging to said second sustaining electrode group by a field forming one image.

29. The driving method of a plasma display panel according to claim 5, further comprising the step of:

changing a sequence of said selecting operations between a display line including said sustaining electrode belonging to said first sustaining electrode group and a display line including said sustaining electrode belonging to said second sustaining electrode group by at least one addressing period.

30. The driving method of a plasma display panel according to claim 6, further comprising the step of:

changing a sequence of said selecting operations between a display line including said sustaining electrode belonging to said first sustaining electrode group and a display line including said sustaining electrode belonging to said second sustaining electrode group by at least one addressing period.

31. The driving method of a plasma display panel according to claim 7, further comprising the step of:

changing a sequence of said selecting operations between a display line including said sustaining electrode belonging to said first sustaining electrode group and a display line including said sustaining electrode belonging to said second sustaining electrode group by at least one addressing period.

32. The driving method of a plasma display panel according to claim 8, further comprising the step of:

changing a sequence of said selecting operations between a display line including said sustaining electrode belonging to said first sustaining electrode group and a display line including said sustaining electrode belonging to said second sustaining electrode group by at least one addressing period.

33. The driving method of a plasma display panel according to claim 9, further comprising the step of:

changing a sequence of said selecting operations between a display line including said sustaining electrode belonging to said first sustaining electrode group and a display line including said sustaining electrode belonging to said second sustaining electrode group by at least one addressing period.

34. The driving method of a plasma display panel according to claim 10, further comprising the step of:

changing a sequence of said selecting operations between a display line including said sustaining electrode belonging to said first sustaining electrode group and a display line including said sustaining electrode belonging to said second sustaining electrode group by at least one addressing period.

35. The driving method of a plasma display panel according to claim 11, further comprising the step of:

changing a sequence of said selecting operations between a display line including said sustaining electrode belonging to said first sustaining electrode group and a display line including said sustaining electrode belonging to said second sustaining electrode group by at least one addressing period.

36. The driving method of a plasma display panel according to claim 12, further comprising the step of:

changing a sequence of said selecting operations between a display line including said sustaining electrode belonging to said first sustaining electrode group and a display line including said sustaining electrode belonging to said second sustaining electrode group by at least one addressing period.

37. The driving method of a plasma display panel according to claim 13, further comprising the step of:

changing a sequence of said selecting operations between a display line including said sustaining electrode belonging to said first sustaining electrode group and a display line including said sustaining electrode belonging to said second sustaining electrode group by at least one addressing period.

38. The driving method of a plasma display panel according to claim 14, further comprising the step of:

changing a sequence of said selecting operations between a display line including said sustaining electrode belonging to said first sustaining electrode group and a display line including said sustaining electrode belonging to said second sustaining electrode group by at least one addressing period.

39. The driving method of a plasma display panel according to claim 15, further comprising the step of:

changing a sequence of said selecting operations between a display line including said sustaining electrode belonging to said first sustaining electrode group and a display line including said sustaining electrode belonging to said second sustaining electrode group by at least one addressing period.

40. The driving method of a plasma display panel according to claim 16, further comprising the step of:

changing a sequence of said selecting operations between a display line including said sustaining electrode belonging to said first sustaining electrode group and a display line including said sustaining electrode belonging to said second sustaining electrode group by at least one addressing period.

41. The driving method of a plasma display panel according to claim 5, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

42. The driving method of a plasma display panel according to claim 6, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

43. The driving method of a plasma display panel according to claim 7, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

44. The driving method of a plasma display panel according to claim 8, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

45. The driving method of a plasma display panel according to claim 9, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

46. The driving method of a plasma display panel according to claim 10, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

47. The driving method of a plasma display panel according to claim 11, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

48. The driving method of a plasma display panel according to claim 12, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

49. The driving method of a plasma display panel according to claim 13, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

50. The driving method of a plasma display panel according to claim 14, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

51. The driving method of a plasma display panel according to claim 15, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

52. The driving method of a plasma display panel according to claim 16, further comprising the steps of:

changing a sequence of said selecting operations by at least one address period between a display line including said sustaining electrode belonging to said first sustaining electrode group and a display line including said sustaining electrode belonging to said second sustaining electrode group; and changing a sequence of said selecting scans by field consisting one screen between said display lines.

53. The driving method of a plasma display panel according to claim 2, further comprising the step of:

changing a sequence of said selecting operations between a plurality of said display lines by a field forming one image.

54. The driving method of a plasma display panel according to claim 2, further comprising the step of:

changing a sequence of said selecting operations between a plurality of said display lines by at least one address period.

55. The driving method of a plasma display panel according to claim 2, further comprising the step of:

changing a sequence of said selecting operations between a plurality of said display lines by at least one address period; and changing a sequence of said selecting operations between a plurality of said display lines by field consisting one screen.

56. A driving method of a plasma display panel, said plasma display panel having: a first substrate and a second substrate disposed opposite to each other; a plurality of scanning electrodes provided on a face side of said first substrate opposite to said second substrate and extended parallel to a first direction, said scanning electrodes being shared between adjacent display lines; a plurality of sustaining electrodes disposed by two between adjacent two scanning electrodes among said scanning electrodes, said sustaining electrodes being separated into a first sustaining electrode group in which a plurality of sustaining electrodes disposed at one side of said scanning electrode are commonly connected and a second sustaining electrode group in which a plurality of sustaining electrodes disposed at the other side of said scanning electrode are commonly connected; a plurality of data electrodes provided on a face side of said second substrate opposite to said first substrate and extended to a second direction perpendicular to said first direction; a dielectric layer covering said scanning electrodes and said sustaining electrodes; and a partition wall partitioning said scanning electrodes into two regions in said second direction, said method comprising the step of:

selecting subfield in consideration of each input gradation level of two display cells sharing said scanning electrode and data electrode, a plurality of gradation levels being expressed with a combination of the selected subfields.

57. A driving method of a plasma display panel, said plasma display panel having: a first substrate and a second substrate disposed opposite to each other; a plurality of scanning electrodes provided on a face side of said first substrate opposite to said second substrate and extended parallel to a first direction, said scanning electrodes being shared between adjacent display lines; a plurality of sustaining electrodes disposed by one between adjacent two scanning electrodes among said scanning electrodes, said sustaining electrodes being shared between adjacent display lines and being separated into a first sustaining electrode group in which an odd number of said sustaining electrodes are commonly connected and a second sustaining electrode group in which an even number of said sustaining electrodes are commonly connected; a plurality of data electrodes provided on a face side of said second substrate opposite to said first substrate and extended to a second direction perpendicular to said first direction; a dielectric layer covering said scanning electrodes and said sustaining electrodes; and a partition wall partitioning said scanning electrodes and said sustaining electrodes into two regions, respectively, in said second direction, said method comprising the step of:

selecting subfield in consideration of each input gradation level of two display cells sharing said scanning electrode and data electrode, a plurality of gradation levels being expressed with a combination of the selected subfields.

58. The driving method of a plasma display panel according to claim 56, wherein selecting subfield comprises a step of considering a relation between an input gradation level of said both display cells and an amount of light emission due to interference of said both display cells.

59. The driving method of a plasma display panel according to claim 57, wherein said selecting subfield comprises a step of considering a relation between an input gradation level of said both display cells and an amount of light emission due to interference of said both display cells.

60. The driving method of a plasma display panel according to claim 56, wherein said selecting subfield is performed such that difference between output gradation level including an amount of light emission due to the interference of said both display cells and said input gradation level is minimized.

61. The driving method of a plasma display panel according to claim 57, wherein said selecting subfield is performed such that difference between output gradation level including an amount of light emission due to the interference of said both display cells and said input gradation level is minimized.

* * * * *